US007329978B2

(12) United States Patent
Konishi

(10) Patent No.: US 7,329,978 B2
(45) Date of Patent: Feb. 12, 2008

(54) COLD CATHODE FIELD EMISSION DISPLAY

(75) Inventor: Morikazu Konishi, Kanagawa (JP)

(73) Assignee: Sony Corporation (JP)

( * ) Notice: Subject to any disclaimer, the term of this patent is extended or adjusted under 35 U.S.C. 154(b) by 313 days.

(21) Appl. No.: 10/547,383

(22) PCT Filed: Feb. 19, 2004

(86) PCT No.: PCT/JP2004/001875

§ 371 (c)(1),
(2), (4) Date: Aug. 31, 2005

(87) PCT Pub. No.: WO2004/081965

PCT Pub. Date: Sep. 23, 2004

(65) Prior Publication Data

US 2006/0170008 A1 Aug. 3, 2006

(30) Foreign Application Priority Data

Mar. 12, 2003 (JP) ..... 2003-065889

(51) Int. Cl.
*G09G 3/22* (2006.01)

(52) U.S. Cl. ..... 313/306; 313/309; 315/169.3

(58) Field of Classification Search ..... 313/306, 313/307, 308, 309; 315/169.3
See application file for complete search history.

(56) References Cited

U.S. PATENT DOCUMENTS 6,278,228 B1 * 8/2001 Iwase et al. ..... 313/306
7,064,493 B2 * 6/2006 Konishi ..... 315/169.1

FOREIGN PATENT DOCUMENTS

| | | |
|---|---|---|
| JP | 09-090898 | 4/1997 |
| JP | 2000-323013 | 11/2000 |
| JP | 2001-243893 | 9/2001 |
| JP | 2003-031150 | 1/2003 |
| JP | 2004-047408 | 2/2004 |

OTHER PUBLICATIONS

International Search Report mailed May 25, 2004.
International Search Opinion mailed May 25, 2005.

* cited by examiner

*Primary Examiner*—David H. Vu
(74) *Attorney, Agent, or Firm*—Rader Fishman & Grauer PLLC; Ronald P. Kananen

(57) ABSTRACT

A cold cathode field emission display comprising a cathode panel CP having a plurality of cold cathode field emission devices and an anode panel AP which panels are bonded to each other in their circumferential portions, the anode panel AP comprising a substrate 30, a phosphor layer 31 formed on the substrate 30, an anode electrode 35 formed on the phosphor layer 31 and a resistance layer 36 for controlling a discharge current, the resistance layer 36 formed on the anode electrode 35 and having a thickness of $t_R$ (unit: μm), and the cold cathode field emission display satisfying the following expression, where "C" represents an electrostatic capacity (F) between the cold cathode field emission device and the anode electrode, and "$V_A$" is a voltage (V) applied to the anode electrode $$t_R \times 10^{-2} > (1/2) C \cdot V_A^2.$$

21 Claims, 29 Drawing Sheets

[STEP–A3]

[STEP–A4]

[STEP–A5]

[STEP–A6]

[STEP–B3]

[STEP–B5]

[STEP-B6]

[STEP-B7]

COLD CATHODE FIELD EMISSION DISPLAY

TECHNICAL FIELD

The present invention relates to a cold cathode field emission display characterized in an anode electrode formed in an anode panel or a focus electrode provided in a cold cathode field emission device formed on a cathode panel.

BACKGROUND ART

In the fields of displays for use in television receivers and information terminals, studies have been made for replacing conventional mainstream cathode ray tubes (CRT) with flat-panel displays which are to comply with demands for a decrease in thickness, a decrease in weight, a larger screen and a high fineness. Such flat panel displays include a liquid crystal display (LCD), an electroluminescence display (ELD), a plasma display panel (PDP) and a cold cathode field emission display (FED). Of these, a liquid crystal display is widely used as a display for an information terminal. For applying the liquid crystal display to a floor-type television receiver, however, it still has problems to be solved concerning a higher brightness and an increase in size. In contrast, a cold cathode field emission display (to be sometimes referred to as "display" hereinafter) uses cold cathode field emission devices (to be sometimes referred to as "field emission device" hereinafter) capable of emitting electrons from a solid into a vacuum on the basis of a quantum tunnel effect without relying on thermal excitation, and it is of great interest from the viewpoints of a high brightness and a low power consumption.

As one example of the above field emission device, FIG. 26 shows a schematic partial end view of a filed emission device as shown in FIG. 2 to JP-A-9-90898.

In this field emission device, an insulating layer 2 is deposited on a substrate 1, and a control electrode (gate electrode) 3 made of a metal thin film is stacked on the insulating layer 2. A single cavity (opening portion) or a plurality of cavities (opening portions) is/are formed in the insulating layer 2 and the control electrode 3, and an emitter (electron emitting portion) 4 having the form of a cone is formed therein. An insulating layer 5 and a focus electrode 6 are stacked on the control electrode 3 excluding vicinities of the emitter 4. The substrate 1, the insulating layer 2, the control electrode 3, the emitter 4, the insulating layer 5 and the focus electrode 6 constitute a micro cold cathode (field emission device) 7, and a single micro cold cathode or a plurality of micro cold cathodes constitutes or constitute a cold cathode 15. In effect, electron beams 8 emitted from the emitter (electron emitting portion) 4 collide with an anode (anode electrode) 9, and flow in an anode-electrode power source (anode-electrode control circuit) 10 that generates positive voltage.

A voltage to be applied to the control electrode (gate electrode) 3 is generated in a control-electrode power source (gate-electrode control circuit) 17, and a voltage obtained by potential-dividing the voltage to be applied to the control electrode 3 with a variable resistor is applied to the focus electrode 6. As a result, the ratio of the voltage of the control electrode 3 and the voltage of the focus electrode 6 is constantly maintained at a value set with the variable resistor 14. When the focus state in a certain beam current quantity is adjusted with the variable resistor 14, a nearly equivalent focus state is maintained even if the electron beam current set value taken out from the emitter 4 is changed with an output voltage of the control electrode power source 17.

Meanwhile, in such a display, the distance between the anode (anode electrode) 9 and the focus electrode 6 is approximately 1 mm at the largest, and an abnormal discharge (vacuum arc discharge) is likely to occur between the anode 9 and the focus electrode 6. When an abnormal discharge occurs, the voltage of the focus electrode 6 or the control electrode (gate electrode) 3 abnormally increases, so that display performance is impaired in display quality, and further that the field emission device (control electrode 3, emitter 4), the focus electrode 6 and the anode (anode electrode) 9 may be damaged.

In a mechanism in which a discharge takes place in a vacuum space, first, electrons and ions that are emitted from the field emission device under a strong electric field work as a trigger to cause a small-scaled discharge. And, energy is supplied to the anode electrode 9 from the anode-electrode power source (anode-electrode control circuit) 10, the anode electrode 9 is locally temperature-increased, and an occluded gas inside the anode electrode 9 is released, or a material constituting the anode electrode 9 is caused to vaporize, so that the small-scaled discharge presumably grows to be an abnormal discharge. Besides the anode-electrode power source (anode-electrode control circuit) 10, energy accumulated in an electrostatic capacity formed between the anode electrode 9 and the field emission device may possibly work as a source for supplying energy that promotes the growth to the abnormal discharge.

For inhibiting the abnormal discharge (vacuum arc discharge), it is effective to control the emission of electrons and ions which trigger the discharge, while it is required to control the particles extremely strictly therefor. In a general production process of the cathode panels or the anode panels or the display panels using the anode panels or the cathode panels, practicing the above control involves great technical difficulties.

It is therefore an object of the present invention to provide a cold cathode field emission display that is so structured to be capable of inhibiting the occurrence of critical damage caused by energy, which is generated by an electrostatic capacity between the anode electrode and the field emission device, on an anode electrode or an electrode constituting the cold cathode field emission device even when a discharge takes place between the electrode constituting the cold cathode field emission device and the anode electrode.

DISCLOSURE OF THE INVENTION

The cold cathode field emission display according to a first aspect of the present invention for achieving the above object is a cold cathode field emission display comprising a cathode panel having a plurality of cold cathode field emission devices and an anode panel which panels are bonded to each other in their circumferential portions, the anode panel comprising a substrate, a phosphor layer formed on the substrate, an anode electrode formed on the phosphor layer and a resistance layer for controlling a discharge current, the resistance layer being formed on the anode electrode and having a thickness of $t_R$ (unit: μm), and the cold cathode field emission display satisfying the following expression (1).

$$Q>(1/2)C\cdot V_A^2 \quad (1)$$

The cold cathode field emission display according to a second aspect of the present invention for achieving the above object is a cold cathode field emission display comprising a cathode panel having a plurality of cold cathode field emission devices and an anode panel which panels are bonded to each other in their circumferential portions, the anode panel comprising a substrate, a phosphor layer formed on the substrate, an anode electrode formed on the phosphor layer and a resistance layer for controlling a discharge current, the resistance layer being formed on the anode electrode and having a thickness of $t_R$ (unit: μm), and the cold cathode field emission display satisfying the following expression (2).

$$t_R \times 10^{-2} > (1/2) C \cdot V_A^2 \quad (2)$$

The cold cathode field emission display according to the first or second aspect of the present invention may have a constitution that each cold cathode field emission device comprises:

(a) a cathode electrode being formed on the supporting member and extending in a first direction,
(b) an insulating layer formed on the supporting member and the cathode electrode,
(c) a gate electrode being formed on the insulating layer and extending in a second direction different from the first direction,
(d) an insulating film formed on the gate electrode and the insulating layer,
(e) a focus electrode formed on the insulating film,
(f) an opening portion formed through the focus electrode, the insulating film, the gate electrode and the insulating layer, and
(g) an electron-emitting portion exposed in a bottom portion of the opening portion.

In this case, each cold cathode field emission device may have a constitution further comprising:

(h) a second resistance layer for controlling a discharge current, the second resistance layer being formed on the focus electrode and having a thickness of $t'_R$ (unit: μm). In this case, the cold cathode field emission display according to the first aspect of the present invention preferably satisfies $$Q' = (1/2) C' \cdot V_A^2 \quad (1')$$

and the cold cathode field emission display according to the second aspect of the present invention preferably satisfies $$t'_R \times 10^{-2} > (1/2) C' \cdot V_A^2 \quad (2').$$

Alternatively, the cold cathode field emission display according to the first or second aspect of the present invention may have a constitution that each cold cathode field emission device comprises:

(a) a cathode electrode being formed on a supporting member and extending in a first direction,
(b) an insulating layer formed on the supporting member and the cathode electrode,
(c) a gate electrode being formed on the insulating layer and extending in a second direction different from the first direction,
(d) an opening portion formed through the gate electrode and the insulating layer, and
(e) an electron-emitting portion exposed in a bottom portion of the opening portion.

The cold cathode field emission display according to a third aspect of the present invention for achieving the above object is a cold cathode field emission display comprising a cathode panel having a plurality of cold cathode field emission devices and an anode panel which panels are bonded to each other in their circumferential portions, the anode panel comprising a substrate, a phosphor layer formed on the substrate and an anode electrode formed on the phosphor layer, each cold cathode field emission device comprising:

(A) a cathode electrode being formed on a supporting member and extending in a first direction,
(B) an insulating layer formed on the supporting member and the cathode electrode,
(C) a gate electrode being formed on the insulating layer and extending in a second direction different from the first direction,
(D) an insulating film formed on the gate electrode and the insulating layer,
(E) a focus electrode formed on the insulating film,
(F) a resistance layer for controlling a discharge current, the resistance layer being formed on the focus electrode and having a thickness of $t_R$ (unit: μm),
(G) an opening portion formed through the focus electrode, the insulating film, the gate electrode and the insulating layer, and
(H) an electron-emitting portion exposed in a bottom portion of the opening portion, and the cold cathode field emission display satisfying the following expression (3).

$$Q > (1/2) C \cdot V_A^2 \quad (3)$$

The cold cathode field emission display according to a fourth aspect of the present invention for achieving the above object is a cold cathode field emission display comprising a cathode panel having a plurality of cold cathode field emission devices and an anode panel which panels are bonded to each other in their circumferential portions, the anode panel comprising a substrate, a phosphor layer formed on the substrate and an anode electrode formed on the phosphor layer, each cold cathode field emission device comprising:

(A) a cathode electrode being formed on a supporting member and extending in a first direction,
(B) an insulating layer formed on the supporting member and the cathode electrode,
(C) a gate electrode being formed on the insulating layer and extending in a second direction different from the first direction,
(D) an insulating film formed on the gate electrode and the insulating layer,
(E) a focus electrode formed on the insulating film,
(F) a resistance layer for controlling a discharge current, the resistance layer being formed on the focus electrode and having a thickness of $t_R$ (unit: μm),
(G) an opening portion formed through the focus electrode, the insulating film, the gate electrode and the insulating layer, and
(H) an electron-emitting portion exposed in a bottom portion of the opening portion, and the cold cathode field emission display satisfying the following expression (4).

$$t_R \times 10^{-2} > (1/2) C \cdot V_A^2 \quad (4)$$

In the cold cathode field emission display according to the first or third aspect of the present invention, when a material constituting the resistance layer vaporizes from a solid phase through a liquid phase, the following expression is given.

$$Q \approx \pi \cdot t_R \cdot r_R^2 \cdot d_R \times [C_{m_S}(T_L - T_r) + Q_{S_L} + C_{m_L}(T_G - T_L) + Q_{L_G}] \times 10^{-6}$$

In the cold cathode field emission display according to the first or third aspect of the present invention, when a material constituting the resistance layer vaporizes from a solid phase directly, the following expression is given.

$$Q \approx \pi \cdot t_R \cdot r_R^2 \cdot d_R \times [C_{m_S}(T_G - T_r) + Q_{L_G}] \times 10^{-6}$$

In the cold cathode field emission display according to any one of the first to fourth aspects of the present invention, $V_A$ is a voltage (V) to be applied to the anode electrode.

In the expressions (1) to (4), rigorously, $V_A$ represents a voltage difference between a voltage to be applied to the anode electrode and a voltage to be applied to that electrode (for example, a focus electrode) of the cold cathode field emission device which is opposed to the anode electrode. Since, however, the voltage to be applied to the anode electrode is sufficiently high as compared with the voltage to be applied to that electrode (for example, a focus electrode) of the cold cathode field emission device which is opposed to the anode electrode, it is determined that $V_A$ on the right-hand side of each of the expressions (1) to (4) is a voltage to be applied to the anode electrode.

In the cold cathode field emission display according to the first or second aspect of the present invention, "C" represents an electrostatic capacity (F) between the cold cathode field emission device and the anode electrode. In the cold cathode field emission display according to the third or fourth aspect of the present invention, "C" represents an electric capacity (F) between the focus electrode and the anode electrode. In a preferred embodiment according to the first aspect of the present invention, "C'" represents an electrostatic capacity (F) between the focus electrode and the anode electrode.

In the cold cathode field emission display according to the first or third aspect of the present invention, further, $r_R$: a radius (mm) of a vaporization-allowable region of the resistance layer, $d_R$: a density ($g \cdot cm^{-3}$) of a material constituting the resistance layer, $C_{m_S}$: a specific heat ($J \cdot g^{-1} \cdot K^{-1}$) of a material constituting the resistance layer in a solid state, $T_L$: a melting point (° C.) of a material constituting the resistance layer, $T_r$: room temperature (° C.), $Q_{S_L}$: a heat of solution ($J \cdot g^{-1}$) of a material constituting the resistance layer, $C_{m_L}$: a specific heat ($J \cdot g^{-1} \cdot K^{-1}$) of a material constituting the resistance layer in a liquid state, $T_G$: a boiling point (° C.) of a material constituting the resistance layer.

Further, when the material constituting the resistance layer vaporizes from a solid phase through a liquid phase, $Q_{L_G}$: a heat of vaporization ($J \cdot g^{-1}$) of a material constituting a resistance layer.

When a material constituting the resistance layer vaporizes from a solid phase directly, $Q_{L_G}$: a sum ($J \cdot g^{-1}$) of a heat of vaporization and a heat of solution of a material constituting the resistance layer.

In a preferred embodiment according to the first aspect of the present invention, when a material constituting the second resistance layer vaporizes from a solid phase through a liquid phase, the following expression is given.

$$Q' \approx \pi \cdot t'_R \cdot r'^2_R \cdot d'_R \times [C'_{m_S}(T'_L - T_r) + Q'_{S_L} + C'_{m_L}(T'_G - T'_L) + Q'_{L_G}] \times 10^{-6}$$

Alternatively, in a preferred embodiment according to the first aspect of the present invention, when a material constituting the second resistance layer vaporizes from a solid phase directly, the following expression is given.

$$Q' \approx \pi \cdot t'_R \cdot r'^2_R \cdot d'_R \times [C'_{m_S}(T'_G - T_r) + Q'_{L_G}] \times 10^{-6}$$

In the above expression, $r'_R$: a radius (mm) of a vaporization-allowable region of the second resistance layer, $d'_R$: a density ($g \cdot cm^{-3}$) of a material constituting the second resistance layer, $C'_{m_S}$: a specific heat ($J \cdot g^{-1} \cdot K^{-1}$) of a material constituting the second resistance layer in a solid state, $T'_L$: a melting point (° C.) of a material constituting the second resistance layer, $T_r$: room temperature (° C.), $Q'_{S_L}$: a heat of solution ($J \cdot g^{-1}$) of a material constituting the second resistance layer, $C'_{m_L}$: a specific heat ($J \cdot g^{-1} \cdot K^{-1}$) of a material constituting the second resistance layer in a liquid state, $T'_G$: a boiling point (° C.) of a material constituting the second resistance layer.

Further, when a material constituting the second resistance layer vaporizes from a solid phase through a liquid phase, $Q'_{L_G}$: a heat of vaporization ($J \cdot g^{-1}$) of a material constituting the second resistance layer.

When a material constituting the second resistance layer vaporizes from a solid phase directly, $Q'_{L_G}$: a sum ($J \cdot g^{-1}$) of a heat of solution and a heat of vaporization of a material constituting the second resistance layer.

The electrostatic capacity "C" between the cold cathode field emission device and the anode electrode can be measured as follows. When the cold cathode field emission device comprises a cathode electrode and a gate electrode, all of gate electrodes are short-circuited and an electrostatic capacity between such a short-circuited gate electrode and the anode electrode is measured by a known method. When the cold cathode field emission device comprises a cathode electrode, a gate electrode and a focus electrode, an electrostatic capacity between the focus electrode and the anode electrode is measured by a known method.

The vaporization-allowable region of the resistance layer or the second resistance layer does not have any circular form, the radius of a circle having the same area as that of the region can be regarded as $r_R$ or $r'_R$.

In the cold cathode field emission device provided in the the cold cathode field emission display according to any one of the first to fourth aspects of the present invention including the preferred embodiments (these will be sometimes referred to as "the display of the present invention" hereinafter), preferably, the cathode electrode and the gate electrode have the form of a stripe, and the projection image of the cathode electrode and the projection image of the gate electrode cross each other at right angles in view of the simplification of structure of the cold cathode field emission display.

In the display of the present invention, desirably, the focus electrode has the form of one sheet that covers an effective field (a region to function as an actual display portion). An opening portion is formed in the focus electrode for passing electrons emitted from an electron-emitting region or an electron-emitting portion through the focus electrode. The above opening portion may be provided in each cold cathode field emission device, or may be provided in each electron-emitting region (each overlap region). The electron-emitting region is constituted of a single or a plurality of electron-emitting portions, which constitutes the electron emission device, formed in a region (an overlap region) where a projection image of the cathode electrode and a projection image of the gate electrode overlap.

In the display of the present invention, the anode electrode may have a constitution having the form of one sheet that covers the effective field, or may be constituted of a set of N anode electrode units ($N \geqq 2$). In the latter case, the above "C" represents an electrostatic capacity (unit: F) between the cold cathode field emission device or the focus electrode and the anode electrode unit. In the anode electrode unit, for example, when the total number of columns of unit phosphor layers (phosphor layers that generate one bright spot in a display) that are arranged in the form of a straight line and constitute one subpixel is n, there may be employed a constitution in which N=n, there may be employed another constitution in which $n=\alpha \cdot N$ ($\alpha$ is an integer of 2 or more, preferably $10 \leqq \alpha \leqq 100$, more preferably $20 \leqq \alpha \leqq 50$), or the number N may be a number obtained by adding 1 to the number of spacers (to be described later) provided at regular intervals. The size of each of the anode electrode units may be constant regardless of their positions or may be different depending upon their positions.

When the distance between the anode electrode unit and the cold cathode field emission device is "L" (unit: mm) and when the anode electrode unit has an area $S_{AU}$ (unit: $mm^2$), preferably, $(V_A/7)^2 \times (S_{AU}/L) \leqq 2250$ is satisfied, more preferably, $(V_A/7)^2 \times (S_{AU}/L) \leqq 450$ is satisfied, for preventing the scale-up of damage caused on the anode electrode unit, such as melting of the anode electrode unit, due to a discharge between the anode electrode unit and the cold cathode field emission device. When a convexoconcave shape exists in the anode electrode unit and when the distance "L" between the anode electrode unit and the cold cathode field emission device is not constant, the shortest distance between the anode electrode unit and the cold cathode field emission device is taken as "L".

In the display of the present invention, the material for constituting the resistance layer includes carbon materials such as silicon carbide (SiC) and SiCN; SiN; refractory metal oxides such as ruthenium oxide ($RuO_2$), tantalum oxide, tantalum oxide, chromium oxide and titanium oxide; semiconductor materials such as amorphous silicon; and ITO. The resistance layer can be formed by a PVD method such as a vapor deposition method and a sputtering method; or a CVD method.

Examples of the cold cathode field emission device (to be abbreviated as "field emission device" hereinafter) include:

(1) a Spindt-type field emission device (field emission device in which a conical electron-emitting portion is formed on the cathode electrode positioned in the bottom portion of the opening portion), (2) a plane-type field emission device (field emission device in which a nearly plane-surface-shaped electron-emitting portion is formed on the cathode electrode positioned in the bottom portion of the opening portion), (3) a crown-type field emission device (field emission device in which a crown-shaped electron-emitting portion is formed on the cathode electrode positioned in the bottom portion of the opening portion), (4) a flat-type field emission device that emits electrons from the surface of the flat cathode electrode, (5) a crater-type field emission device that emits electrons from convex portions of surface of the cathode electrode having a convexoconcave shape formed on the surface, and (6) an edge-type field emission device that emits electrons from an edge portion of the cathode electrode.

In addition to the above-mentioned forms of the field emission device, a device generally called a surface-conduction-type electron emitting device is known as the field emission device and can be applied to the cold cathode field emission display of the present invention. In the surface-conduction-type electron emitting device, thin films composed of material such as tin oxide ($SnO_2$), gold (Au), indium oxide ($In_2O_3$)/tin oxide ($SnO_2$), carbon, palladium oxide (PdO) or the like and having a very small area are formed in the form of a matrix on the substrate made, for example, of glass. Each thin film is constituted of a pair of thin film fragments and has a constitution in which a wiring in the row direction is connected to one of each pair of the thin film fragments and a wiring in the column direction is connected to the other of each pair of the thin film fragments and a several nm gap is formed between one of each pair of the thin film fragments and the other of each pair of the thin film fragments. In the thin film selected by the wiring in the row direction and the wiring in the column direction, electrons are emitted from the thin film through the gap.

In the display of the present invention, the substrate for constituting the anode panel includes a glass substrate, a glass substrate having an insulating film formed on its surface, a quartz substrate, a quartz substrate having an insulating film formed on its surface and a semiconductor substrate having an insulating film formed on its surface. From the viewpoint that the production cost is decreased, it is preferred to use a glass substrate or a glass substrate having an insulating film formed on its surface. Examples of the glass substrate include high-distortion glass, soda glass ($Na_2O.CaO.SiO_2$), borosilicate glass ($Na_2O.B_2O_3.SiO_2$), forsterite ($2MgO.SiO_2$) and lead glass ($Na_2O.PbO.SiO_2$). A supporting member for constituting the cathode panel can have the same constitution as that of the above substrate.

The material for constituting the cathode electrode, the gate electrode or the focus electrode includes metals such as aluminum (Al), tungsten (W), niobium (Nb), tantalum (Ta), molybdenum (Mo), chromium (Cr), copper (Cu), gold (Au), silver (Ag), titanium (Ti), nickel (Ni) and the like; alloys or compounds containing these metal elements (for example, nitrides such as TiN and silicides such as $WSi_2$, $MoSi_2$, $TiSi_2$ and $TaSi_2$); electrically conductive metal oxides such as ITO (indium-tin oxide), indium oxide and zinc oxide; and semiconductors such as silicon (Si). For making or forming the cathode electrode, the gate electrode or the focus electrode, a thin film made of the above material is formed on a substratum by a known thin film forming method such as a CVD method, a sputtering method, a vapor deposition method, an ion-plating method, an electrolytic plating method, an electroless plating method, a screen printing method, a laser abrasion method or a sol-gel method. When the thin film is formed on the entire surface of the substratum, the thin film is patterned by a known patterning method to form the above members. When a patterned resist is formed on the substratum in advance of the formation of the thin film, the above members can be formed by a lift-off method. Further, when vapor deposition is carried out using a mask having openings conforming to the cathode electrode or the gate electrode, or when screen printing is carried out with a screen having such openings, no patterning is required after the formation of the thin film.

As a material for constituting the insulating layer or the insulating film which constitutes the field emission device, $SiO_2$-containing material such as $SiO_2$, BPSG, PSG, BSG, AsSG, PbSG, SiN, SiON, spin on glass (SOG), low-melting-point glass and a glass paste; SiN; an insulating resin such as polyimide and the like can be used alone or in combination. The insulating layer or the insulating film can be formed by a known method such as a CVD method, an application method, a sputtering method or a screen printing method.

The electron-emitting portion will be explained in detail later.

Examples of a material for constituting the anode electrode include aluminum (Al) and chromium (Cr). When the anode electrode is made of aluminum (Al) or chromium (Cr), for example, the specific thickness of the anode electrode is $3\times10^{-8}$ m (30 nm) to $1.5\times10^{-7}$ m (150 nm), preferably $5\times10^{-8}$ m (50 nm) to $1\times10^{-7}$ m (100 nm). The anode electrode can be formed by a vapor deposition method or a sputtering method.

The phosphor layer may be made of monochromatic phosphor particles, or it may be made of phosphor particles of three primary colors. Further, the arrangement form of the phosphor layer may be a dot matrix form, or it may be a stripe form. In the arrangement form such as a dot matrix form or a stripe form, a black matrix for improvement in contrast may be embedded in a space between one phosphor layer and another adjacent phosphor layer.

Further, the anode panel is preferably provided with a plurality of separation walls for preventing the occurrence of a so-called optical crosstalk (color mixing) that is caused when electrons recoiling from the phosphor layer or secondary electrons emitted from the phosphor layer enter another phosphor layer, or for preventing the collision of electrons with other phosphor layer when electrons recoiling from the phosphor layer or secondary electrons emitted from the phosphor layer enter other phosphor layer over the separation wall.

The form of the separation walls includes the form of a lattice (grilles), that is, a form in which the separation wall surrounds four sides of the phosphor layer corresponding to one pixel and having a plan form of nearly a rectangle (or dot-shaped), and a stripe or band-like form that extends in parallel with opposite two sides of a rectangular or stripe-shaped phosphor layer. When the separation wall(s) has (have) the form of a lattice, the separation wall may have a form in which the separation wall continuously or discontinuously surrounds four sides of one phosphor layer. When the separation wall(s) has(have) the form of a stripe or band-like form, the form may be continuous or discontinuous. The formed separation walls may be polished to flatten the top surface of each separation wall.

For improving the contrast of display images, preferably, a black matrix that absorbs light from the phosphor layer is formed between one phosphor layer and another adjacent phosphor layer and between the separation wall and the substrate. As a material for constituting the black matrix, it is preferred to select a material that absorbs at least 99% of light from the phosphor layer. The above material includes carbon, a thin metal film (made, for example, of chromium, nickel, aluminum, molybdenum and an alloy of these), a metal oxide (for example, chromium oxide), metal nitride (for example, chromium nitride), a heat-resistant organic resin, glass paste, and glass paste containing a black pigment or electrically conductive particles of silver or the like. Specific examples thereof include a photosensitive polyimide resin, chromium oxide, and a chromium oxide/chromium stacked film. Concerning the chromium oxide/chromium stacked film, the chromium film is to be in contact with the substrate.

When the cathode panel and the anode panel are bonded in their circumferential portions, the bonding may be carried out with an adhesive layer or with a frame made of an insulating rigid material such as glass or ceramic and an adhesive layer. When the frame and the adhesive layer are used in combination, the facing distance between the cathode panel and the anode panel can be adjusted to be longer by properly determining the height of the frame than that obtained when the adhesive layer alone is used. While a frit glass is generally used as a material for the adhesive layer, a so-called low-melting-point metal material having a melting point of approximately 120 to 400° C. may be used. The low-melting-point metal material includes In (indium; melting point 157° C.); an indium-gold low-melting-point alloy; tin (Sn)-containing high-temperature solders such as $Sn_{80}Ag_{20}$ (melting point 220 to 370° C.) and $Sn_{95}Cu_5$ (melting point 227 to 370° C.); lead (Pb)-containing high-temperature solders such as $Pb_{97.5}Ag_{2.5}$ (melting point 304° C.), $Pb_{94.5}Ag_{5.5}$ (melting point 304 to 365° C.) and $Pb_{97.5}Ag_{1.5}Sn_{1.0}$ (melting point 309° C.); zinc (Zn)-containing high-temperature solders such as $Zn_{95}Al_5$ (melting point 380° C.); tin-lead-containing standard solders such as $Sn_5Pb_{95}$ (melting point 300 to 314° C.) and $Sn_2Pb_{98}$ (melting point 316 to 322° C.); and brazing materials such as $Au_{88}Ga_{12}$ (melting point 381° C.) (all of the above parenthesized values show atomic %).

When three members of the substrate, the supporting member and the frame are bonded, these three members may be bonded at the same time, or one of the substrate and the supporting member may be bonded to the frame at a first stage, and then the other of the substrate and the supporting member may be bonded to the frame at a second stage. When bonding of the three members or bonding at the second stage is carried out in a high-vacuum atmosphere, a space surrounded by the substrate, the supporting member, the frame and the adhesive layer comes to be a vacuum space upon bonding. Otherwise, after the three members are bonded, the space surrounded by the substrate, the supporting member, the frame and the adhesive layer may be vacuumed to obtain a vacuum space. When the vacuuming is carried out after the bonding, the pressure in an atmosphere during the bonding may be any one of atmospheric pressure and reduced pressure, and the gas constituting the atmosphere may be ambient atmosphere or an inert gas containing nitrogen gas or a gas (for example, Ar gas) coming under the group 0 of the periodic table.

When the vacuuming is carried out after the bonding, the vacuuming can be carried out through a tip tube preconnected to the substrate and/or the supporting member. Typically, the tip tube is made of a glass tube and is bonded to a circumference of a through-hole formed in an ineffective field of the substrate and/or the supporting member (i.e., the field other than the effective field which works as a display portion) with a frit glass or the above low-melting-point metal material. After the space reaches a predetermined degree of vacuum, the tip tube is sealed by thermal fusion. It is preferred to heat and then temperature-decrease the cold cathode field emission display as a whole before the sealing, since residual gas can be released into the space, and the residual gas can be removed out of the space by vacuuming.

The display is internally in a high vacuum state, and atmospheric pressure is exerted on the display. The display is therefore preferably internally provided with spacers for preventing atmospheric pressure from damaging the display.

Examples of a material for constituting the spacer include glass and ceramics (for example, a ceramic obtained by adding titanium oxide, chromium oxide, iron oxide, vanadium oxide or nickel oxide to mullite, alumina, barium titanate, lead titanate zirconate, zirconia, cordierite, barium borosilicate, iron silicate or a glass ceramic material). The spacer can be fixed to the anode panel, for example, with a spacer holder formed in the anode panel or partition walls.

In the display of the present invention, the cathode electrode is connected to a cathode-electrode control circuit, the gate electrode is connected to a gate-electrode control circuit, the anode electrode is connected to an anode-electrode control circuit, and the focus electrode is connected to the focus-electrode control circuit. These control circuits can be constituted of known circuits. The output voltage $V_A$ of the anode-electrode control circuit is generally constant, and it can be set, for example, at 5 kilovolts to 10 kilovolts. Concerning the voltage $V_C$ to be applied to the cathode electrode and the voltage $V_G$ to be applied to the gate electrode, there can be employed (1) a method in which the voltage $V_C$ to be applied to the cathode electrode is set at a constant level and the voltage $V_G$ to be applied to the gate electrode is changed, (2) a method in which the voltage $V_C$ to be applied to the cathode electrode is changed and the voltage $V_G$ to be applied to the gate electrode is set at a constant level, or (3) a method in which the voltage $V_C$ to be applied to the cathode electrode is changed and the voltage $V_G$ to be applied to the gate electrode is also changed. A constant voltage of 0 volt or approximately −20 volts at maximum is applied to the focus electrode from the focus-electrode control circuit.

In the cold cathode field emission display of the present invention, the relationship of the total energy "Q" required for the vaporization of the resistance layer, the electrostatic capacity "C" between the cold cathode field emission device or the focus electrode and the anode electrode and the voltage $V_A$ to be applied to the anode electrode are defined, so that the occurrence of damage, caused by energy generated on basis of an electrostatic capacity formed between the anode electrode and the field emission device, on members constituting the resistance layer, the anode electrode or the cold cathode field emission device can be reliably suppressed even when a discharge takes place between the cold cathode field emission device or the focus electrode and the anode electrode. Alternatively, the relationship of the thickness $t_R$ of the resistance layer, the electrostatic capacity "C" between the cold cathode field emission device or the focus electrode and the anode electrode and the voltage $V_A$ to be applied to the anode electrode are defined, so that the occurrence of damage, caused by energy generated on the basis of an electrostatic capacity formed between the anode electrode and the field emission device, on members constituting the resistance layer, the anode electrode and the cold cathode field emission device can be reliably suppressed even when a discharge takes place between the cold cathode field emission device or the focus electrode and the anode electrode. Further, the resistance layer is provided, so that the peak value of a discharge current can be decreased.

Further, when the anode electrode has a form in which the anode electrode is divided into the anode electrode units having smaller areas in place of forming the anode electrode on the entire region of the effective field, the electrostatic capacity between the cold cathode field emission device or the focus electrode and the anode electrode unit can be decreased, so that the thickness of the resistance layer can be consequently decreased. Further, the energy generated on the basis of the electrostatic capacity formed between the anode electrode and the field emission device can be decreased, so that extent of the damage caused on the anode electrode by a discharge can be further decreased.

BRIEF DESCRIPTION OF DRAWINGS

FIG. 17B, are schematic partial end views of the supporting member, etc., for explaining a method of manufacturing the Spindt-type cold cathode field emission device.

FIG. 19B, are schematic partial cross-sectional views of a supporting member, etc., for explaining the method of manufacturing the plane-type cold cathode field emission device (No. 1).

BEST MODE FOR CARRYING OUT THE INVENTION

The present invention will be explained hereinafter with reference to Examples by referring to drawings.

EXAMPLE 1

Example 1 is directed to the cold cathode field emission display (to be simply abbreviated as "display" hereinafter) according to the first and second aspects of the present invention.

Figure 1:
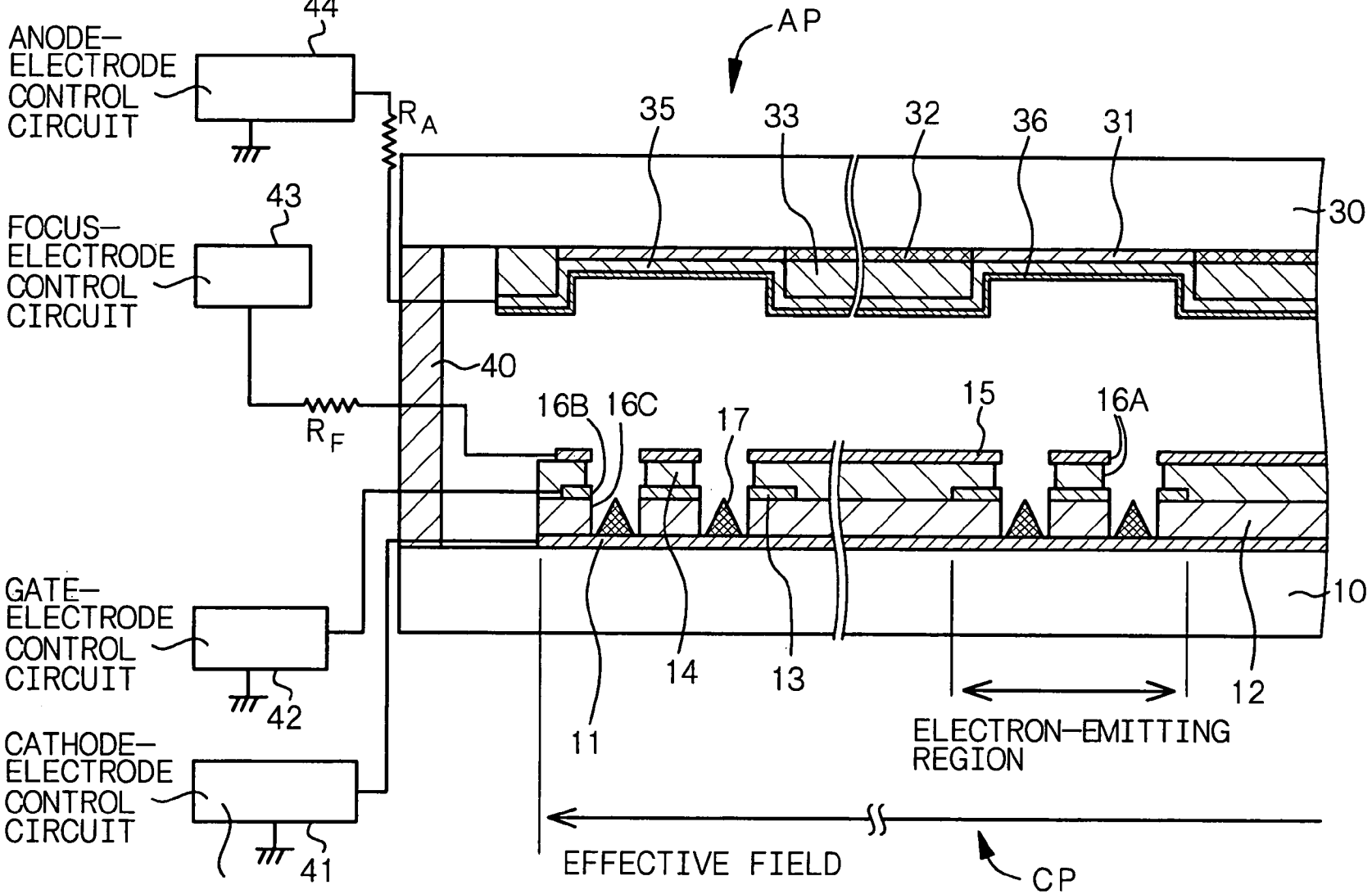
FIG. 1 is a schematic partial end view of a cold cathode field emission display of Example 1.
Figure 2:
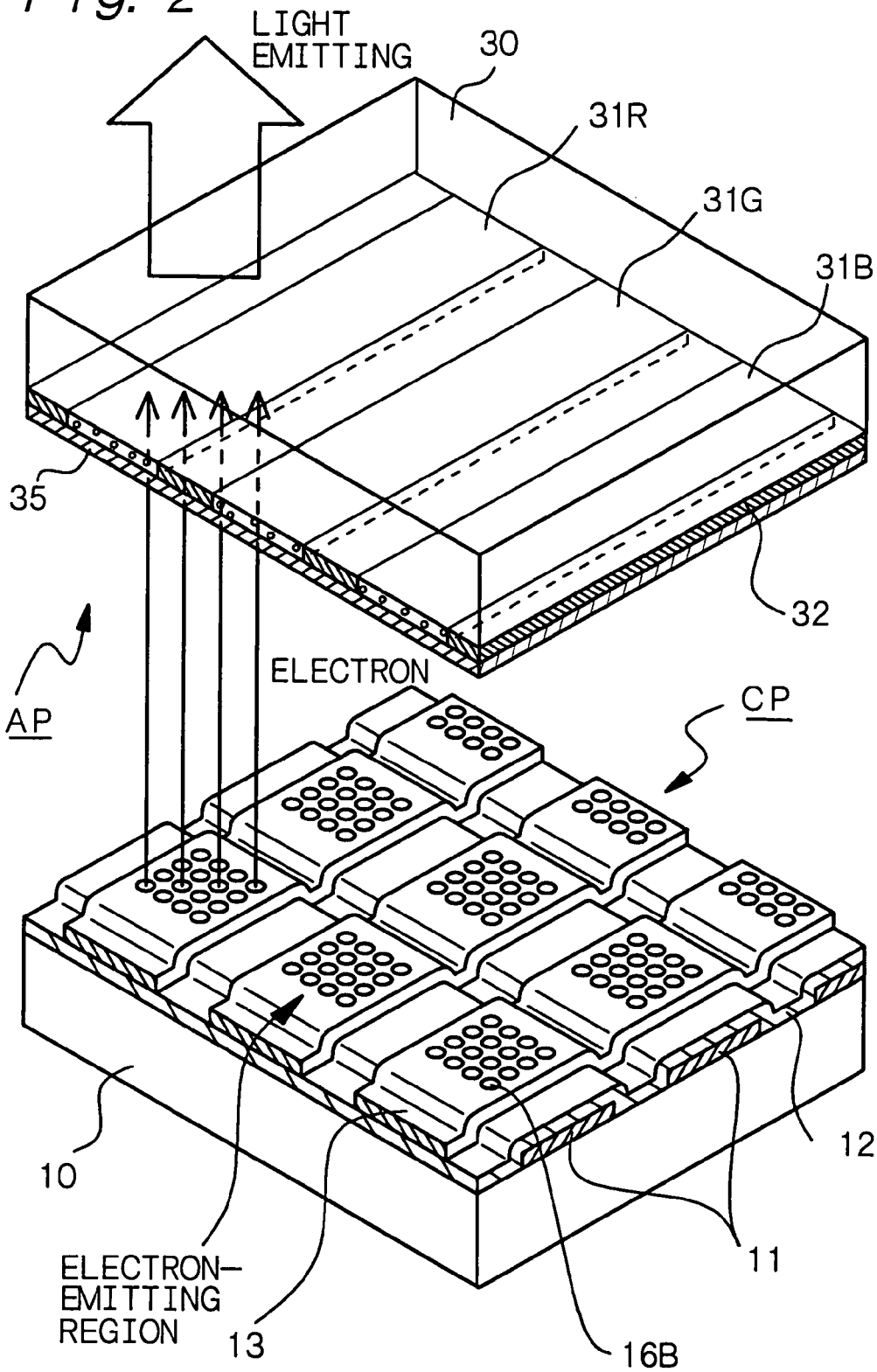
FIG. 2 is a schematic partial perspective view obtained when a cathode panel CP and an anode panel AP constituting the cold cathode field emission display of Example 1 are disassembled.
Figure 3:
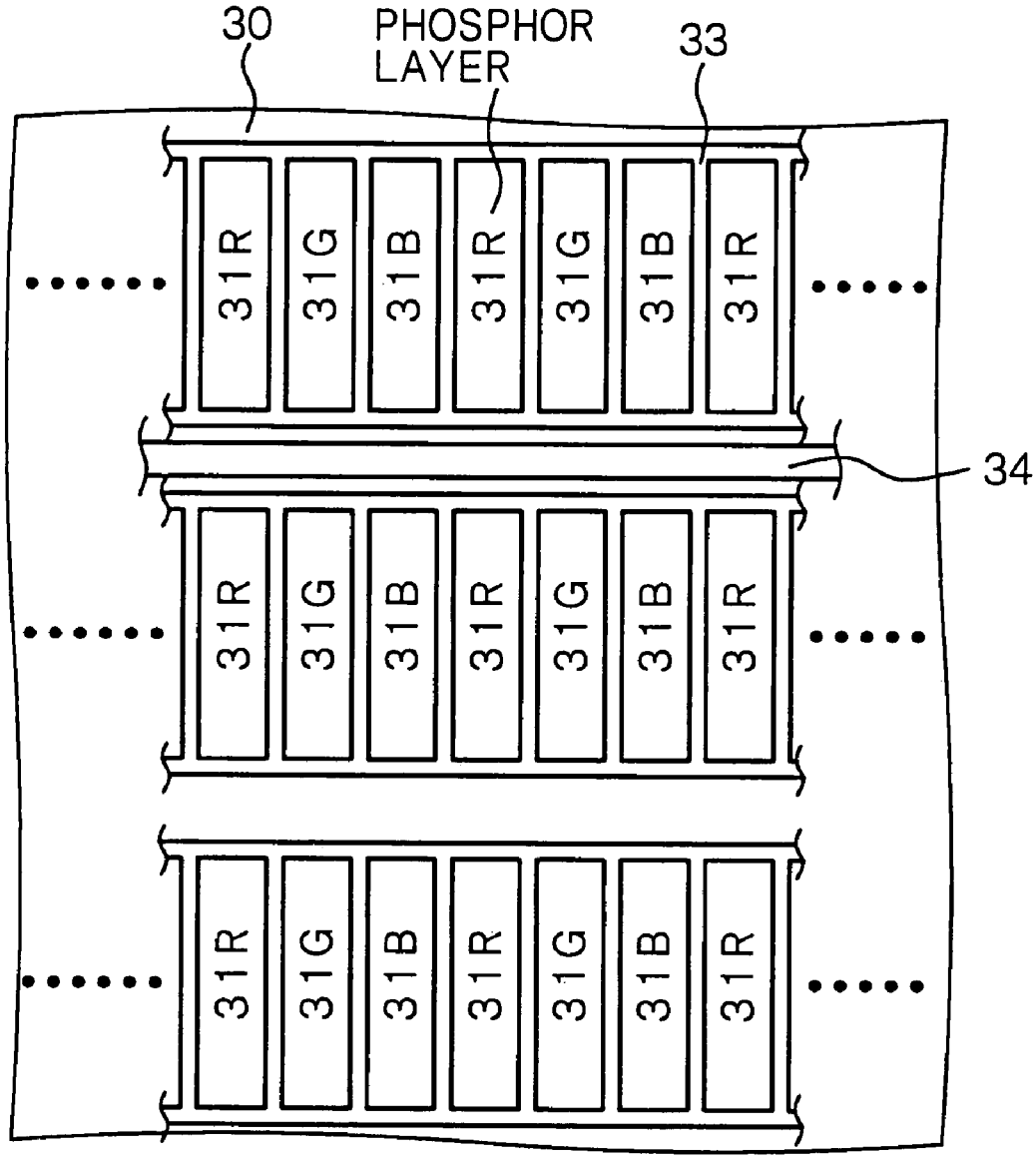
FIG. 3 is a schematic layout drawing that shows a layout of partition walls, spacers and phosphor layers in the anode panel constituting a cold cathode field emission display.
Figure 4:
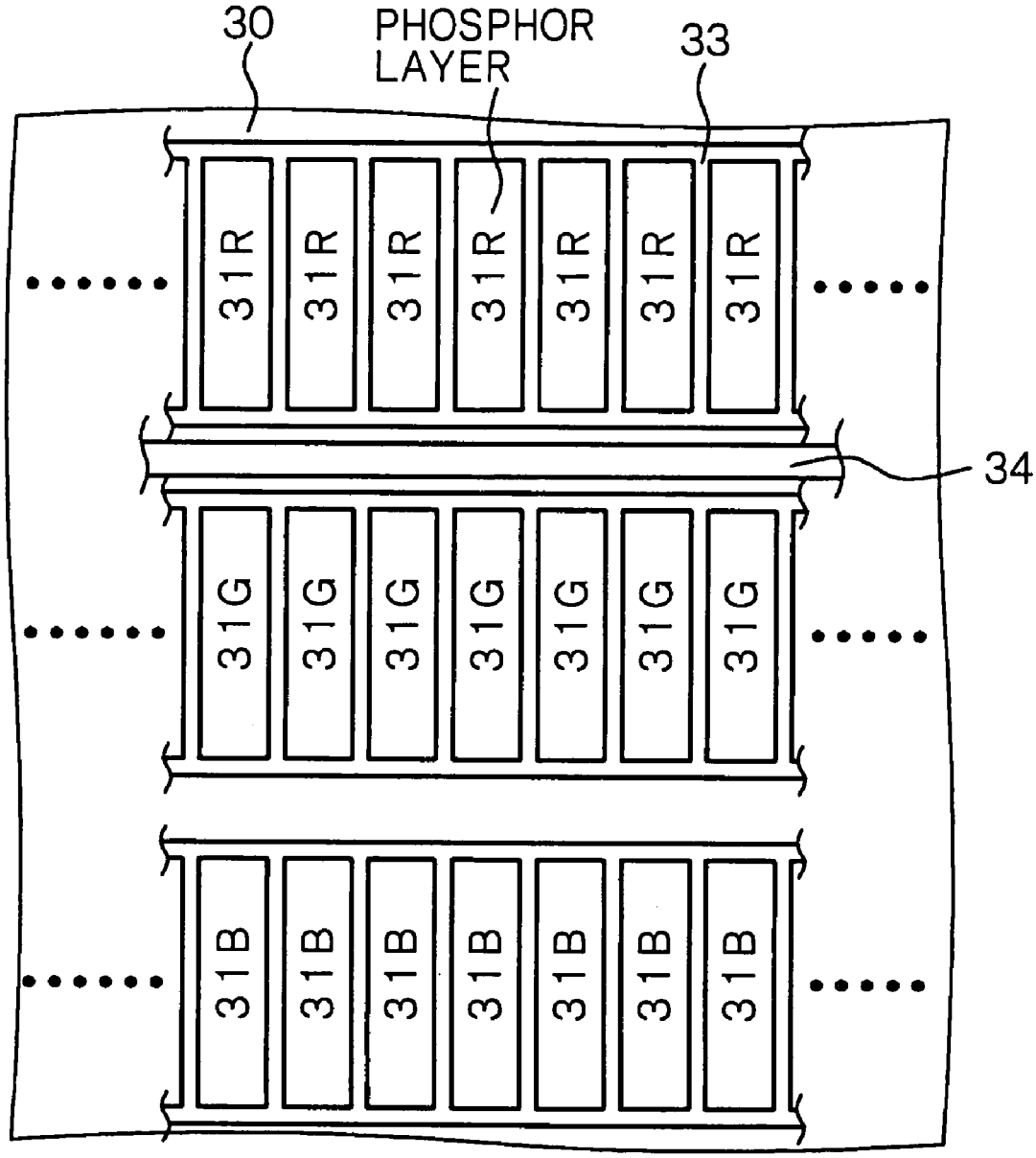
FIG. 4 is a schematic layout drawing that shows a layout of partition walls, spacers and phosphor layers in the anode panel constituting a cold cathode field emission display.
Figure 5:
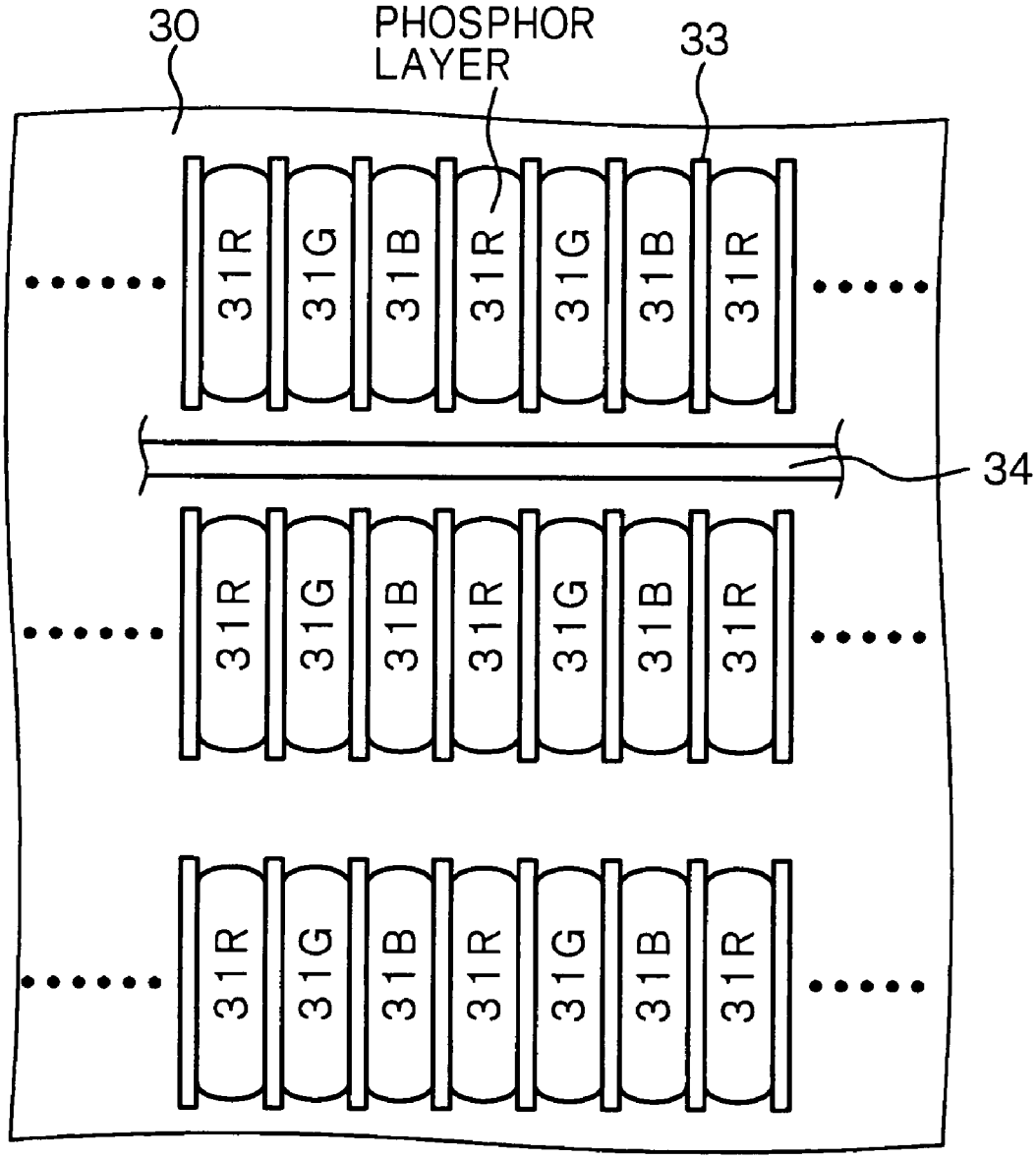
FIG. 5 is a schematic layout drawing that shows a layout of partition walls, spacers and phosphor layers in the anode panel constituting a cold cathode field emission display.
Figure 6:
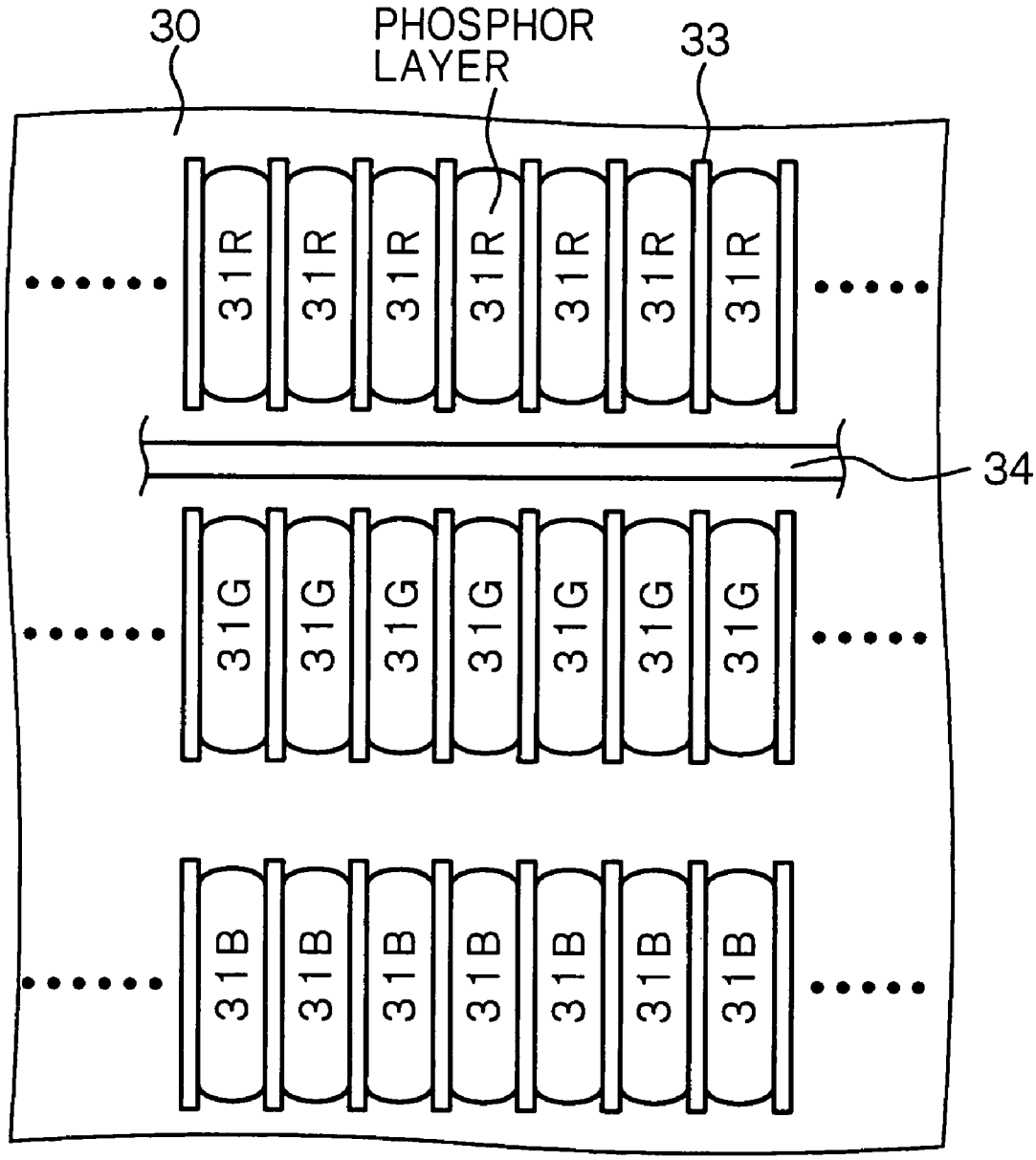
FIG. 6 is a schematic layout drawing that shows a layout of partition walls, spacers and phosphor layers in the anode panel constituting a cold cathode field emission display.

FIG. 1 shows a schematic partial end view of the display of Example 1, and FIG. 2 shows a schematic partial perspective view found when a cathode panel CP and an anode panel AP are disassembled. FIG. 1 omits showing of spacers, and FIG. 2 omits showing of partition walls, spacers and a resistance layer and also omits showing of a focus electrode and an insulating layer.

In the display of Example 1, a cathode panel CP having a plurality of cold cathode field emission devices (to be referred to as "field emission devices" hereinafter) having a cathode electrode 11, a gate electrode 13, a focus electrode 15 and an electron-emitting portion 17 and an anode panel AP are bonded to each other through a frame 40 in their circumferential portions.

The anode panel comprises a substrate 30, a phosphor layer 31 (red-light-emitting phosphor layer 31R, green-light-emitting phosphor layer 31G and blue-light-emitting phosphor layer 31B) formed on the substrate 30, an anode electrode 35 formed on the phosphor layer 31 and a resistance layer 36 for controlling a discharge current, the resistance layer 36 being formed on the anode electrode 35 and having a thickness of $t_R$ (unit: μm). The above anode electrode 35 is made of an aluminum thin film and has the form of one sheet covering an effective field. Further, the resistance layer 36 is made of ITO having a thickness $t_R$ of 0.2 μm and is formed on the entire area of the anode electrode 35.

A black matrix 32 is formed on the substrate 30 between one phosphor layer 31 and another phosphor layer 31. A separation wall 33 is formed on the black matrix 32. FIGS. 3 to 6 schematically show examples of layout of the separation walls 33, spacer 34 and the phosphor layers 31 in the anode panel AP. The plan form of the separation wall 33 includes the form of a lattice (grid form), i.e., a form that surrounds the phosphor layer 31 having the plan form, for example, of a nearly rectangle and equivalent to one sub pixel (see FIGS. 3 and 4), and a form of a band (stripe form) extending in parallel with facing two sides of the phosphor layer 31 having a nearly rectangular form (or strip form) (see FIGS. 5 and 6). The phosphor layer 31 may have the form of a stripe that extends vertically on FIGS. 3 to 6. Part of the separation wall 33 works as a spacer holding portion for holding the spacer 34.

The field emission device shown in FIG. 1 is a so-called Spindt-type field emission device having a conical electron-emitting portion. This field emission device comprises:

(a) a cathode electrode 11 formed on a supporting member 10 and extending in a first direction, (b) an insulating layer 12 formed on the supporting member 10 and the cathode electrode 11, (c) a gate electrode 13 being formed on the insulating layer 12 and extending in a second direction different from the first direction, (d) an insulating film 14 formed on the gate electrode 13 and the insulating layer 12, (e) a focus electrode 15 formed on the insulating film 14, (f) an opening portion 16 formed through the focus electrode 15, the insulating film 14, the gate electrode 13 and the insulating layer 12 (an opening portion 16A formed through the focus electrode 15 and the insulating film 14, an opening portion 16B formed through the gate electrode 13, and an opening portion 16C formed through the insulating layer 12), and (g) an electron-emitting portion 17 formed on the cathode electrode 11 positioned in the bottom portion of the opening portion.

The electron-emitting portion 17 is constituted, specifically, of a conical electron-emitting portion formed on the cathode electrode 11 positioned in a bottom portion of the opening portion 16C. Further, the focus electrode 15 has the form of one sheet covering the effective field. The opening portion 16A formed through the focus electrode 15 is provided for each cold cathode field emission device.

Generally, the cathode electrode 11 and the gate electrode 13 are formed in the form of a stripe each in directions in which the projection images of these two electrodes cross each other at right angles. Generally, a plurality of field emission devices are arranged in a region (corresponding to one pixel, and the region will be called an "overlap region" or an "electron-emitting region" hereinafter) where the projection images of the above two electrodes overlap. Further, generally, such electron-emitting regions are arranged in the form of a two-dimensional matrix within the effective field (which works as an actual display portion) of the cathode panel CP.

The space surrounded by the anode panel AP, the cathode panel CP and a frame 40 is a vacuum space. Atmosphere has a pressure on the anode panel AP and the cathode panel CP. The spacer 34 having a height, for example, of about 1 mm is provided between the anode panel AP and the cathode panel CP for preventing the pressure from destroying the display.

Each picture element (one pixel) is constituted of a group of field emission devices formed in the three overlap regions of the cathode electrode 11 and the gate electrode 13 on the cathode panel side, and the phosphor layer 31 (an aggregate of one unit phosphor layer for emitting light in red 31R, one unit phosphor layer for emitting light in green 31G and one unit phosphor layer for emitting light in blue 31B) that faces three overlap regions and is on the anode panel side. Such pixels are arranged in the effective field on the order of, for example, several hundreds thousand to several millions. Further, each picture element (one pixel) is constituted of three subpixels, each pixel is constituted of a group of the field emission devices formed on the overlap region of the cathode electrode 11 and the gate electrode 13 of the cathode panel side and the phosphor layer 31 (an aggregate of one unit phosphor layer for emitting light in red 31R, one unit phosphor layer for emitting light in green 31G and one unit phosphor layer for emitting light in blue 31B) of the anode panel side arranged so as to face the group of the field emission devices.

The anode panel AP and the cathode panel CP are arranged such that the electron-emitting region and the phosphor layer 31 face each other, and they are bonded to each other in their circumferential portions through the frame 40, whereby a display can be manufactured. An ineffective field surrounding the effective field and having peripheral circuits for selecting pixels is provided with a through hole (not shown) for vacuuming, and a tip tube (not shown) that is to be sealed after the vacuuming is connected to the through hole. That is, the space surrounded by the anode panel AP, the cathode panel CP and the frame 40 is a vacuum space.

A relatively negative voltage $V_c$ is applied to the cathode electrode 11 from the cathode-electrode control circuit 41, a relatively positive voltage $V_G$ is applied to the gate electrode 13 from the gate-electrode control circuit 42, a relatively negative voltage $V_F$ is applied to the focus electrode 15 from the focus-electrode control circuit 43, and a positive voltage $V_A$ higher than that applied to the gate electrode 13 is applied to the anode electrode 35 from the anode-electrode control circuit 44. When display is performed with the above display, for example, a scanning signal is inputted to the cathode electrode 11 from the cathode-electrode control circuit 41, and a video signal is inputted to the gate electrode 13 from the gate-electrode control circuit 42. Reversely, a video signal may be inputted to the cathode electrode 11 from the cathode-electrode control circuit 41, and a scanning signal may be inputted to the gate electrode 13 from the gate-electrode control circuit 42. Due to an electric field generated when a voltage is applied between the cathode electrode 11 and the gate electrode 13, electrons are emitted from the electron-emitting portion 17 on the basis of a quantum tunnel effect, and the electrons are drawn toward the anode electrode 35 to collide with the phosphor layers 31. As a result, the phosphor layers 31 are excited, whereby a desired image can be obtained. That is, the operation of the display is basically controlled by the voltage applied to the gate electrode 13 and the voltage applied to the electron-emitting portion 17 through the cathode electrode 11.

Figure 27:
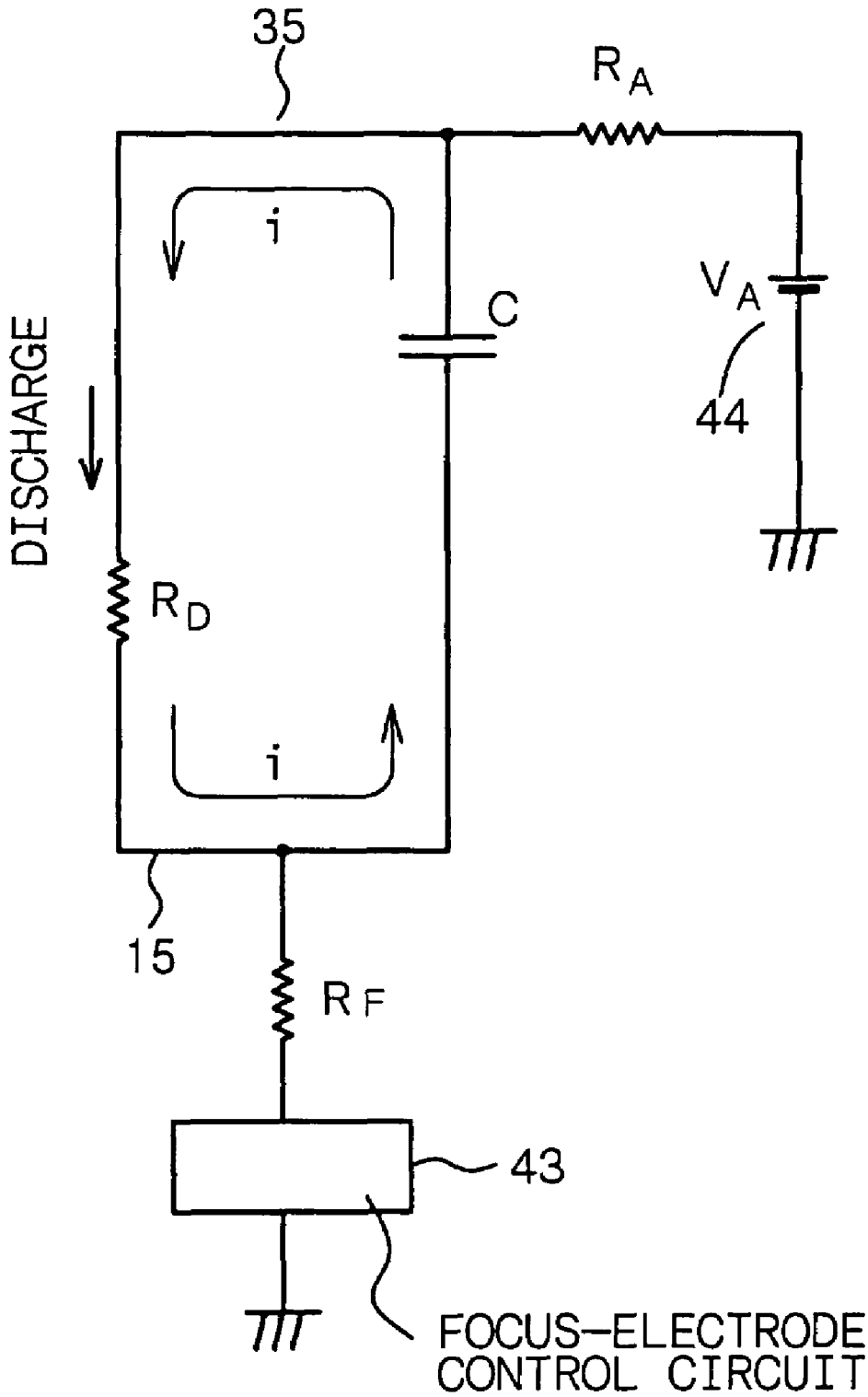
FIG. 27 is an equivalent circuit found when a discharge takes place between an anode electrode and a focus electrode when no resistance layer is formed.

FIG. 27 shows an equivalent circuit found when a discharge takes place between the anode electrode 35 and the focus electrode 15 in a conventional display having no resistance layer 36.

In this Example, a positive voltage $V_A$ (10 kV) was applied to the anode electrode 35 from the anode-electrode control circuit 44 through a resistance element $R_A$ for preventing an overcurrent and a discharge. Further, a voltage $V_F$ (=0 V) was applied to the focus electrode 15 from the focus-electrode control circuit 43 through a 1 kΩ resistance element $R_F$. The above resistance elements $R_A$ and $R_F$ are placed outside the display. Further, the electrostatic capacity "C" between the field emission device (more specifically, the focus electrode 15) and the anode electrode 35 is 70 pF. Further, the electric resistance value $R_D$ along a discharge current path (specifically, the electric resistance value of the anode electrode 35 made of aluminum and the focus electrode) is 0.1 Ω. The anode electrode 35 had a size of 130 mm×100 mm.

Figure 28:
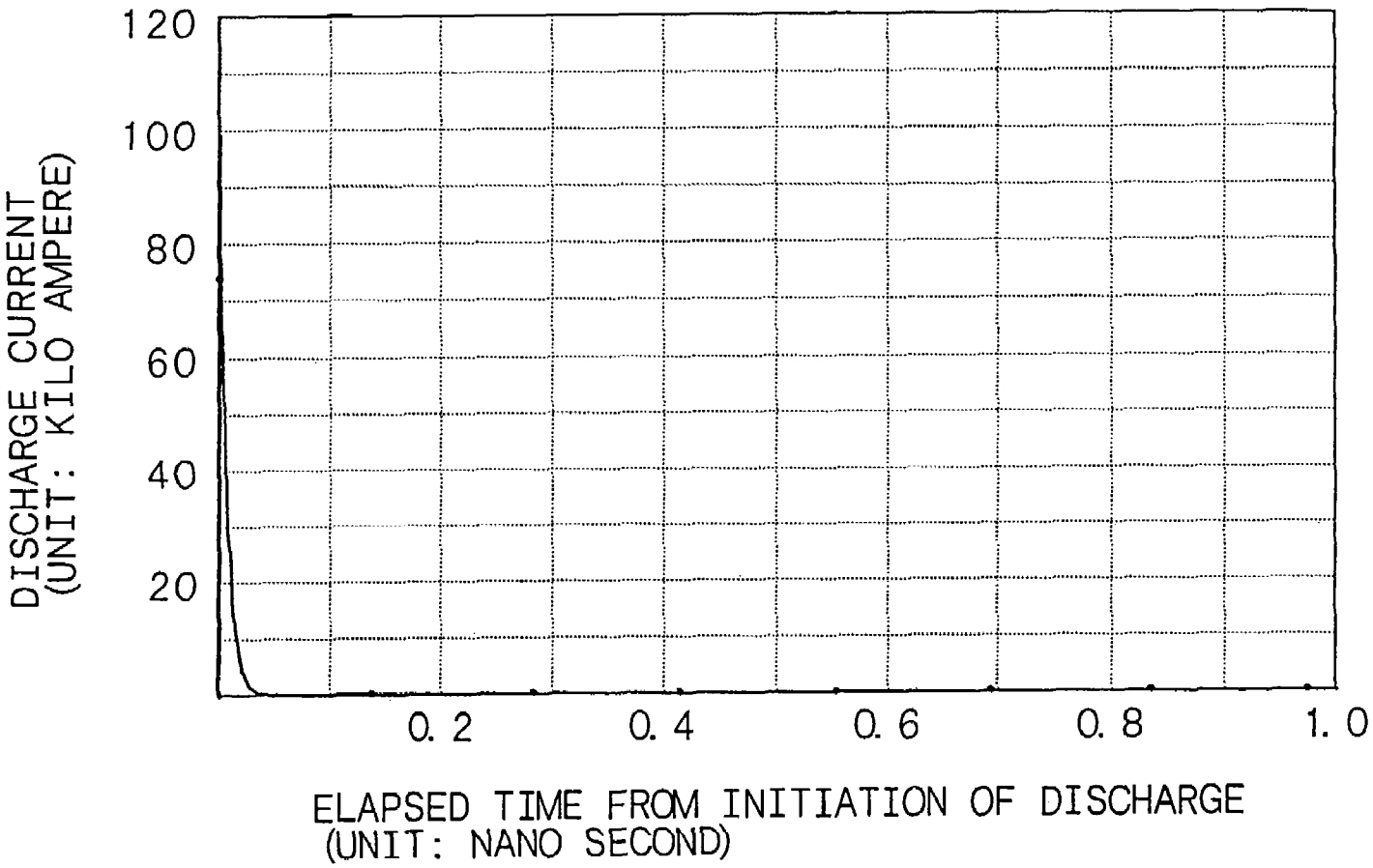
FIG. 28 is a graph showing results with regard to a discharge current calculated when $R_A$=100 kΩ in the equivalent circuit shown in FIG. 27.
Figure 29:
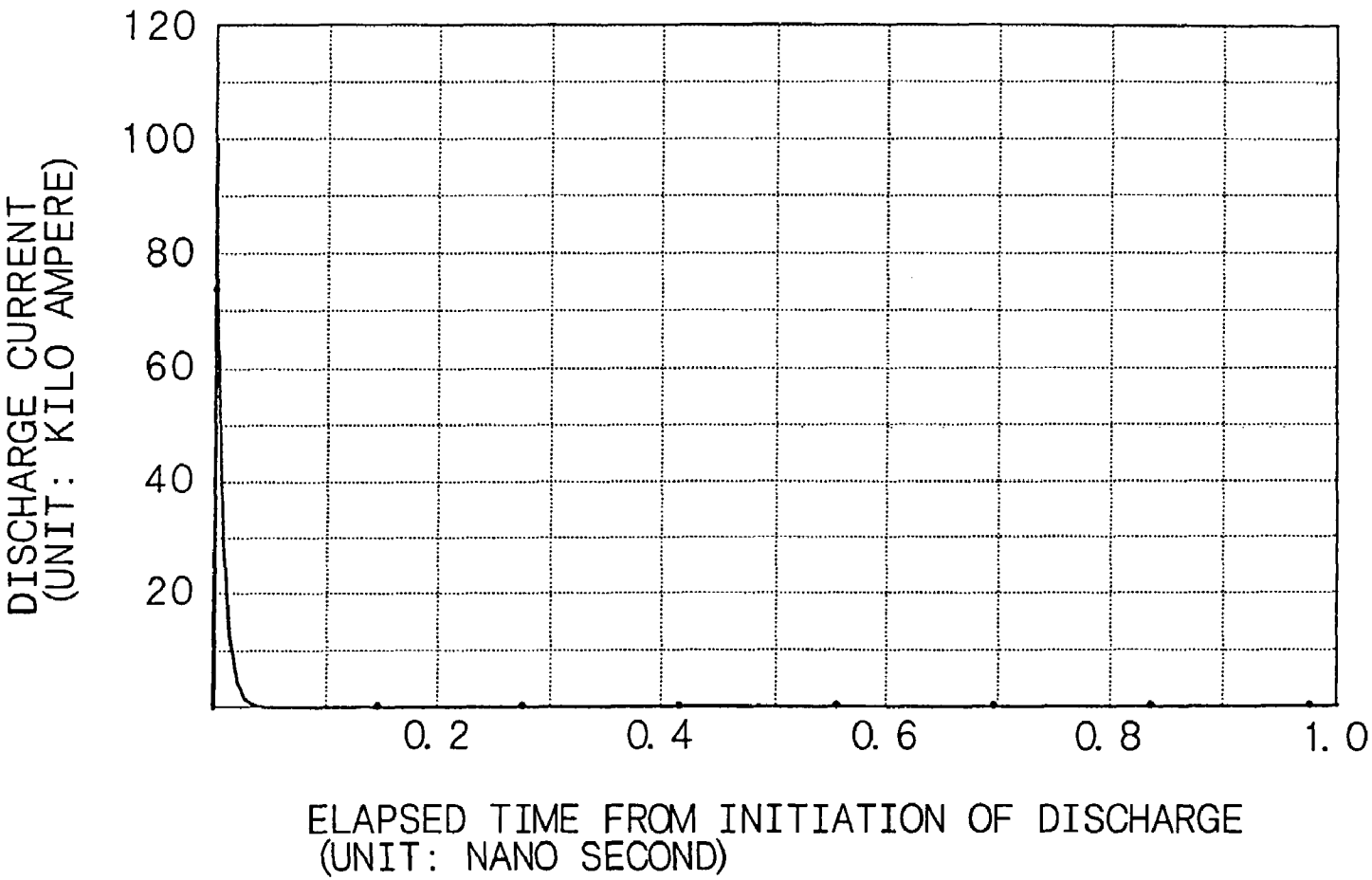
FIG. 29 is a graph showing results with regard to a discharge current calculated when $R_A$=1 kΩ in the equivalent circuit shown in FIG. 27.

Discharge currents "i" were calculated at an $R_A$=100 kΩ and $R_A$=1 kΩ, and FIGS. 28 and 29 show the results. The calculations disregarded inductance components. When FIGS. 28 and 29 are compared, it is seen that almost no discharge current "i" flows in the resistance elements $R_A$ and $R_F$ but that it flows in a closed system constituted of the anode electrode 35, the discharge current path, the focus electrode 15 and the electrostatic capacity "C" as shown by an arrow and comes to be extinct.

The relationship of the total energy "Q" required for vaporization of the resistance layer 36 for controlling a discharge current, which resistance layer 36 has a thickness of $t_R$ (unit: μm), and the energy (which will be called "discharge energy" and is $(1/2)C\cdot V_A^2$ hereinafter) generated on the basis of the electrostatic capacity "C" formed between the anode electrode and the field emission device, and the relationship of the resistance layer 36 having a thickness of $t_R$ (unit: μm) and the discharge energy $(1/2)C\cdot V_A^2$ will be explained below.

Figure 7:
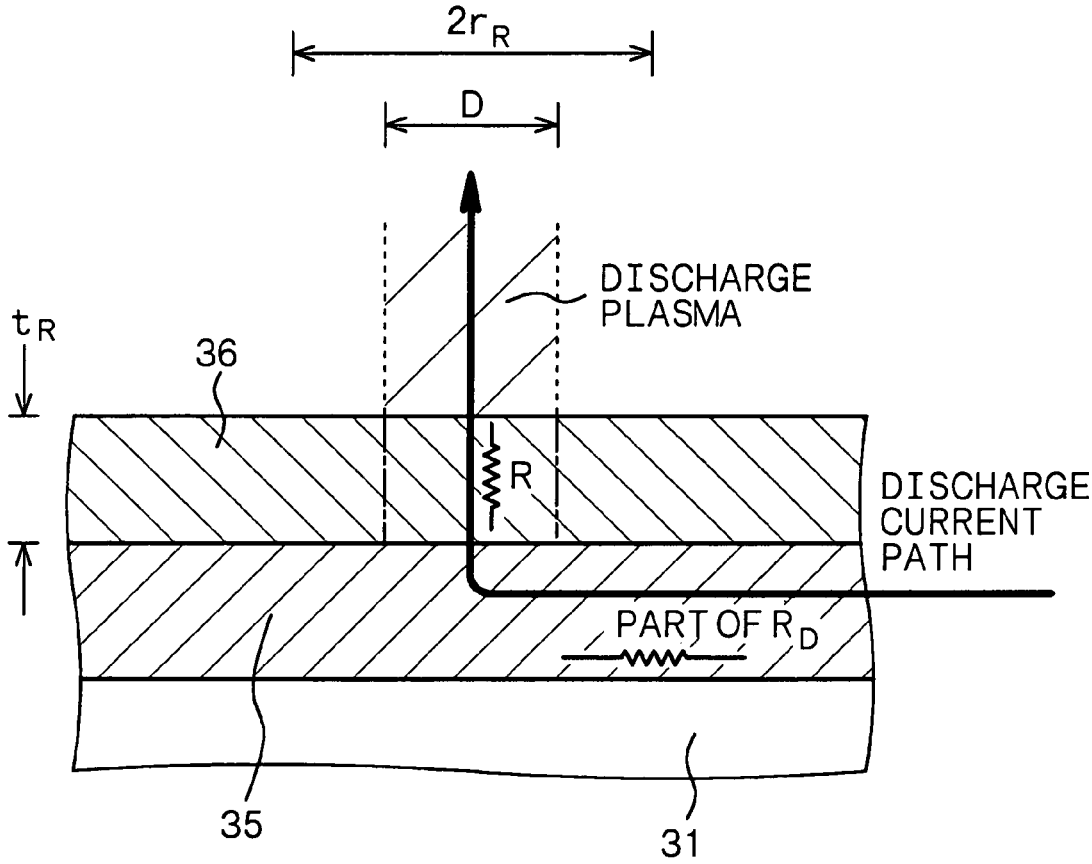
FIG. 7 is a schematic showing of a discharge state when a resistance layer is formed in a discharge current path in the cold cathode field emission display of Example 1.
Figure 8:
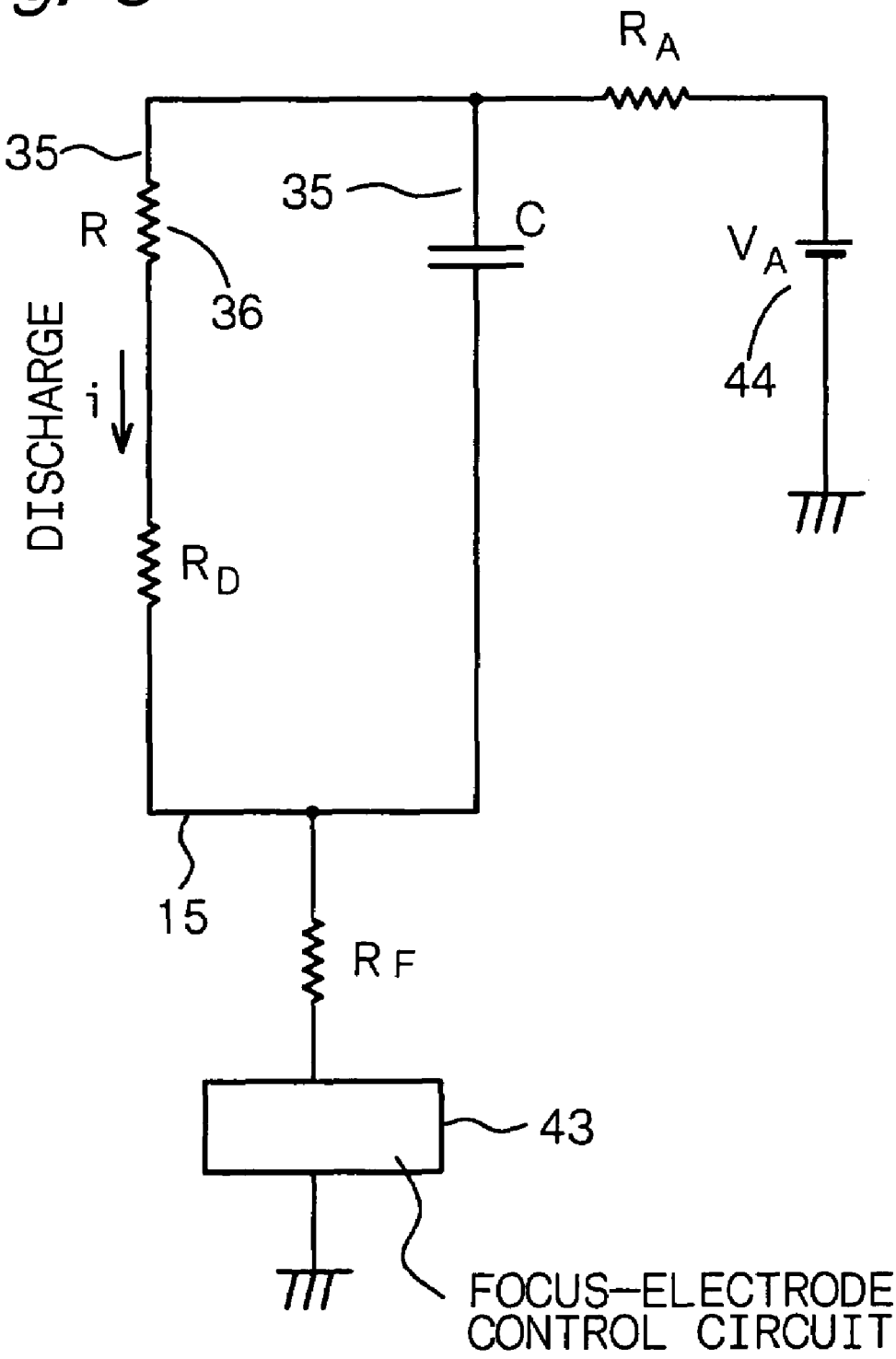
FIG. 8 is an equivalent circuit found when a discharge takes place between the anode electrode and the focus electrode in the cold cathode field emission display of Example 1.

FIG. 7 schematically shows a discharge state found when the resistance layer 36 for controlling a discharge current is formed in a discharge current path, and FIG. 8 shows an equivalent circuit found when a discharge takes place between the anode electrode 35 and the focus electrode 15 when the resistance layer 36 is provided as shown in FIG. 1.

For example, it can be considered that the display has no critical problem caused on its display function so long as a discharge that occurs between the anode electrode 35 and the focus electrode 15 does not cause the anode electrode 35 made of aluminum to vaporize to such an extent that an area corresponding approximately to one pixel is vaporized. It can be therefore also considered that so long as the discharge between the anode electrode 35 and the focus electrode 15 does not cause the resistance layer 36 to vaporize to such an extent that an area corresponding to one pixel vaporizes, the display has no critical problem caused on its display function.

That is, it can be said that so long as the discharge energy $(1/2)C\cdot V_A^2$ [in which "C" is an electrostatic capacity (unit: F) between the field emission device and the anode electrode and $V_A$ is a voltage (unit: V) applied to the anode electrode 35] does not exceed the total energy "Q" required for vaporization of the resistance layer 36 having an area of $\pi\times r_R^2$ (unit: mm$^2$) and a thickness of $t_R$ (unit: μm), the resistance layer 36 is not damaged. That is, it is sufficient to satisfy the following expression (1).

$$Q>(1/2)C\cdot V_A^2 \quad (1)$$

When a material constituting the resistance layer 36 vaporizes from a solid phase through a liquid phase, the total energy "Q" required for vaporization of the resistance layer 36 can be expressed by:

$$Q \approx \pi \cdot t_R \cdot r_R^2 \cdot d_R \times [C_{m_S}(T_L - T_r) + Q_{S_L} + C_{m_L}(T_G - T_L) + Q_{L_G}] \times 10^{-6}$$

Alternatively, when a material constituting the resistance layer 36 vaporizes from a solid phase directly, it can be expressed by:

$$Q \approx \pi \cdot t_R \cdot r_R^2 \cdot d_R \times [C_{m_S}(T_G - T_r) + Q_{L_G}] \times 10^{-6}$$

In the above expressions, $r_R$: a radius (mm) of a vaporization-allowable region of the resistance layer, or a radius (mm) of a size (region) that does not cause a problem on the display function of a display even when the resistance layer of such a size (region) vaporizes, or a radius (mm) of that size (region) of the resistance layer which corresponds to 1 subpixel, $d_R$: a density ($g \cdot cm^{-3}$) of a material constituting the resistance layer, $C_{m_S}$: a specific heat ($J \cdot g^{-1} \cdot K^{-1}$) of a material constituting the resistance layer in a solid state, $T_L$: a melting point (° C.) of a material constituting the resistance layer, $T_r$: room temperature (° C.), $Q_{S_L}$: a heat of solution ($J \cdot g^{-1}$) of a material constituting the resistance layer, $C_{m_L}$: a specific heat ($J \cdot g^{-1} \cdot K^{-1}$) of a material constituting the resistance layer in a liquid state, $T_G$: a boiling point (° C.) of a material constituting the resistance layer.

Further, when the material constituting the resistance layer vaporizes from a solid phase through a liquid phase, $Q_{L_G}$: a heat of vaporization ($J \cdot g^{-1}$) of a material constituting the resistance layer.

When a material constituting the resistance layer vaporizes from a solid phase directly, $Q_{L_G}$: a sum ($J \cdot g^{-1}$) of a heat of vaporization and a heat of solution of a material constituting the resistance layer.

When the resistance layer 36 is made of carbon, carbon vaporizes from a solid phase directly, $d_R$: 2.3 ($g \cdot cm^{-3}$)

$C_{m_S}$: 6 ($J \cdot mol^{-1} \cdot K^{-1}$)

$T_r$: 30 (° C.)

$T_G$: 3400 (° C.)

$Q_{L_G}$: 350 ($kJ \cdot mol^{-1}$).

The total energy "Q" required for vaporization of the resistance layer 36 made of carbon is calculated as shown in the following expression (5), in which units of $r_R$ and $t_R$ are mm and μm, respectively.

$$Q = 7.10 \times 10^{-2} \times \pi \times r_R^2 \times t_R (J) \quad (5)$$

When C=70 pF and when $V_A$=10 kV, the following expression (6) can be obtained from the expressions (1) and (5).

$$\pi \times r_R^2 \times t_R > 4.93 \times 10^{-2} \quad (6)$$

Further, when $\pi \times r_R^2 = 0.04$ mm$^2$ (this area is approximately as large as an area of one subpixel), it is sufficient that the thickness $t_R$ of the resistance layer 36 should satisfy the following expression (7).

$$t_R > 1.2 (\mu m) \quad (7)$$

Further, when the anode electrode 35 is divided into 10 anode electrode units, C=7 pF, so that it is sufficient that the thickness $t_R$ of the resistance layer 36 should satisfy $t_R$>0.12 (μm).

Further, $\pi \times r_R^2 = 0.04$ mm$^2$ is substituted in the expression (5), the following expression (8) can be obtained from the expression (1).

$$2.84 \times 10^{-3} \times t_R > (1/2) C \cdot V_A^2 \quad (8)$$

When the resistance layer 36 for controlling a discharge current is made of ITO, ITO having a relatively high volume resistivity has an $SnO_2$ content close to 100%, so that it can be considered that ITO has physical property values almost equivalent to those of $SnO_2$. Therefore, the following physical property values of $SnO_2$ are used as substitutes for the physical property values of ITO. ITO vaporizes from a solid phase through a liquid phase.

$d_R$: 6.4 ($g \cdot cm^{-3}$)

$C_{m_S}$: 53 ($J \cdot mol^{-1} \cdot K^{-1}$)

$T_L$: 1130 (° C.)

$T_r$: 30 (° C.)

$Q_{S_L}$: 48 ($kJ \cdot mol^{-1}$)

$C_{m_L}$: 53 ($J \cdot mol^{-1} \cdot K^{-1}$)

$T_G$: 1850 (° C.)

$Q_{L_G}$: 314 ($kJ \cdot mol^{-1}$)

Therefore, the total energy "Q" required for vaporization of the resistance layer 36 made of ITO is calculated as shown in the following expression (9), in which units of $r_R$ and $t_R$ are mm and μm, respectively.

$$Q = 1.94 \times 10^{-2} \times \pi \times r_R^2 \times t_R (J) \quad (9)$$

When C=70 pF and when $V_A$=10 kV, the following expression (10-1) can be obtained from the expressions (1) and (9). Further, when the anode electrode is divided into ten anode electrode units, and when C=7 pF and $V_A$=10 kV, the following expression (10-2) can be obtained from the expressions (1) and (9).

$$\pi \times r_R^2 \times t_R > 1.8 \times 10^{-1} \quad (10\text{-}1)$$

$$\pi \times r_R^2 \times t_R > 1.8 \times 10^{-2} \quad (10\text{-}2)$$

Further, when $\pi \times r_R^2 = 0.04$ mm$^2$, it is sufficient that the thickness $t_R$ of the resistance layer 36 should satisfy the following expressions (11-1) and (11-2) on the basis of the expressions (10-1) and (10-2).

$$t_R > 4.5 (\mu m) \quad (11\text{-}1)$$

$$t_R > 0.45 (\mu m) \quad (11\text{-}2)$$

Further, when $\pi \times r_R^2 = 0.04$ mm$^2$ is substituted in the expression (9), the following expression (12) can be obtained from the expression (1).

$$7.8 \times 10^{-4} \times t_R > (1/2) C \cdot V_A^2 \quad (12)$$

As a result, it is seen that if it is taken into account that the thickness of the resistance layer 36 for controlling a discharge current varies, it is sufficient that the thickness $t_R$ (unit: μm) of the resistance layer 36 should satisfy the following expression (2) on the basis of the expressions (8) and (12).

$$t_R \times 10^{-2} > (1/2) C \cdot V_A^2 \quad (2)$$

The expression (2) is not dependent upon the volume resistivity of a material constituting the resistance layer 36 for controlling a discharge current but is dependent upon physical property values such as $d_R$, $C_{m_S}$, $T_L$, $Q_{S_L}$, $C_{m_L}$, $T_G$, and $Q_{L_G}$.

When the thickness $t_R$ of the resistance layer 36 for controlling a discharge current is defined as shown by the expression (2), the occurrence of damage on any region having an area of over 0.04 $mm^2$ can be suppressed in the resistance layer 36 even when a discharge takes place between the anode electrode 35 and the focus electrode 15. Further, damage on the anode electrode 35 can be also suppressed.

For example, it can be considered that the display has no critical problem caused on its display function so long as the discharge between the anode electrode 35 and the focus electrode 15 does not cause the anode electrode 35 made of aluminum to vaporize to such an extent that a portion having an area of $\pi \times r_0^2 = 0.04\ mm^2$ (an area corresponding approximately to an area of 1 subpixel as described already) vaporizes.

The electric resistance value required of the resistance layer 36 for suppressing the vaporization of the above anode electrode 35 will be explained below. The explanation can be also applied to the focus electrode 15.

A discharge current energy $E(r_0)$ generated by a discharge current "i" in the anode electrode 35 or the focus electrode 15 can be determined by the following expression.

That is, a discharge current energy $\Delta E$ to be generated in a micro region positioned at a distance of a radius r from a discharge point as an origin (radially width $\Delta r$) can be represented by the following expression (13-1), in which $\rho_0$: a volume resistivity ($\Omega \cdot m$) of an anode electrode or a focus electrode, and $s_0$: a thickness of the anode electrode or the focus electrode.

$$\Delta E = \int \rho_0 \cdot \Delta r / (2\pi \cdot r \cdot s_0) \cdot i^2 dt = \int i^2 dt \cdot \int [\rho_0 \cdot 1 / (2\pi \cdot r \cdot s_0)] dr \quad (13\text{-}1)$$

When the radius r is integrated from (D/2) to $r_0$, the following expression (13-2) can be obtained, in which $r_0$: a radius (μm) of a region in which the anode electrode or the focus electrode suffers damage due to a discharge, and D: a diameter (μm) of a plasma generated by the discharge.

$$E(r_0) = \rho_0 \cdot (2\pi s_0)^{-1} \cdot \ln(2r_0/D) \cdot \int i^2 dt \quad (13\text{-}2)$$

As described already, it can be considered that the display has no critical problem caused on its display function so long as the discharge between the anode electrode 35 and the focus electrode 15 does not cause the anode electrode 35 made of aluminum to vaporize to such an extent that a portion having an area of $\pi \times r_0^2 = 0.04\ mm^2$ (an area corresponding approximately to an area of 1 subpixel) vaporizes.

An energy found when a portion having an area of $\pi \times r_0^2 = 0.04\ mm^2$ is vaporized by a discharge between the anode electrode 35 and the focus electrode 15 in the anode electrode 35 made of aluminum will be calculated below. The calculation will be based on values shown in the following Table 1. While the thickness of the anode electrode is assumed to be 1 μm ($=s_0$), the anode electrode frequently has such a thickness in portions other than a portion on the phosphor layer.

TABLE 1

| | |
|---|---|
| Thickness of anode electrode | 1 μm ($=s_0$) |
| Melting area | 0.04 $mm^2$ ($=\pi \times r_0^2$) |
| Density of aluminum | 2.7 $g \cdot cm^{-3}$ |

TABLE 1-continued

| | |
|---|---|
| Melting point of aluminum | 660° C. |
| Boiling point of aluminum | 2060° C. |
| Specific heat of aluminum | 0.214 $cal \cdot g^{-1} \cdot K^{-1}$ |
| Heat of solution of aluminum | 94.6 $cal \cdot g^{-1}$ |
| Heat of vaporization of aluminum | 293 $kJ \cdot mol^{-1}$ =10850 $J \cdot g^{-1}$ |

A mass $M_{A1}$ (unit: gram) of aluminum melted, an energy $Q_{MELT}$ (unit: Joule) required for aluminum reaching its melting point (660° C.) from room temperature (30° C.), an energy $Q_{Liq}$ (unit: Joule) required for melting, an energy $Q_{Biol}$ (unit: Joule) required for reaching a boiling point (2060° C.) from the melting point (660° C.), an energy $Q_{Evap}$ required for vaporization and a total energy $Q_{Total}$ required for vaporization are as follows. A specific heat of aluminum in a solid state is used as a specific heat of aluminum in $Q_{Biol}$ for convenience.

$$M_{Al} = 0.04 \times 10^{-2} \times 10^{-4} \times 2.7 = 1.08 \times 10^{-7}\ (g)$$

$$Q_{MELT} = 0.214 \times 4.2 \times (660 - 30) \times M_{Al} = 6.1 \times 10^{-5}\ (J)$$

$$Q_{Liq} = 94.6 \times 4.2 \times M_{Al} = 4.3 \times 10^{-5}\ (J)$$

$$Q_{Biol} = 0.214 \times 4.2 \times (2060 - 660) \times M_{Al} = 1.36 \times 10^{-4}\ (J)$$

$$Q_{Evap} = 10850 \times M_{Al} = 1.17 \times 10^{-3}\ (J)$$

$$Q_{Total} = Q_{MELT} + Q_{Liq} + Q_{Biol} + Q_{Evap} = 1.41 \times 10^{-3}\ (J)$$

It can be said that no local evaporation of the anode electrode 35 takes place so long as the integration value of energy generated in the anode electrode 35 during a discharge that takes place between the anode electrode 35 and the field emission device does not exceed the total energy $Q_{Total}$. That is, it can be said that no portion corresponding to 1 subpixel evaporates in the anode electrode 35. When anode electrode 35 is made of molybdenum (Mo), the total energy $Q_{Total}$ is $2.7 \times 10^{-3}$ (J).

That is, it can be said that no local evaporation takes place in the anode electrode 35 made of aluminum, having a thickness of $s_0 = 1$ μm, so long as the total energy $Q_{Total}$ and $E(r_0)$ satisfy the relationship of the following expression (14).

$$E(r_0) < Q_{Total} = 1.41 \times 10^{-3} \quad (14)$$

When the anode electrode 35 is made of aluminum and has a thickness $s_0$ of 1 μm, $\rho = 2.7 \times 10^{-8}\ \Omega \cdot m$, and a plasma generated by discharge has a radius D of several tens μm at the largest, so that the expression (14) can be specifically represented by the expression (15). Further, since $\pi \times r_0^2 = 0.04\ mm^2$, $r_0 = 0.11$ mm.

$$\int i^2 dt < 1.1 \times 10^{-1} \quad (15)$$

In the equivalent circuit shown in FIG. 8, a positive voltage $V_A$ (10 kV) was applied to the anode electrode 35 from the anode-electrode control circuit 44 through a 100 kΩ resistance element $R_A$. Further, a voltage $V_F$ (=0 V) was applied to the focus electrode 15 from the focus-electrode control circuit 43 through a 1 kΩ resistance element $R_F$. The resistance elements $R_A$ and $R_F$ are arranged outside the display. Further, the electrostatic capacity "C" between the field emission device (more specifically, the focus electrode 15) and the anode electrode 35 is 70 pF. Further, the electric resistance value $R_D$ along the discharge current path (specifically, the electric resistance value of the anode electrode 35 and the focus electrode 15 made of aluminum each) is 0.1 Ω. The anode electrode 35 had a size of 130 mm×100 mm.

Figure 9:
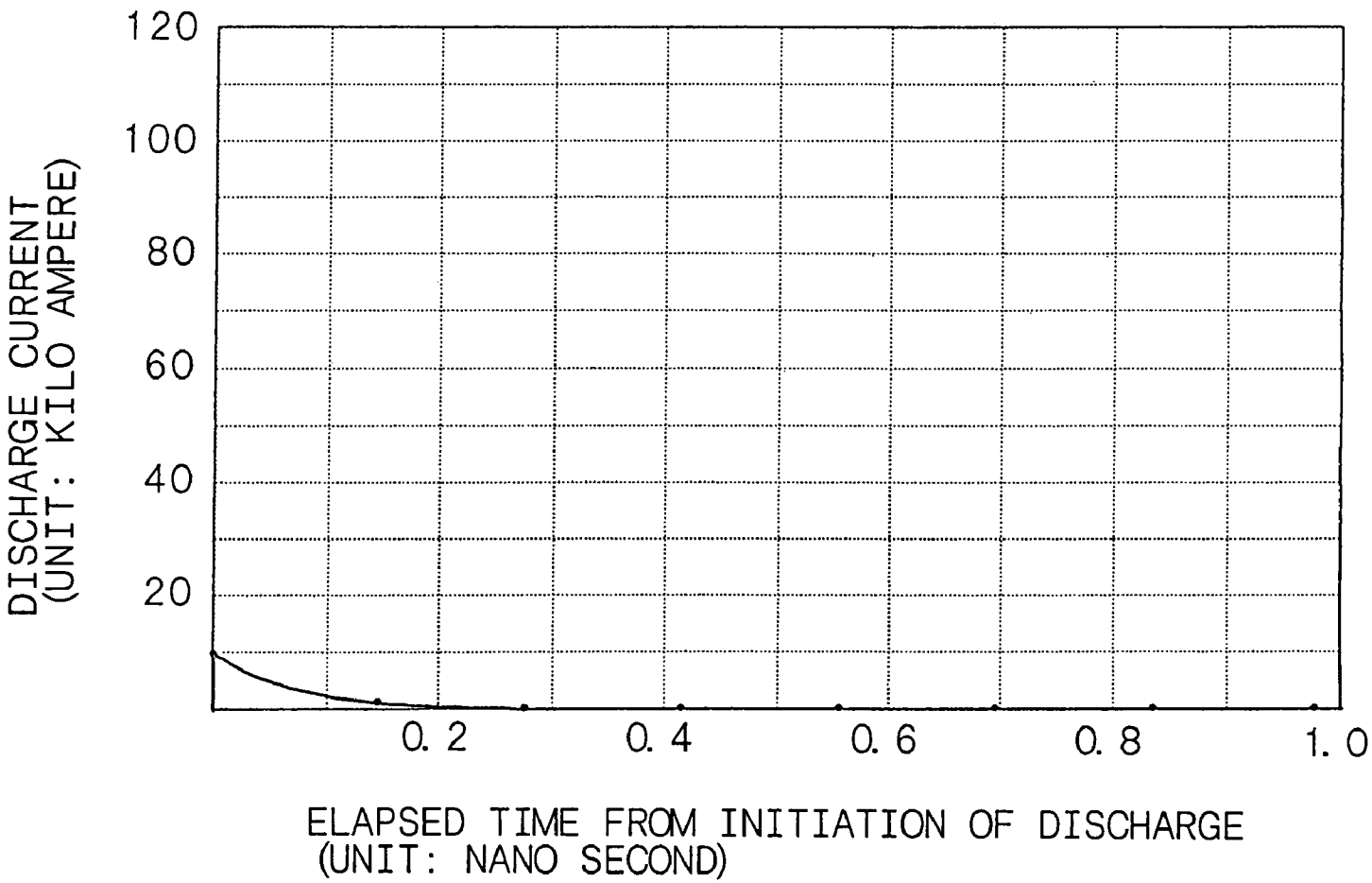
FIG. 9 is a graph showing a calculation result with regard to a discharge current when the electric resistance value "R" of a resistance layer for controlling a discharge current in the equivalent circuit shown in FIG. 8 is set at 0.9Ω.

A discharge current when the electric resistance value "R" of the resistance layer 36 for controlling a discharge current was 0.9 Ω was calculated, and FIG. 9 shows the results. An integration value of the discharge current "i" on the left side of the expression (15) can be determined on the basis of the graph of FIG. 9.

Integration values $\int i^2dt$ of a discharge current "i" on the left side of the expression (15) were similarly obtained when the electric resistance values "R" of the resistance layer 36 for controlling a discharge current were set at various values, and the following Table 2 shows the results.

TABLE 2

| $R_D(\Omega)$ | $R(\Omega)$ | $R_D + R(\Omega)$ | $\int i^2dt$ |
|---|---|---|---|
| 0.1 | 0.26 | 0.36 | $1.1 \times 10^{-2}$ J |
| 0.1 | 0.9 | 1.0 | $3.9 \times 10^{-3}$ J |
| 0.1 | 4.9 | 5.0 | $7.2 \times 10^{-4}$ J |
| 0.1 | 99.9 | 100 | $3.5 \times 10^{-5}$ J |

The following expression (16) is determined from the results in Table 2.

$$\int i^2dt=(R_D+R)^{-1.023}/260 \quad (16)$$

It is seen from the expression (16) that the expression (15) obtained when the anode electrode is made of 1 μm thick aluminum is satisfied so long as the value of an electric resistance value ($R+R_D$) exceeds 0.36 Ω, that is, so long as the value of electric resistance value "R" of the resistance layer 36 for controlling a discharge current exceeds 0.26 Ω. The above value of electric resistance value "R" of the resistance layer 36 for controlling a discharge current can be controlled by selecting a material for constituting the resistance layer 36 for controlling a discharge current and its thickness ($t_R$) as required. As the electric resistance value $R_D$ (specifically, electric resistance values of the anode electrode made of aluminum and the focus electrode), there can be used a total value of an average electric resistance value between the central portion of the anode electrode 35 and a circumferential portion of the anode electrode 35 and an average electric resistance value between the central portion of the focus electrode 15 and a circumferential portion of the focus electrode 15. Further, as an electric resistance value R of the resistance layer 36 for controlling a discharge current, there can be used an electric resistance value between front and reverse sides of that portion of the resistance layer 36 from which a damage-allowable area (for example, an area for 1 subpixel) is removed.

When FIG. 9 is compared with FIGS. 28 and 29, it can be seen that the peak value of a discharge current is sharply decreased by providing the resistance layer 36 for controlling a discharge current. When the resistance layer 36 for controlling a discharge current is provided, the peak value of a discharge current is decreased to be as small as approximately 0.1 times, so that the occurrence of damage to a material constituting the field emission device and the anode electrode can be consequently far more reliably suppressed.

EXAMPLE 2

Figure 10:
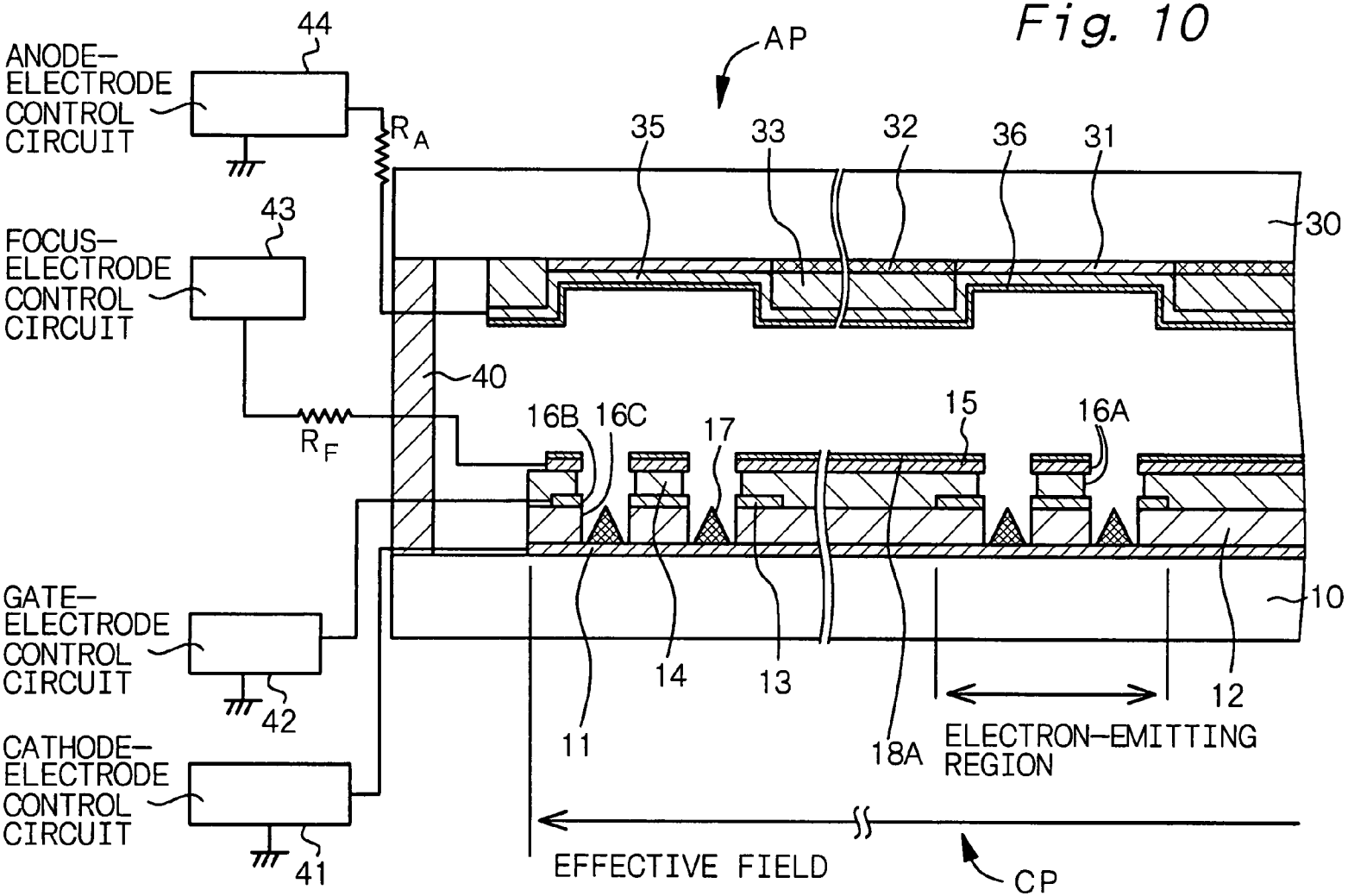
FIG. 10 is a schematic partial end view of a cold cathode field emission display of Example 2.

Example 2 is a variant of Example 1. FIG. 10 shows a schematic partial end view of a display of Example 2. A schematic partial perspective exploded view of a cathode panel CP and an anode panel AP is basically as shown in FIG. 2.

In the display of Example 2, field emission devices formed in the cathode panel CP have a structure that is similar to that of the field emission devices explained in Example 1 except that a second resistance layer 18A is formed on the focus electrode 15 made of 1 μm thick aluminum. The second resistance layer 18A is made of ITO having a thickness of $t'_R$=0.2 μm. The focus electrode 15 has the form of one sheet covering the effective field. The opening portion 16A formed through the focus electrode 15 is provided for each cold cathode field emission device.

In Example 2, further, the following expression (1') is satisfied, in which

C': an electrostatic capacity (F) between the focus electrode and the anode electrode, and $V_A$: a voltage (V) applied to the anode electrode.

$$Q'>(1/2)C'\cdot V_A^2 \quad (1')$$

When a material constituting the second resistance layer 18A vaporizes from a solid phase through a liquid phase, $$Q' \approx \pi \cdot t'_R \cdot r'^2_R \cdot d'_R \times [C'_{m_S}(T'_L - T_r) + Q'_{S_L} + C'_{m_L}(T'_G - T'_L) + Q'_{L_G}] \times 10^{-6}$$

On the other hand, when a material constituting the second resistance layer vaporizes from a solid phase directly, $$Q' \approx \pi \cdot t'_R \cdot r'^2_R \cdot d'_R \times [C'_{m_S}(T'_G - T_r) + Q'_{L_G}] \times 10^{-6}$$

In the above expression, $r'_R$: a radius (mm) of a vaporization-allowable region of the second resistance layer, or a radius (mm) of a size (region) that does not cause a problem on the display function of a display even when the second resistance layer of such a size (region) vaporizes, or a radius (mm) of that size (region) of the second resistance layer which corresponds to 1 subpixel, $d'_R$: a density ($g\cdot cm^{-3}$) of a material constituting the second resistance layer, $C'_{m_S}$: a specific heat ($J\cdot g^{-1}\cdot K^{-1}$) of a material constituting the second resistance layer in a solid state, $T'_L$: a melting point (° C.) of a material constituting the second resistance layer, $T_r$: room temperature (° C.), $Q'_{S_L}$: a heat of solution ($J\cdot g^{-1}$) of a material constituting the second resistance layer, $C'_{m_L}$: a specific heat ($J\cdot g^{-1}\cdot K^{-1}$) of a material constituting the second resistance layer in a liquid state, and $T'_G$: a boiling point (° C.) of a material constituting the second resistance layer.

Further, when a material constituting the second resistance layer vaporizes from a solid phase through a liquid phase, $Q'_{L_G}$: a heat of vaporization ($J\cdot g^{-1}$) of a material constituting the second resistance layer.

When a material constituting the second resistance layer vaporizes from a solid phase directly, $Q'_{L_G}$: a sum ($J \cdot g^{-1}$) of a heat of solution and a heat of vaporization of a material constituting the second resistance layer.

Alternatively, the following expression (2') is satisfied.

$$t'_R \times 10^{-2} > (1/2) C' \cdot V_A^2 \quad (2')$$

A detailed explanation of the electric resistance R of the second resistance layer 18A for controlling a discharge current and a detailed explanation of the expressions (1') and (2') are omitted since they are the same as those of the electric resistance "R" of the resistance layer 36 for controlling a discharge current and the expressions (1) and (2) in Example 1.

EXAMPLE 3

Example 3 is directed to the display according to the third and fourth aspects of the present invention.

Figure 11:
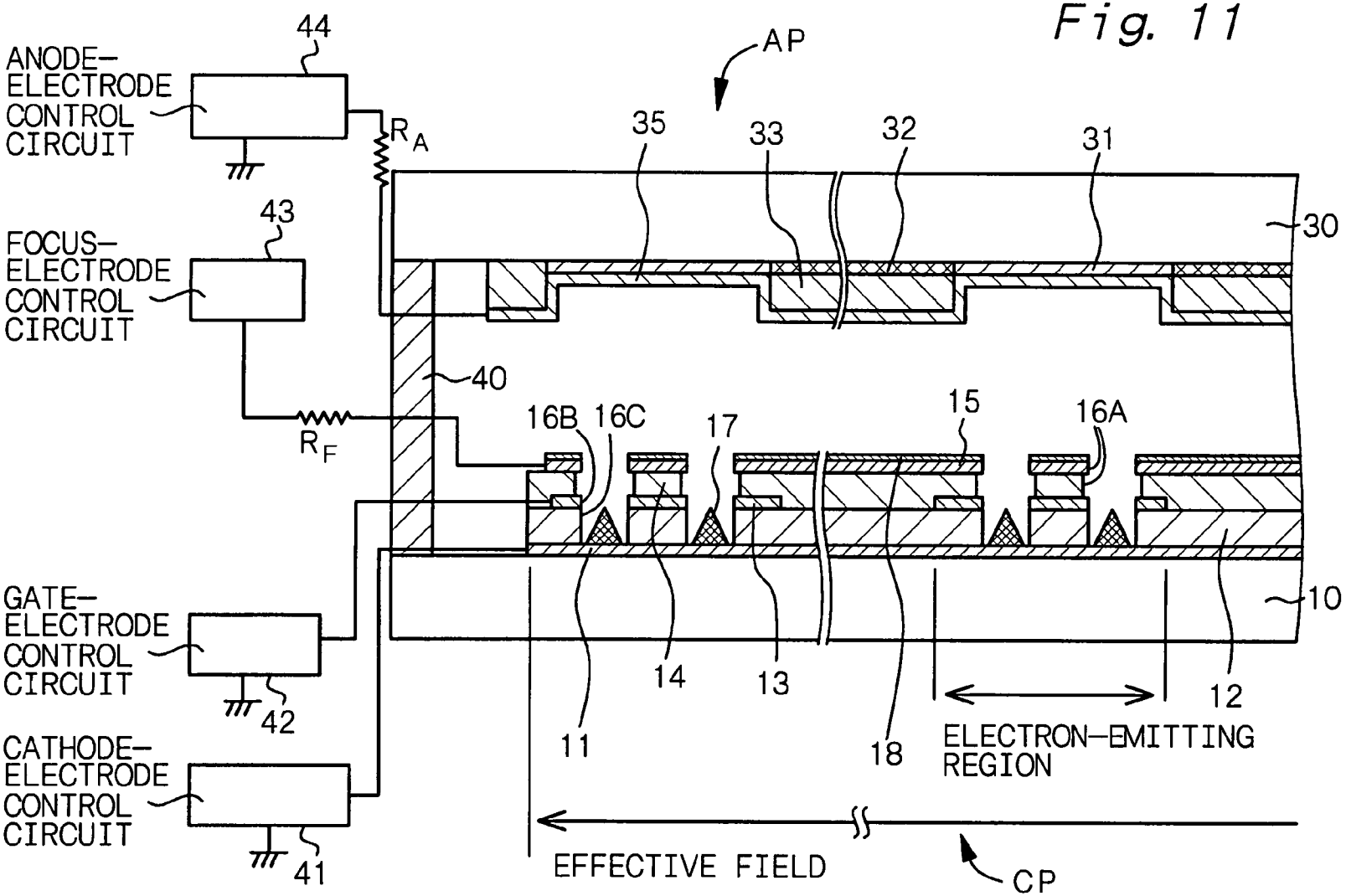
FIG. 11 is a schematic partial end view of a cold cathode field emission display of Example 3.

FIG. 11 shows a schematic partial end view of the display of Example 3. A schematic partial perspective exploded view of a cathode panel CP and an anode panel AP is basically as shown in FIG. 2.

In the display of Example 3, a cathode panel CP having a plurality of cold cathode field emission devices having a cathode electrode 11, a gate electrode 13, a focus electrode 15 and an electron-emitting portion 17 and an anode panel AP are also bonded to each other through a frame 40 in their circumferential portions.

A detailed explanation of the anode panel will be omitted since the anode panel has a structure similar to that of the anode panel AP explained in Example 1 except for the non-formation of the resistance layer 36.

Further, a detailed explanation of field emission devices formed in the cathode panel CP will be omitted since they have a structure similar to that of the field emission device explained in Example 1 except for the formation of a resistance layer 18 formed on the focus electrode 15 made of 1 μm thick aluminum. The resistance layer 18 is made of ITO having a thickness of $t_R$=0.2 μm. Further, the focus electrode 15 has the form of one sheet covering the effective field. An opening portion 16A formed through the focus electrode 15 is formed for each cold cathode field emission device.

In Example 3, the following expression (3) is satisfied.

$$Q > (1/2) C \cdot V_A^2 \quad (3)$$

In the above expression, $$Q \approx \pi \cdot t_R \cdot r_R^2 \cdot d_R \times [C_{m_S}(T_L - T_r) + Q_{S_L} + C_{m_L}(T_G - T_L) + Q_{L_G}] \times 10^{-6}$$

where,

C: an electrostatic capacity (F) between the focus electrode and the anode electrode, $V_A$: a voltage (V) applied to the anode electrode, $r_R$: a radius (mm) of a vaporization-allowable region of the resistance layer, or a radius (mm) of a size (region) that does not cause a problem on the display function of a display even when the resistance layer of such a size (region) vaporizes, or a radius (mm) of that size (region) of the resistance layer which corresponds to 1 subpixel, $d_R$: a density ($g \cdot cm^{-3}$) of a material constituting the resistance layer, $C_{m_S}$: a specific heat ($J \cdot g^{-1} \cdot K^{-1}$) of a material constituting the resistance layer in a solid state, $T_L$: a melting point (° C.) of a material constituting the resistance layer, $T_r$: room temperature (° C.), $Q_{S_L}$: a heat of solution ($J \cdot g^{-1}$) of a material constituting the resistance layer, $C_{m_L}$: a specific heat ($J \cdot g^{-1} \cdot K^{-1}$) of a material constituting the resistance layer in a liquid state, $T_G$: a boiling point (° C.) of a material constituting the resistance layer, and $Q_{L_G}$: a heat of vaporization ($J \cdot g^{-1}$) of a material constituting the resistance layer.

Alternatively, the following expression (4) is satisfied.

$$t_R \times 10^{-2} > (1/2) C \cdot V_A^2 \quad (4)$$

In the above expression,

C: an electrostatic capacity (F) between the focus electrode and the anode electrode, and $V_A$: a voltage (V) applied to the anode electrode.

A detailed explanation of the electric resistance value R of the resistance layer 18 for controlling a discharge current and a detailed explanation of the expressions (3) and (4) are omitted since they are similar to explanations of the electric resistance value R of the resistance layer 36 for controlling a discharge current and the expressions (1) and (2) in Example 1.

EXAMPLE 4

Example 4 is a variant of Examples 1 to 3. In Example 4, an anode electrode is constituted of "N" (N≧2) anode electrode units 35A, and the above "C" is an electrostatic capacity (unit: F) between the field emission device (more specifically, the focus electrode 15) and the anode electrode unit 35A.

Figure 12:
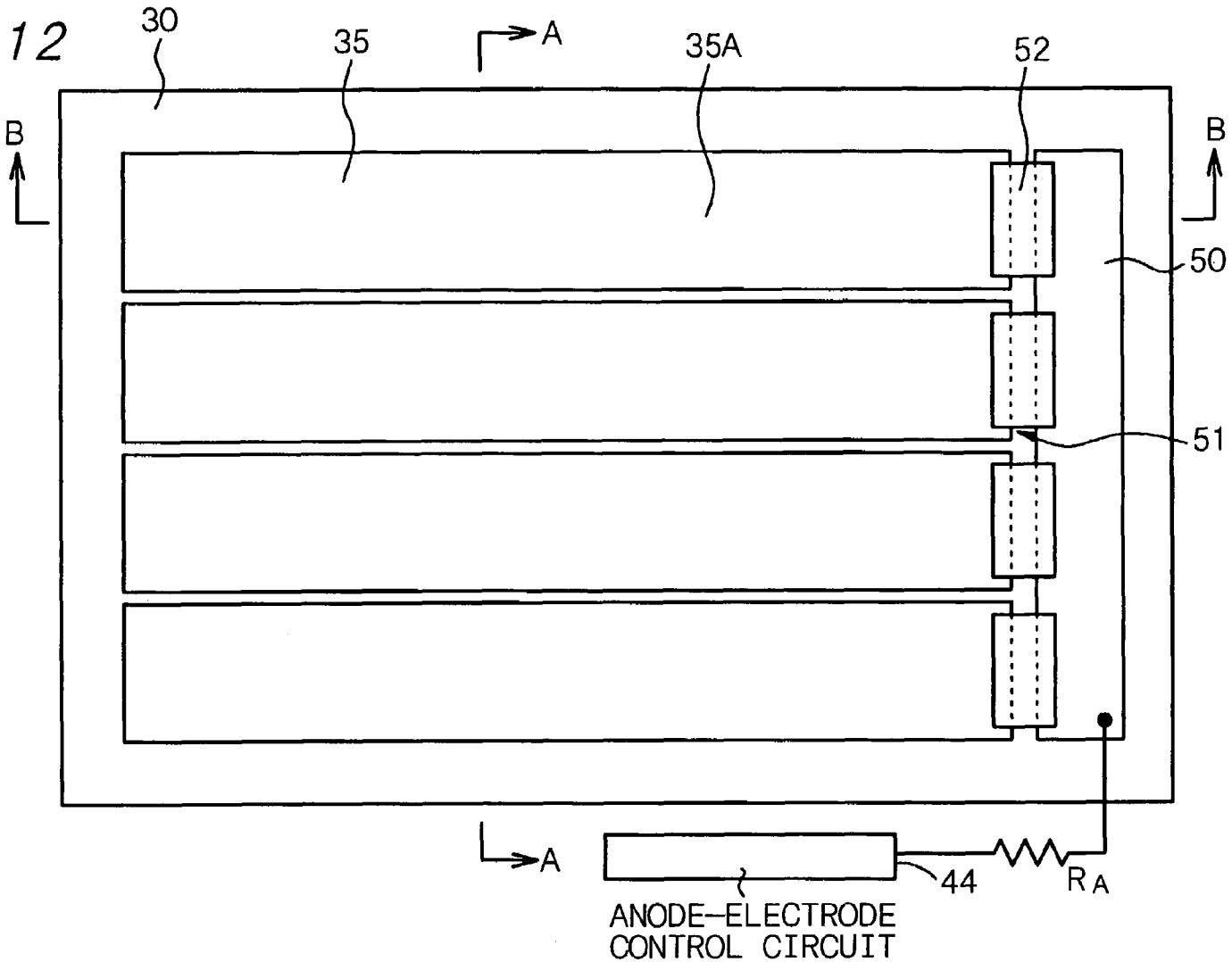
FIG. 12 is a schematic plan view of an anode electrode in a cold cathode field emission display of Example 4.
Figure 13A:
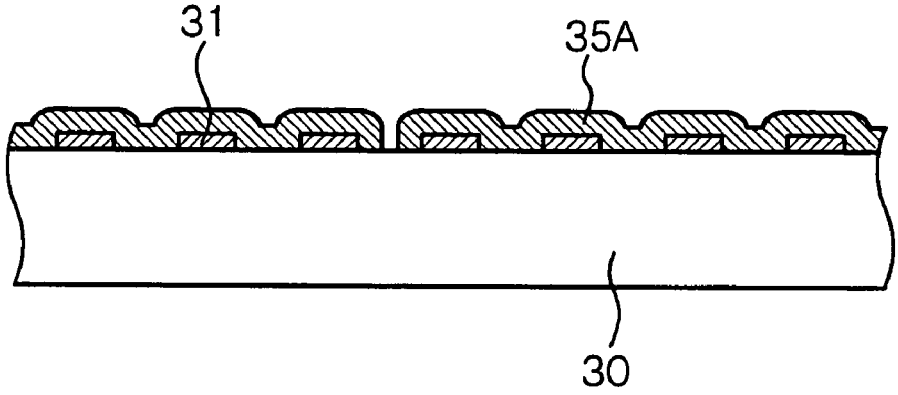
FIGS. 13A and 13B are a schematic partial end view of an anode panel taken along line A-A in FIG. 12 and a schematic partial end view of the same taken along line B-B in FIG. 12, respectively.
Figure 13B:
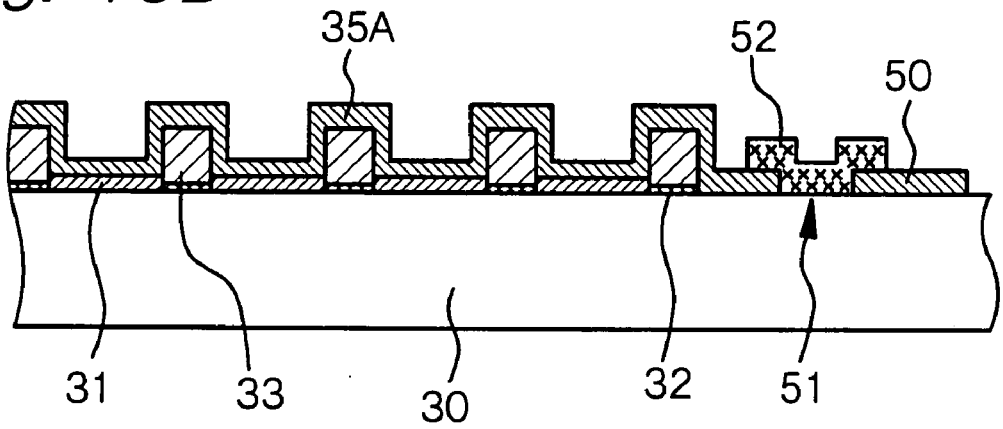

FIG. 12 shows a schematic plan view of the anode electrode, FIG. 13A shows a schematic partial end view of an anode panel AP taken along line A-A in FIG. 12, and FIG. 13B shows a schematic partial end view of the anode panel AP taken alone line B-B in FIG. 12. FIGS. 12 and 13 omit showing of a resistance layer 36.

The anode electrode as a whole has a form covering the rectangle effective field (size: 70 mm×110 mm) and is made of an aluminum thin film. The anode electrode in Example 4 is constituted of 200 anode electrode units 35A. The relationship of a total number "n" of columns of unit phosphor layers 31 arranged in the form of a straight line and "N" is n=20N.

The anode electrode unit 35A is large to such an extent that the anode electrode unit 35A is not vaporized by an energy (to be referred to as "generation energy" hereinafter) generated on the basis of an electrostatic capacity C formed between the anode electrode unit 35A and the field emission device (more specifically, the focus electrode 15) (more specifically, the size being large to such an extent that no portion corresponding to 1 subpixel in the anode electrode unit 35A is vaporized by the above generation energy). Specifically, each anode electrode unit 35A had a rectangular outer form and had a size (area $S_{AU}$) of 0.33 mm×110 mm. For simplification of drawings, FIG. 12 shows four anode electrode units 35A.

Each of the "N" anode electrode units 35A is connected to the anode-electrode control circuit 44 through one electric supply line 50. The electric supply line 50 is also made, for example, of an aluminum thin film. A resistance element $R_A$ (electric resistance value of 100 kΩ in a shown embodiment) is placed between the anode-electrode control circuit 44 and the electric supply line 50. The above resistance element $R_A$ is arranged outside the display. A gap 51 is provided between each anode electrode unit 35A and the electric supply line 50, and each anode electrode unit 35A and the electric supply line 50 are connected through a resistance element 52. The resistance element 52 was constituted of a resistance thin film made of amorphous silicon. The resistance element 52 is formed on the gap 51 so as to bridge between each anode electrode unit 35A and the electric supply line 50. The resistance element 52 has an electric resistance value ($r_1$) of approximately 30 kΩ.

In the display in Example 4, when the distance between the anode electrode unit 35A and the focus electrode 15 is "L" (unit: mm) and when the area of the anode electrode unit 35A is $S_{AU}$ (unit: mm$^2$), $(V_A/7)^2\times(S_{AU}/L)\leqq 2250$ is satisfied, and further, $(V_A/7)^2\times(S_{AU}/L)\leqq 450$ is satisfied. Specifically, the value of "L" is 1.0 mm, and the value of $S_{AU}$ is 36.3 mm$^2$.

Since the anode electrode unit 35A is formed on the substrate 30, on the separation wall 33 and on the phosphor layer 31, the anode electrode unit 35A has the form of convexoconcave, and the distance "L" between the anode electrode unit 35A and the field emission device is not constant. Therefore, the shortest distance between the anode electrode unit and the field emission device, that is, the distance specifically between the anode electrode unit 35A on the separation wall 33 and the field emission device (more specifically, the gate electrode 15) is taken as "L".

Figure 14:
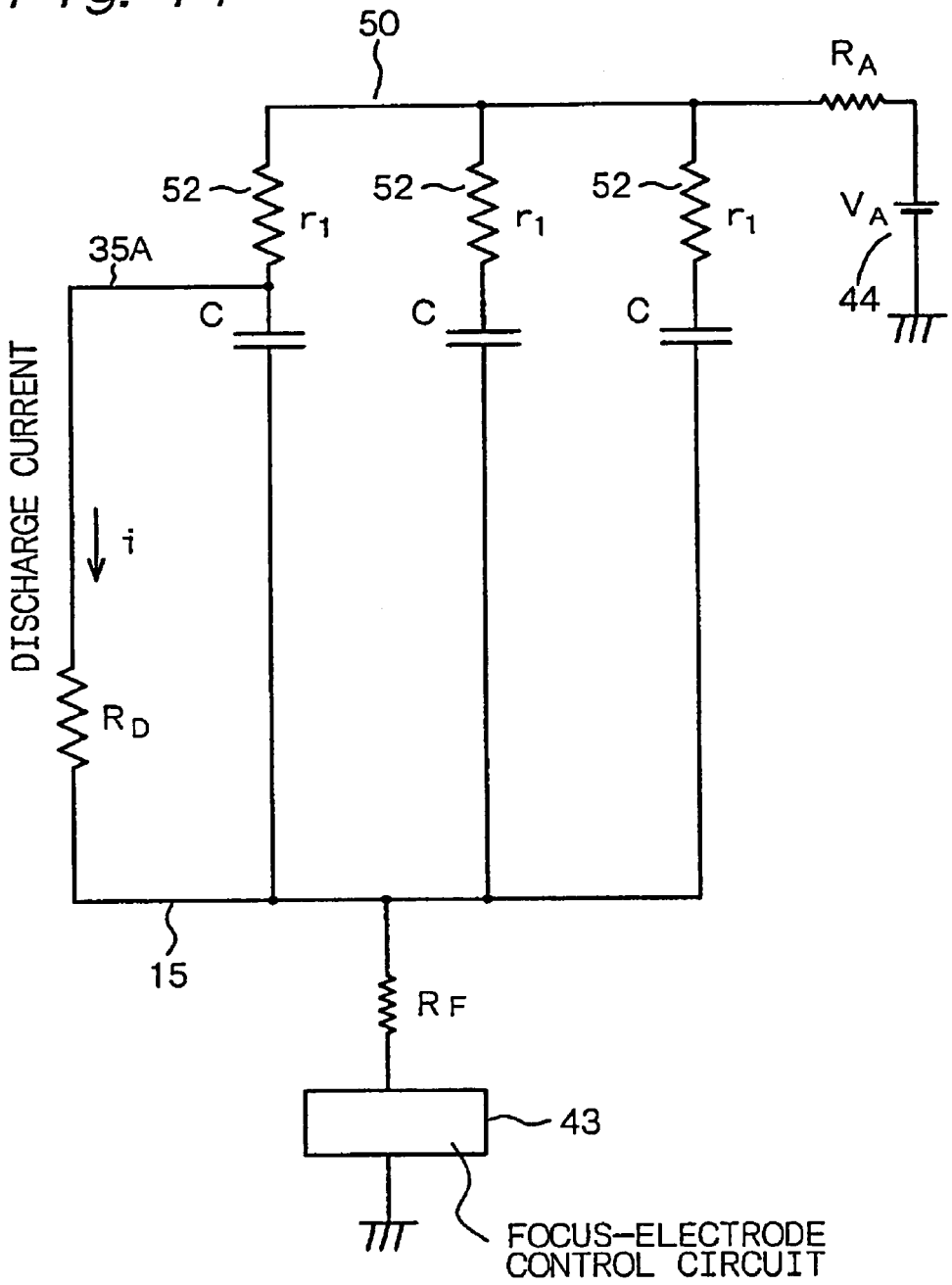
FIG. 14 is an equivalent circuit found when a discharge takes place between an anode electrode unit and a focus electrode in the cold cathode field emission display of Example 4 having no resistance layer.
Figure 15:
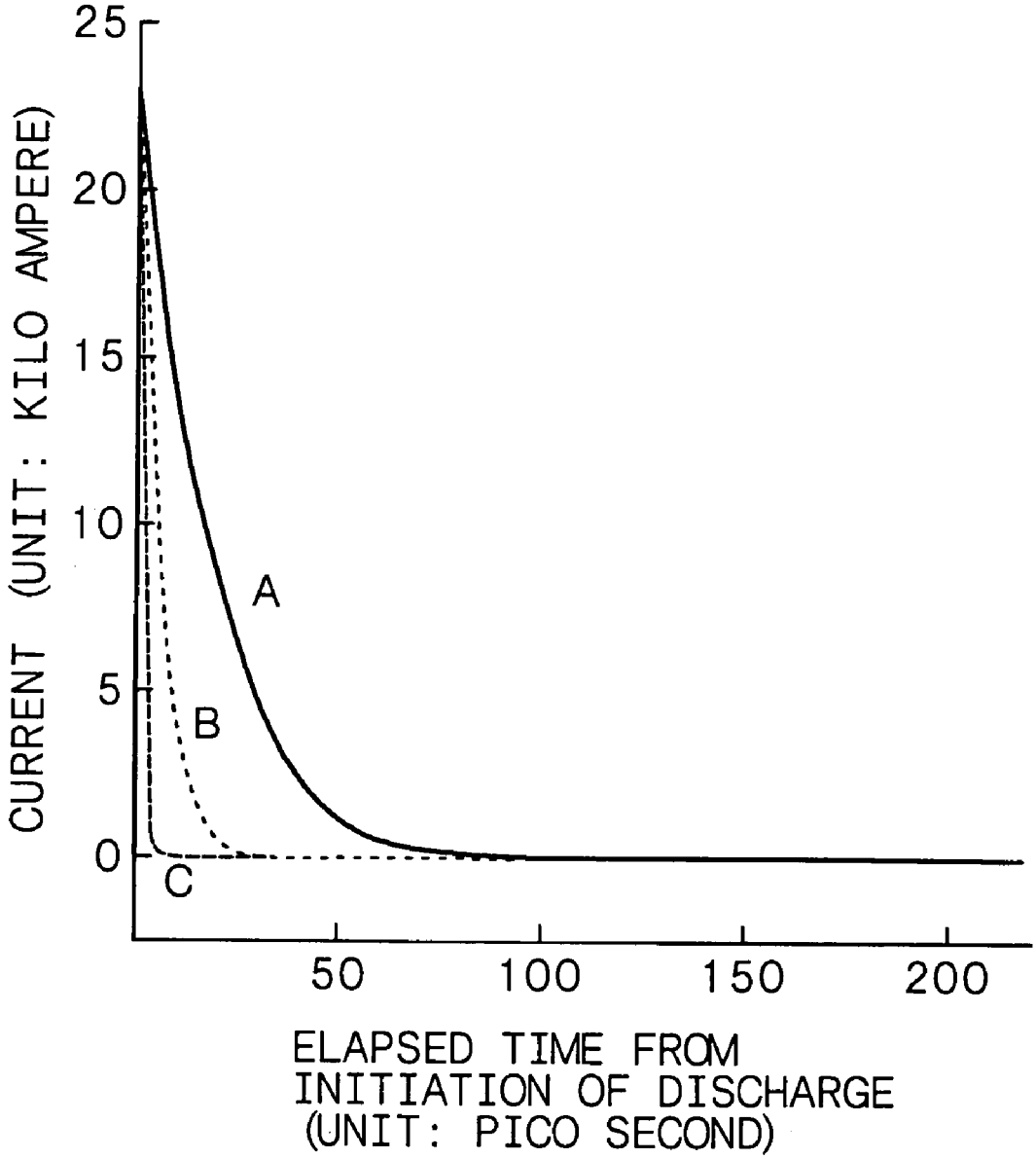
FIG. 15 is a graph showing simulation results with regard to a change in abnormal discharge current "i" when the anode electrode unit of the cold cathode field emission display of Example 4 has an area $S_{AU}$ of 9000 $mm^2$, 3000 $mm^2$ and 450 $mm^2$.
Figure 16:
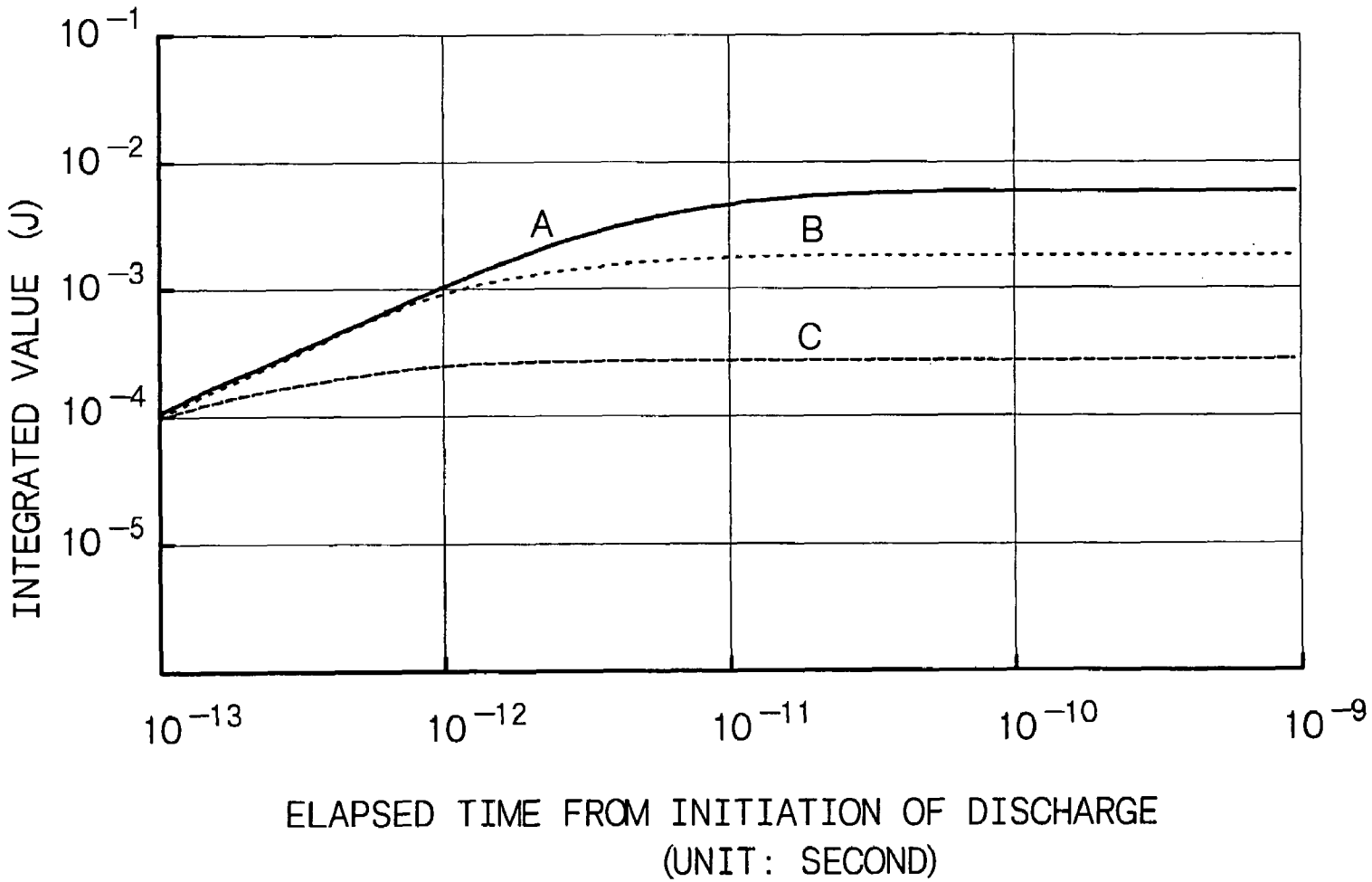
FIG. 16 is a graph showing simulation results with regard to an integration value of energy generated during an abnormal discharge when the anode electrode unit of the cold cathode field emission display of Example 4 has an area $S_{AU}$ of 9000 $mm^2$, 3000 $mm^2$ and 450 $mm^2$.

FIG. 14 shows an equivalent circuit found when a discharge takes place between an anode electrode unit 35A and the focus electrode 15 when no resistance layers 18 and 36 are provided. FIG. 14 shows three anode electrode units. Due to the discharge between the anode electrode unit 35A and the focus electrode 15, a current "i" flows, and the total value $R_D$ of electric resistance values of the anode electrode unit 35A and the focus electrode 15 was determined to be 0.2 Ω. Further, the values of the electrostatic capacity "C" formed by the anode electrode unit 35A and the focus electrode 15 when the values of $S_{AU}$ were 9000 mm$^2$, 3000 mm$^2$ and 450 mm$^2$ were 60 pF, 20 pF and 3 pF, respectively. Further, $V_A$ was set at 7 kV. FIGS. 15 and 16 show a change in the current "I" flowing in the anode electrode unit 35A and generation energy in the anode electrode unit 35A when the values of $S_{AU}$ were 9000 mm$^2$, 3000 mm$^2$ and 450 mm$^2$. In FIGS. 15 and 16, a curve "A" shows a value when the value of $S_{AU}$ was 9000 mm$^2$, a curve "B" shows a value when the value of $S_{AU}$ was 3000 mm$^2$, and a curve "C" shows a value when the value of $S_{AU}$ was 450 mm$^2$. Further, an integration value of the generation energy (integrated value for 1 nanosecond from the occurrence of a discharge) was as shown in the following Table 3. There was carried out a simulation in which the value of the electrostatic capacity "C" formed by the anode electrode unit 35A and the focus electrode 15 at an $S_{AU}$ value of 2250 mm$^2$ was 15 pF, and $V_A$ was 7 kV, and the following Table 3 further shows an integration value of generation energy in the simulation.

TABLE 3

| Anode electrode unit area | Integration value of generation energy in discharge |
|---|---|
| 9000 mm$^2$ | $5.6\times10^{-3}$ (J) |
| 3000 mm$^2$ | $1.9\times10^{-3}$ (J) |
| 2250 mm$^2$ | $1.4\times10^{-3}$ (J) |
| 450 mm$^2$ | $2.8\times10^{-4}$ (J) |

When the anode electrode unit 35A had areas $S_{AU}$ of 9000 mm$^2$ and 3000 mm$^2$, the integration values of generation energy during the discharge between the anode electrode unit 35A and the field emission device exceed $Q_{Total}$ ($1.41\times10^{-3}$ J) explained in Example 1. On the other hand, when the anode electrode unit 35A has an area of 2250 mm$^2$ or less, the integration values of generation energy during the discharge between the anode electrode unit 35A and the field emission device do not at all exceed $Q_{Total}$. There is therefore no case in which the anode electrode unit 35A is damaged locally (more specifically, up to a size corresponding to 1 subpixel) by the generation energy during the discharge between the anode electrode unit 35A and the field emission device. Specifically, there is no case in which the anode electrode unit 35A is vaporized locally (more specifically, up to a size corresponding to 1 subpixel) by the discharge between the anode electrode unit 35A and the field emission device.

Generally, energy accumulated in a capacitor having a capacity "c" is represented by $(1/2)cV^2$. When a counterpart electrode to the capacitor has an area "S" and when the distance between the electrodes is "L", the capacity "c" of the capacitor is represented by $\epsilon(S/L)$. Therefore, if the following expression is satisfied when the counterpart electrode has an area $S_{AU}$ and when the distance between the anode electrode unit 35A and the field emission device is "L", it follows that the anode electrode unit 35A corresponding to the counterpart electrode to the capacity is not damaged locally (more specifically, up to a size corresponding to 1 subpixel).

$$\epsilon(1/2)(S_{AU}/L)V_A^2\leqq\epsilon(1/2)[2250/1]7^2$$

When the above expression is modified, $$(V_A/7)^2\times(S_{AU}/L)\leqq 2250$$

is obtained.

(In Re Various Field Emission Devices)

While various field emission devices and methods of manufacturing them will be explained below, explanations with regard to the formation of a resistance layer 18 on a focus electrode 15 will be omitted. For example, after field emission devices are fabricated, the resistance layer 18 can be formed, for example, by an oblique sputtering method.

While the Spindt-type (field emission devices each having a conical electron-emitting portion formed on the cathode electrode 11 positioned in the bottom portion of the opening portion 16) has been explained as field emission devices in Examples, there may be employed, for example, a plane-type (field emission devices each having a more or less plane-surfaced electron-emitting portion formed on the cathode electrode 11 positioned in the bottom portion of the opening portion 16). These field emission devices will be referred to as field emission devices each having a first structure.

Alternatively, there may be employed a field emission device comprising:

(a) a stripe-shaped cathode electrode being formed on a supporting member and extending in a first direction, (b) an insulating layer formed on the supporting member and the cathode electrode, (c) a stripe-shaped gate electrode being formed on the insulating layer and extending in a second direction different from the first direction, (d) an insulating film formed on the gate electrode and the insulating film, (e) a focus electrode formed on the insulating film, and (f) an opening portion formed through the focus electrode and the insulating film and the gate electrode and the insulating layer, and having a structure in which that portion of the cathode electrode which is exposed in the bottom portion of the opening portion corresponds to an electron-emitting portion and electrons are emitted from the exposed portion of the cathode electrode in the bottom portion of the opening portion.

The thus-structured field emission device includes a flat-type field emission device that emits electrons from a flat surface of the cathode electrode. This field emission device will be called a field emission device having a second structure.

In the Spindt-type field emission device, the material for constituting an electron-emitting portion may include at least one material selected from the group consisting of tungsten, a tungsten alloy, molybdenum, a molybdenum alloy, titanium, a titanium alloy, niobium, a niobium alloy, tantalum, a tantalum alloy, chromium, a chromium alloy and impurity-containing silicon (polysilicon or amorphous silicon). The electron-emitting portion of the Spindt-type field emission device can be formed by, for example, a vapor deposition method, a sputtering method and a CVD method.

In the plane-type field emission device, preferably, the electron-emitting portion is made of a material having a smaller work function Φ than a material for constituting a cathode electrode. The material for constituting an electron-emitting portion can be selected on the basis of the work function of a material for constituting a cathode electrode, a potential difference between the gate electrode and the cathode electrode, a required current density of emitted electrons, and the like. Typical examples of the material for constituting a cathode electrode of the field emission device include tungsten (Φ=4.55 eV), niobium (Φ=4.02-4.87 eV), molybdenum (Φ=4.53-4.95 eV), aluminum (Φ=4.28 eV), copper (Φ=4.6 eV), tantalum (Φ=4.3 eV), chromium (Φ=4.5 eV) and silicon (Φ=4.9 eV). The material for constituting an electron-emitting portion preferably has a smaller work function Φ than these materials, and the value of the work function thereof is preferably approximately 3 eV or smaller. Examples of such a material include carbon (Φ<1 eV), cesium (Φ=2.14 eV), $LaB_6$ (Φ=2.66-2.76 eV), BaO (Φ=1.6-2.7 eV), SrO (Φ=1.25-1.6 eV), $Y_2O_3$ (Φ=2.0 eV), CaO (Φ=1.6-1.86 eV), BaS (Φ=2.05 eV), TiN (Φ=2.92 eV) and ZrN (Φ=2.92 eV). More preferably, the electron-emitting portion is made of a material having a work function Φ of 2 eV or smaller. The material for constituting an electron-emitting portion is not necessarily required to have electric conductivity.

Otherwise, in the plane-type field emission device, the material for constituting an electron-emitting portion can be selected from materials having a secondary electron gain δ greater than the secondary electron gain δ of the electrically conductive material for constituting a cathode electrode. That is, the above material can be properly selected from metals such as silver (Ag), aluminum (Al), gold (Au), cobalt (Co), copper (Cu), molybdenum (Mo), niobium (Nb), nickel (Ni), platinum (Pt), tantalum (Ta), tungsten (W) and zirconium (Zr); semiconductors such as silicon (Si) and germanium (Ge); inorganic simple substances such as carbon and diamond; and compounds such as aluminum oxide ($Al_2O_3$), barium oxide (BaO), beryllium oxide (BeO), calcium oxide (CaO), magnesium oxide (MgO), tin oxide ($SnO_2$), barium fluoride ($BaF_2$) and calcium fluoride ($CaF_2$). The material for constituting an electron-emitting portion is not necessarily required to have electric conductivity.

In the plane-type field emission device, as a material for constituting an electron-emitting portion, particularly, carbon is preferred. More specifically, diamond, graphite and a carbon-nanotube structure are preferred. When the electron-emitting portion is made of diamond, graphite or the carbon-nanotube structure, an emitted-electron current density necessary for the display can be obtained at an electric field intensity of $5\times10^7$ V/m or lower. Further, since diamond is an electric resister, emitted-electron currents obtained from the electron-emitting portions can be brought into uniform currents, and the fluctuation of brightness can be suppressed when such field emission devices are incorporated into the display. Further, since the above materials exhibit remarkably high durability against sputtering by ions of residual gas in the display, field emission devices having a longer lifetime can be attained.

Specifically, the carbon-nanotube structure includes a carbon-nanotube and/or a carbon-nanofiber. More specifically, the electron-emitting portion may be constituted of a carbon-nanotube, it may be constituted of a carbon-nanofiber, or it may be constituted of a mixture of a carbon-nanotube with a carbon-nanofiber. Macroscopically, the carbon-nanotube and carbon-nanofiber may have the form of a powder or a thin film. The carbon-nanotube structure may have the form of a cone in some cases. The carbon-nanotube and carbon-nanofiber can be produced or formed by a known PVD method as an arc discharge method and a laser abrasion method; and any one of various CVD methods such as a plasma CVD method, a laser CVD method, a thermal CVD method, a gaseous phase synthetic method and a gaseous phase growth method.

The plane-type field emission device can be produced by a method in which a dispersion of a carbon-nanotube structure in a binder material is, for example, applied onto a desired region of the cathode electrode and the binder material is fired or cured (more specifically, a method in which the carbon-nanotube structure is dispersed in an organic binder material such as an epoxy resin or an acrylic resin or an inorganic binder material such as water glass or silver paste and the like, the dispersion is, for example, applied onto a desired region of the cathode electrode, then, the solvent is removed and the binder material is fired and cured). The above method will be referred to as "first forming method of a carbon-nanotube structure". The application method includes, for example, a screen printing method.

Alternatively, the plane-type field emission device can be produced by a method in which a dispersion of the carbon-nanotube structure in a metal compound solution is applied onto the cathode electrode and then, the metal compound is fired, whereby the carbon-nanotube structure is fixed to the surface of the cathode electrode with a matrix containing metal atoms derived from the metal compound. The above method will be referred to as "second forming method of a carbon-nanotube structure". The matrix is preferably made of an electrically conductive metal oxide. More specifically, it is preferably made of tin oxide, indium oxide, indium-tin oxide, zinc oxide, antimony oxide or antimony-tin oxide. After the firing, there can be obtained a state where part of each carbon-nanotube structure is embedded in the matrix, or there can be obtained a state where the entire portion of each carbon-nanotube structure is embedded in the matrix. The matrix preferably has a volume resistivity of $1\times10^{-9}$ Ω·m to $5\times10^{-6}$ Ω·m.

The metal compound for constituting the metal compound solution includes, for example, an organometal compound, an organic acid metal compound and metal salts (for example, chloride, nitrate and acetate). The organic acid metal compound solution is, for example, a solution prepared by dissolving an organic tin compound, an organic indium compound, an organic zinc compound or an organic antimony compound in an acid (for example, hydrochloric acid, nitric acid or sulfuric acid) and diluting the resultant solution with an organic solvent (for example, toluene, butyl acetate or isopropyl alcohol). Further, the organic metal compound solution is, for example, a solution prepared by dissolving an organic tin compound, an organic indium compound, an organic zinc compound or an organic antimony compound in an organic solvent (for example, toluene, butyl acetate or isopropyl alcohol). When the amount of the solution is 100 parts by weight, the solution preferably has a composition containing 0.001 to 20 parts by weight of the carbon-nanotube structure and 0.1 to 10 parts by weight of the metal compound. The solution may contain a dispersing agent and a surfactant. From the viewpoint of increasing the thickness of the matrix, an additive such as carbon black or the like may be added to the metal compound solution. In some cases, the organic solvent may be replaced with water.

The method for applying onto the cathode electrode the metal compound solution in which the carbon-nanotube structure is dispersed includes a spray method, a spin coating method, a dipping method, a die quarter method and a screen printing method. Of these, a spray method is preferred in view of easiness in application.

There may be employed a constitution in which the metal compound solution in which the carbon-nanotube structure is disperse is applied onto the cathode electrode, the metal compound solution is dried to form a metal compound layer, then, an unnecessary portion of the metal compound layer on the cathode electrode is removed, and then the metal compound is fired. Otherwise, an unnecessary portion of the metal compound layer on the cathode electrode may be removed after the metal compound is fired. Otherwise, the metal compound solution may be applied only onto a desired region of the cathode electrode.

The temperature for firing the metal compound is preferably, for example, a temperature at which the metal salt is oxidized to form a metal oxide having electric conductivity, or a temperature at which the organometal compound or an organic acid metal compound is decomposed to form a matrix (for example, a metal oxide having electric conductivity) containing metal atoms derived from the organometal compound or the organic acid metal compound. For example, the above temperature is preferably at least 300° C. The upper limit of the firing temperature can be a temperature at which elements constituting the field emission device or the cathode panel do not suffer any thermal damage and the like.

In the first forming method or the second forming method of a carbon-nanotube structure, it is preferred to carry out a kind of an activation treatment (washing treatment) of the surface of the electron-emitting portion after the formation of the electron-emitting portion, since the efficiency of emission of electrons from the electron-emitting portion is further improved. The above activation treatment includes a plasma treatment in an atmosphere containing a gas such as hydrogen gas, ammonia gas, helium gas, argon gas, neon gas, methane gas, ethylene gas, acetylene gas or nitrogen gas.

In the first forming method or the second forming method of a carbon-nanotube structure, the electron-emitting portion may be formed in that portion of the cathode electrode which portion is positioned in the bottom portion of the opening portion, or the electron-emitting portion may be also formed so as to extend from that portion of the cathode electrode which portion is positioned in the bottom portion of the opening portion to the surface of that portion of the cathode electrode which portion is different from the portion of the cathode electrode in the bottom portion of the opening portion. Further, the electron-emitting portion may be formed on the entire surface or part of the surface of that portion of the cathode electrode which portion is positioned in the bottom portion of the opening portion.

In the field emission device having the first or second structure, depending upon the structure of field emission device, one electron-emitting portion may exist in one opening portion formed in the gate electrode and the insulating layer, or a plurality of electron-emitting portions may exist in one opening portion formed in the gate electrode and the insulating layer, or one electron-emitting portion or a plurality of electron-emitting portions may exist in a plurality of first opening portions formed in the gate electrode and one second opening portion which is formed in the insulating layer and communicates with such first opening portions.

The plan form of the opening portion formed in the gate electrode and the insulating layer (form obtained by cutting the opening portion with an imaginary plane in parallel with the surface of the supporting member) may be any form such as a circle, an oval, a rectangle, a polygon, a rounded rectangle or a rounded polygon. The opening portion formed in the gate electrode can be formed, for example, by isotropic etching, anisotropic etching or by a combination of anisotropic etching and isotropic etching. Otherwise, the opening portion in the gate electrode can be formed directly according to the forming method of the gate electrode. The opening portion in the insulating layer can be also formed, for example, by isotropic etching, anisotropic etching or by a combination of anisotropic etching and isotropic etching. The opening portion provided in the focus electrode is formed in each cold cathode field emission device or in each electron-emitting region (each overlap region).

In the field emission device having the first structure, the resistance layer may be formed between the cathode electrode and the electron-emitting portion. Otherwise, when the surface of the cathode electrode corresponds to the electron-emitting portion (that is, in the field emission device having the second structure), the cathode electrode may have a three-layered structure constituted of an electrically conductive material layer, a resistance layer and an electron-emitting layer corresponding to the electron-emitting portion. The resistance layer can stabilize performances of the field emission device and can attain uniform electron emitting properties. The material for constituting a resistance layer includes carbon-containing materials such as silicon carbide (SiC) and SiCN; SiN; semiconductor materials such as amorphous silicon and the like; and refractory metal oxides such as ruthenium oxide ($RuO_2$), tantalum oxide and tantalum nitride. The resistance layer can be formed by a sputtering method, a CVD method or a screen-printing method. The resistance value of the resistance layer is approximately $1\times10^5$ to $1\times10^7$ Ω, preferably several MΩ.

[Spindt-type Field Emission Device]

As explained in above, basically, the Spindt-type field emission device comprises:

(a) a stripe-shaped cathode electrode 11 being formed on a supporting member 10 and extending in a first direction, (b) an insulating layer 12 formed on the supporting member 10 and the cathode electrode 11, (c) a stripe-shaped gate electrode 13 being formed on the insulating layer 12 and extending in a second direction different from the first direction, (d) an insulating film 14 formed on the gate electrode 13 and the insulating layer 12, (e) a focus electrode 15 formed on the insulating layer 14, (f) an opening portion 16 formed through the focus electrode 15 and the insulating film 14 and the gate electrode 13 and the insulating layer 12 (an opening portion 16A formed through the focus electrode 15 and the insulating film 14, an opening portion 16B formed through the gate electrode 13, and an opening portion 16C formed through the insulating layer 12), and (g) an electron-emitting portion 17 formed on a cathode electrode 11 positioned in the bottom portion of the opening portion 16, and has a structure in which electrons are emitted from the conical electron-emitting portion 17 exposed in the bottom portion of the opening portion 16.

The method of manufacturing the Spindt-type field emission device will be explained below with reference to FIGS. 17A, 17B, 18A and 18B which are schematic partial end views of the supporting member 10, etc., constituting a cathode panel.

The above Spindt-type field emission device can be obtained basically by a method in which the conical electron-emitting portion 17 is formed by vertical vapor deposition of a metal material. That is, while deposition particles perpendicularly enter the opening portion 16A formed through the focus electrode 15, the amount of deposition particles reaching the bottom portion of the opening portion 16 is gradually decreased by utilizing a masking effect produced by an overhanging deposit formed around the edge of opening of the opening portion 16A, and the electron-emitting portion 17, which is a conical deposit, is formed in a self-alignment manner. There will be explained below a method in which a peeling-off layer 19A is formed on the focus electrode 15 beforehand for making it easy to remove an unnecessary overhanging deposit. In the drawings for explaining the method of manufacturing a field emission device, one electron-emitting portion alone is shown.

[Step-A0]

A conductive material layer composed, for example, of polysilicon for a cathode electrode is formed on a supporting member 10 made, for example, of a glass substrate by a plasma-enhanced CVD method. Then, the conductive material layer for a cathode electrode is patterned by a lithograph method and a dry etching method, to form the cathode electrode 11 having a stripe form. Thereafter, the insulating layer 12 composed of $SiO_2$ is formed on the entire surface by a CVD method.

[Step-A1]

Then, the conductive material layer (for example, TiN layer) for a gate electrode is formed on the insulating layer 12 by a sputtering method. Then, the conductive material layer for a gate electrode is patterned by a lithograph method and a dry etching method, to form the stripe-shaped gate electrode 13. The cathode electrode 11 in the form of a stripe extends in a direction rightward and leftward to the paper surface of the drawing and the gate electrode 13 in the form of a stripe extends in a direction perpendicular to the paper surface of the drawing.

The gate electrode 13 can be formed by a known thin film forming method such as a PVD method including a vapor deposition method and the like, a CVD method, a plating method including an electroplating method and an electroless plating method, a screen printing method, a laser abrasion method, a sol-gel method, a lift-off method and the like, or a combination of one of them with an etching method as required. For example, a stripe-shaped gate electrode can be directly formed when a screen-printing method or a plating method is employed.

[Step-A2]

Then, an insulating film 14 is formed on the entire surface, and, a focus electrode 15 is formed on the insulating film 14.

[Step-A3]

Then, a resist layer is formed again, and the opening portion 16A is formed through the focus electrode 15 and the insulating film 14 by etching, and further, an opening portion 16B is formed through the gate electrode 13, and an opening portion 16C is formed through the insulating layer. The cathode electrode 11 is exposed in the bottom portion of the opening portion 16C, and then, the resist layer is removed. In the above manner, a structure shown in FIG. 17A can be obtained.

[Step-A4]

Figure 17A:
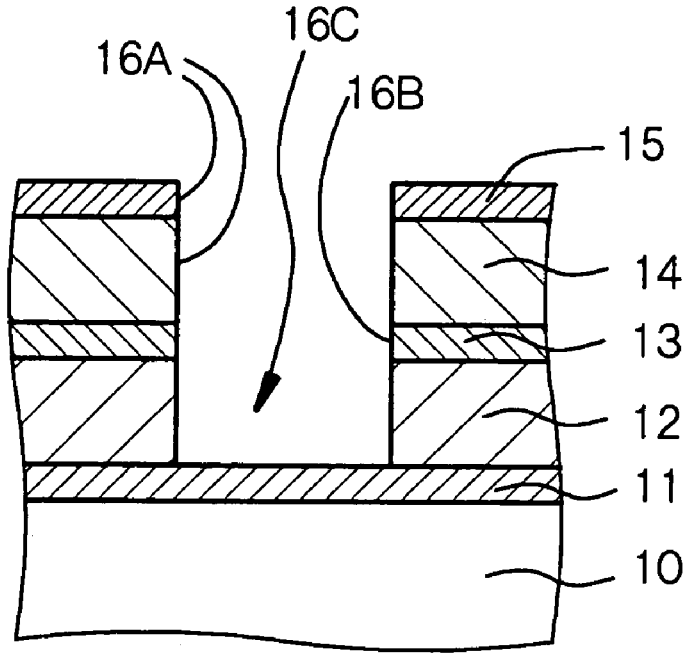
FIGS. 17A and 17B are schematic partial end views of a supporting member, etc., for explaining a method of manufacturing a Spindt-type cold cathode field emission device.
Figure 17B:
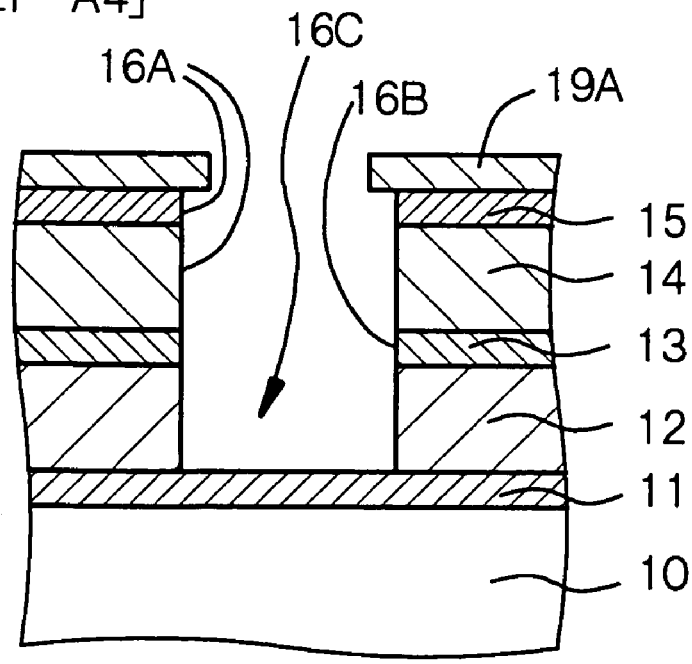

As shown in FIG. 17B, a peeling-off layer 19A is then formed on the focus electrode 15 by oblique vapor deposition of nickel (Ni) while the supporting member 10 is turned. In this case, the incidence angle of vaporized particles relative to the normal of the supporting member 10 is set at a sufficiently large angle (for example, an incidence angle of 65° to 85°), whereby the peeling-off layer 19A can be formed on the focus electrode 15 almost without depositing any nickel in the bottom portion of the opening portion 16C. The peeling-off layer 19A extends from the opening edge portion of the opening portion 16A like eaves, whereby the diameter of the opening portion 16A is substantially decreased.

[Step-A5]

Figure 18A:
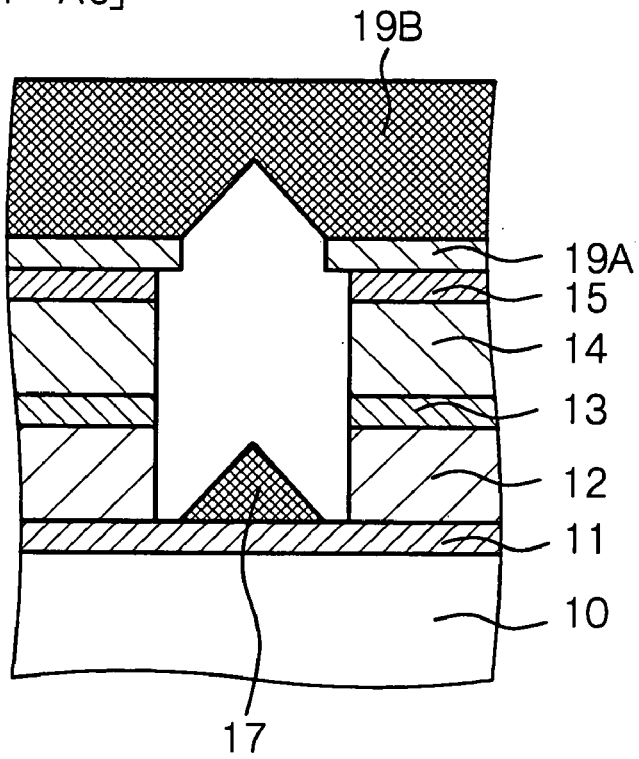
FIGS. 18A and 18B, following

Then, an electrically conductive material such as molybdenum (Mo) is deposited on the entire surface by vertical vapor deposition (incidence angle 3° to 10°). During the above vapor deposition, as shown in FIG. 18A, as the conductive material layer 19B having an overhanging form grows on the peeling-off layer 19A, the substantial diameter of the opening portion 16A is gradually decreased, and the vaporized particles which contribute to the deposition in the bottom portion of the opening portion 16C gradually come to be limited to particles which pass the central region of the opening portion 16C. As a result, a circular-cone-shaped deposit is formed on the bottom portion of the opening portion 16C, and the circular-cone-shaped deposit constitutes the electron-emitting portion 17.

[Step-A6]

Figure 18B:
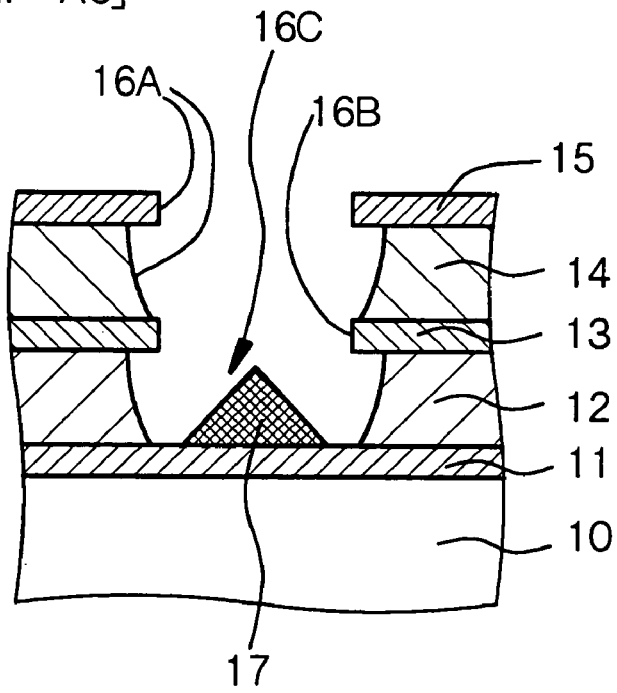

Then, the peeling-off layer 19A is peeled off from the surfaces of the focus electrode 15 by a lift-off method, and the conductive material layer 19B above the focus electrode 15 are selectively removed. Then, the side wall surface of the opening portion 16C formed through the insulating layer 12 are allowed to recede by isotropic etching, which is preferred from the viewpoint of exposing the opening end portion of the gate electrode 13. The isotropic etching can be carried out by dry etching using radicals as main etching species like chemical dry etching, or by wet etching using an etching solution. As an etching solution, for example, a mixture containing a 49% hydrofluoric acid aqueous solution and pure water in a hydrofluoric acid aqueous solution: pure water volume ratio of 1:100 can be used. Whereby, a field emission device shown in FIG. 18B is completed.

[Plane-type Field Emission Device (No. 1)]

The plane-type field emission device comprises:

(a) cathode electrode 11 being formed on a supporting member 10 and extending in first direction, (b) an insulating layer 12 formed on the supporting member 10 and the cathode electrode 11, (c) a gate electrode 13 being formed on the insulating layer 12 and extending in a second direction different from the first direction, (d) an insulating film 14 formed on the gate electrode 13 and the insulating layer 12, (e) a focus electrode 15 formed on the insulating film 14, (f) an opening portion 16 formed through the focus electrode 15 and the insulating film 14 and the gate electrode 13 and the insulating layer 12 (an opening portion 16A formed through the focus electrode 15 and the insulating film 14, an opening portion 16B formed through the gate electrode 13, and an opening portion 16C formed through the insulating layer 12), and (g) an electron-emitting portion 17A formed on a cathode electrode 11 positioned in the bottom portion of the opening portion 16, and has a structure in which electrons are emitted from the electron-emitting portion 17A exposed in the bottom portion of the opening portion 16.

An electron-emitting portion 17A comprises a matrix 20 and a carbon-nanotube structure (specifically, a carbon-nanotube 21) embedded in the matrix 20 in a state where the toportion of the carbon-nanotube structure is projected, and the matrix 20 is made of an electrically conductive metal oxide (specifically, indium-tin oxide, ITO).

The production method of the field emission device will be explained with reference to FIGS. 19A, 19B, 20A and 20B, hereinafter.

[Step-B0]

First, a stripe-shaped cathode electrode 11 made of an approximately 0.2 μm thick chromium (Cr) layer is formed on a supporting member 10 made, for example, of a glass substrate, for example, by a sputtering method and an etching technique.

[Step-B1]

Then, a metal compound solution consisting of an organic acid metal compound solution in which the carbon-nanotube structure is dispersed is applied onto the cathode electrode 11, for example, by a spray method. Specifically, a metal compound solution shown in Table 4 is used. In the metal compound solution, the organic tin compound and the organic indium compound are in a state where they are dissolved in an acid (for example, hydrochloric acid, nitric acid or sulfuric acid). The carbon-nanotube is produced by an arc discharge method and has an average diameter of 30 nm and an average length of 1 μm. In the application, the supporting member 10 is heated to 70-150° C. Atmospheric atmosphere is employed as an application atmosphere. After the application, the supporting member 10 is heated for 5 to 30 minutes to fully evaporate butyl acetate off. When the supporting member 10 is heated during the application as described above, the applied solution begins to dry before the carbon-nanotube is self-leveled toward the horizontal direction of the surface of the cathode electrode 11. As a result, the carbon-nanotube can be arranged on the surface of the cathode electrode 11 in a state where the carbon-nanotube is not in a level position. That is, the carbon-nanotube can be aligned in the direction in which the toportion of the carbon-nanotube faces the anode electrode, in other words, the carbon-nanotube comes close to the normal direction of the supporting member 10. The metal compound solution having a composition shown in Table 4 may be prepared beforehand, or a metal compound solution containing no carbon-nanotube may be prepared beforehand and the carbon-nanotube and the metal compound solution may be mixed before the application. For improving dispersibility of the carbon-nanotube, ultrasonic wave may be applied when the metal compound solution is prepared.

TABLE 4

| | |
|---|---|
| Organic tin compound and organic indium compound | 0.1-10 parts by weight |
| Dispersing agent (sodium dodecylsulfate) | 0.1-5 parts by weight |
| Carbon-nanotube | 0.1-20 parts by weight |
| Butyl acetate | Balance |

When a solution of an organic tin compound dissolved in an acid is used as an organic acid metal compound solution, tin oxide is obtained as a matrix. When a solution of an organic indium compound dissolved in an acid is used, indium oxide is obtained as a matrix. When a solution of an organic zinc compound dissolved in an acid is used, zinc oxide is obtained as a matrix. When a solution of an organic antimony compound dissolved in an acid is used, antimony oxide is obtained as a matrix. When a solution of an organic antimony compound and an organic tin compound dissolved in an acid is used, antimony-tin oxide is obtained as a matrix. Further, when an organic tin compound is used as an organic metal compound solution, tin oxide is obtained as a matrix. When an organic indium compound is used, indium oxide is obtained as a matrix. When an organic zinc compound is used, zinc oxide is obtained as a matrix. When an organic antimony compound is used, antimony oxide is obtained as a matrix. When an organic antimony compound and an organic tin compound are used, antimony-tin oxide is obtained as a matrix. Alternatively, a solution of metal chloride (for example, tin chloride or indium chloride) may be used.

After the metal compound solution is dried, salient convexo-concave shapes may be formed in the surface of the metal compound layer in some cases. In such cases, it is desirable to apply the metal compound solution again on the metal compound layer without heating the supporting member 10.

[Step-B2]

Then, the metal compound composed of the organic acid metal compound is fired, to give an electron-emitting portion 17A having the carbon-nanotubes 21 fixed onto the surface of the cathode electrode 11 with the matrix 20 (which is specifically a metal oxide, and more specifically, ITO) containing metal atoms (specifically, In and Sn) derived from the organic acid metal compound. The firing is carried out in an atmospheric atmosphere at 350° C. for 20 minutes. The thus-obtained matrix 20 had a volume resistivity of $5\times10^{-7}$ Ω·m. When the organic acid metal compound is used as a starting material, the matrix 20 made of ITO can be formed at a low firing temperature of as low as 350 (C. The organic acid metal compound solution may be replaced with an organic metal compound solution. When a solution of metal chloride (for example, tin chloride and indium chloride) is used, the matrix 20 made of ITO is formed while the tin chloride and indium chloride are oxidized by the firing.

[Step-B3]

Then, a resist layer is formed on the entire surface, and the circular resist layer having a diameter, for example, of 10 μm is retained above a desired region of the cathode electrode 11. The matrix 20 is etched with hydrochloric acid having a temperature of 10 to 60° C. for 1 to 30 minutes, to remove an unnecessary portion of the electron-emitting portion. Further, when the carbon-nanotubes still remain in a region different from the desired region, the carbon-nanotubes are etched by an oxygen plasma etching treatment under a condition shown in Table 5. A bias power may be 0 W, i.e., direct current, while it is desirable to apply the bias power. The supporting member may be heated, for example, to approximately 80° C.

TABLE 5

| | |
|---|---|
| Apparatus to be used | RIE apparatus |
| Gas to be introduced | Gas containing oxygen |
| Plasma exciting power | 500 W |
| Bias power | 0-150 W |
| Treatment time period | at least 10 seconds |

Alternatively, the carbon-nanotubes can be etched by a wet etching treatment under a condition shown in Table 6.

TABLE 6

| | |
|---|---|
| Solution to be used | $KMnO_4$ |
| Temperature | 20-120° C. |
| Treatment time period | 10 seconds-20 minutes |

Figure 19A:
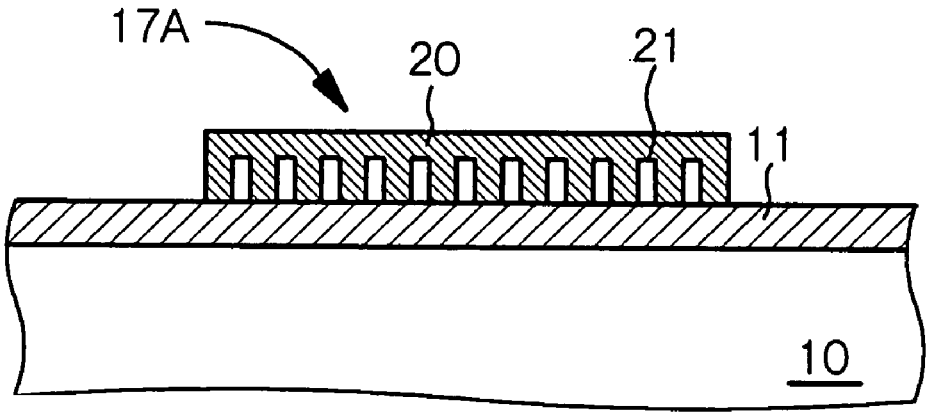
FIGS. 19A and 19B are schematic partial cross-sectional views of a supporting member, etc., for explaining a method of manufacturing a plane-type cold cathode field emission device (No. 1).
Figure 19B:
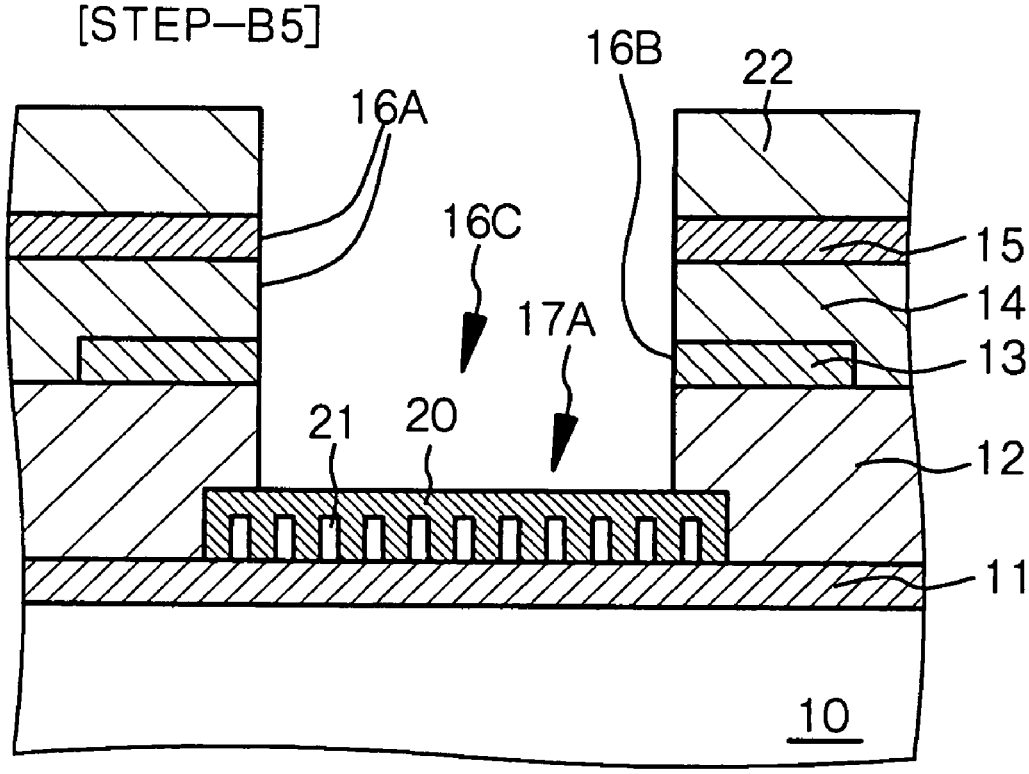

Then, the resist layer is removed, whereby a structure shown in FIG. 19A can be obtained. It is not necessarily required to retain a circular electron-emitting portion 17A having a diameter of 10 μm. For example, the electron-emitting portion 17A may be retained on the cathode electrode 11.

The process may be carried out in the order of [Step-B1], [Step-B3] and [Step-B2].

[Step-B4]

An insulating layer 12 is formed on the electron-emitting portion 17A, the supporting member 10 and the cathode electrode 11. Specifically, an approximately 1 μm thick insulating layer 12 is formed on the entire surface by a CVD method using, for example, tetraethoxysilane (TEOS) as a source gas.

[Step-B5]

Then, a stripe-shaped gate electrode 13 is formed on the insulating layer 12. Further, an insulating film 14 is formed on the insulating layer 12 and the gate electrode 13, and, a focus electrode 15 is formed on the insulating film 14. Then, a mask layer 22 is formed on the focus electrode 15, then, an opening portion 16A is formed through the focus electrode 15 and the insulating film 14, further, an opening portion 16B is formed through the gate electrode 13, and, an opening portion 16C communicating with the opening portion 16B formed through the gate electrode 13 is formed through the insulating layer 12 (see FIG. 19B). When the matrix 20 is made of a metal oxide, for example, ITO, the insulating layer 12 can be etched without etching the matrix 20. That is, the etching selective ratio between the insulating layer 12 and the matrix 18 is approximately infinite. The carbon-nanotubes 19 are therefore not damaged when the insulating layer 12 is etched.

[Step-B6]

Then, preferably, part of the matrix 20 is removed under a condition shown in Table 7, to obtain the carbon-nanotubes 21 in a state where top portions thereof are projected from the matrix 20. In this manner, the electron-emitting portion 17A having a structure shown in FIG. 20A can be obtained.

TABLE 7

| | |
|---|---|
| Etching solution | Hydrochloric acid |
| Etching time period | 10 seconds-30 seconds |
| Etching temperature | 10-60° C. |

Some or all of the carbon-nanotubes 21 may change in their surface state due to the etching of the matrix 20 (for example, oxygen atoms or oxygen molecules or fluorine atoms are adsorbed to their surfaces), and the carbon-nanotubes 21 are deactivated with respect of electric field emission in some cases. Therefore, it is preferred to subject the electron-emitting portion 17A to a plasma treatment in a hydrogen gas atmosphere. By the plasma treatment, the electron-emitting portion 17A is activated, and the efficiency of emission of electrons from the electron-emitting portion 17A is further improved. Table 8 shows an example of a plasma treatment condition.

TABLE 8

| | |
|---|---|
| Gas to be used | $H_2$ = 100 sccm |
| Source power | 1000 W |
| Power to be applied to supporting member | 50 V |
| Reaction pressure | 0.1 Pa |
| Supporting member temperature | 300° C. |

Then, for releasing gas from the carbon-nanotubes 21, a heating treatment or various plasma treatments may be carried out. For allowing a substance to be adsorbed to the surfaces of the carbon-nanotubes 21, the carbon-nanotubes 21 may be exposed to a gas containing the substance whose adsorption is desirable. For purifying the carbon-nanotubes 21, an oxygen plasma treatment or a fluorine plasma treatment may be carried out.

[Step-B7]

Figure 20A:
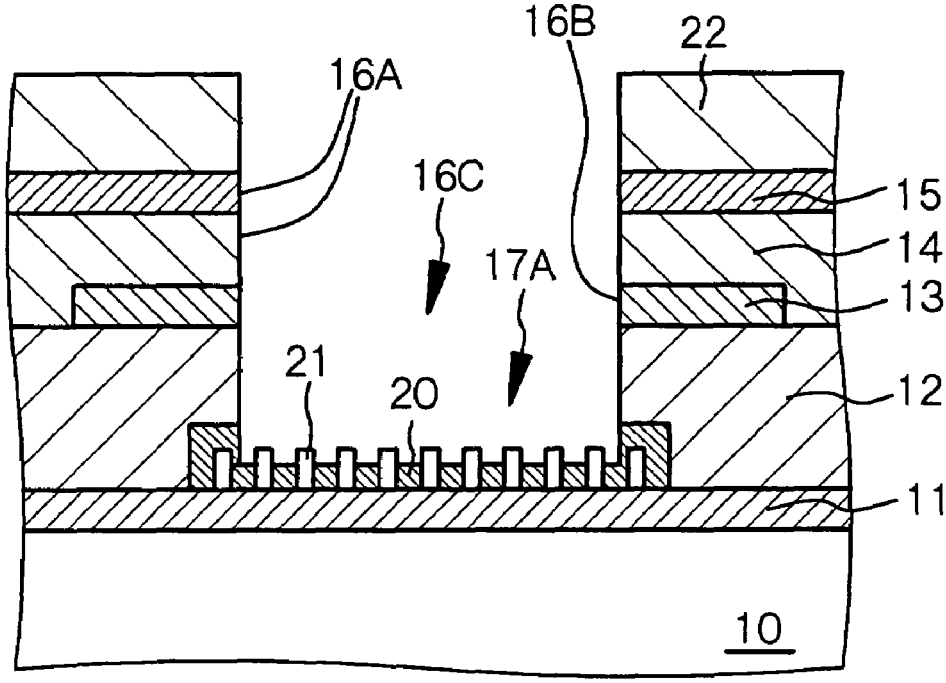
FIGS. 20A and 20B, following
Figure 20B:
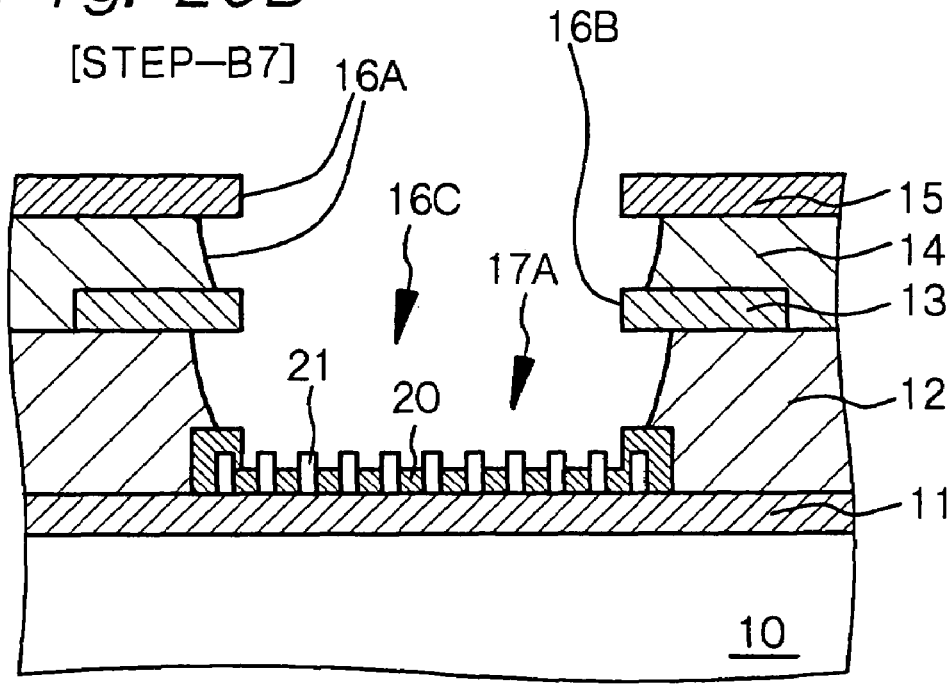

Then, the side wall surface of the opening portion 16C formed through the insulating layer 12 are allowed to recede by isotropic etching, which is preferred from the viewpoint of exposing the opening end portion of the gate electrode 13. Then, the mask layer 22 is removed, whereby a field emission device shown in FIG. 20B is completed.

The above process can be carried out in the order of [Step-B5], [Step-B7] and [Step-B6].

[Plane-type Field Emission Device (No. 2)]

Figure 21A:
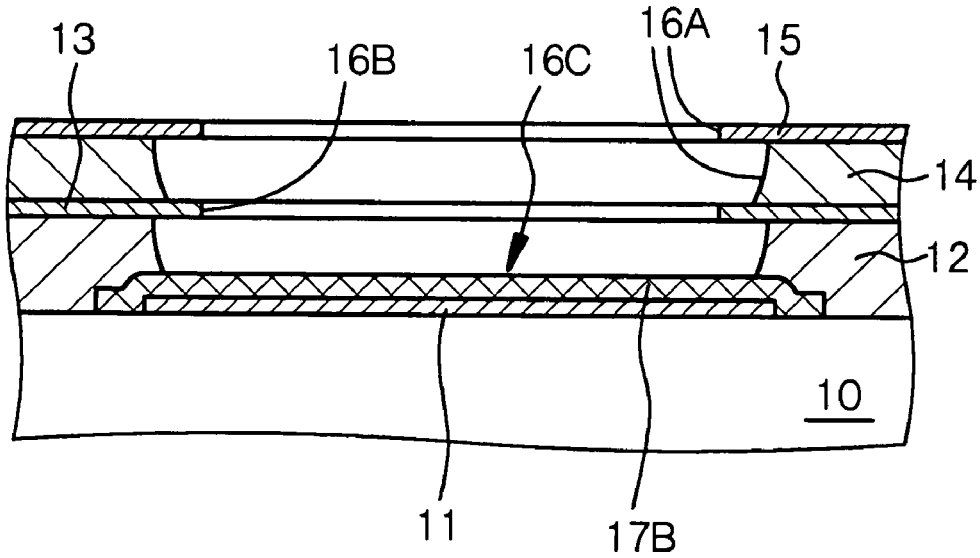
FIGS. 21A and 21B are a schematic partial cross-sectional view of a plane-type cold cathode field emission device (No. 2) and a schematic partial cross-sectional view of a flat-type cold cathode field emission device, respectively.

FIG. 21A shows a schematic partial cross-sectional view of a plane-type field emission device. The plane-type field emission device comprises a cathode electrode 11 formed on a supporting member 10 made, for example, of glass, an insulating layer 12 formed on the supporting member 10 and the cathode electrode 11, a gate electrode 13 formed on the insulating layer 12, an insulating film 14 formed on the gate electrode 13 and the insulating layer 12, a focus electrode 15 formed on the insulating film 14, an opening portion 16 formed through the focus electrode 15, the insulating film 14, the gate electrode 13 and the insulating layer 12 (an opening portion 16A formed through the focus electrode 15 and the insulating film 14, an opening portion 16B formed through the gate electrode 13, and an opening portion 16C formed through the insulating layer 12), and a flat electron-emitting portion (electron-emitting layer 17B) formed on that portion of the cathode electrode 11 which is positioned in the bottom portion of the opening portion 16. The electron-emitting layer 17B is formed on the stripe-shaped cathode electrode 11 extending in the direction perpendicular to the paper surface of the drawing. Further, the gate electrode 13 is extending leftward and rightward on the paper surface of the drawing. The cathode electrode 11 and the gate electrode 13 are made of chromium. Specifically, the electron-emitting layer 17B is constituted of a thin layer made of a graphite powder. In the plane-type field emission device shown in FIG. 21A, the electron-emitting layer 17B is formed on the entire region of the surface of the cathode electrode 11, while the plane-type field emission device shall not be limited to such a structure, and the point is that the electron-emitting layer 17B is formed at least in the bottom portion of the opening portion 16.

[Flat-type Field Emission Device]

Figure 21B:
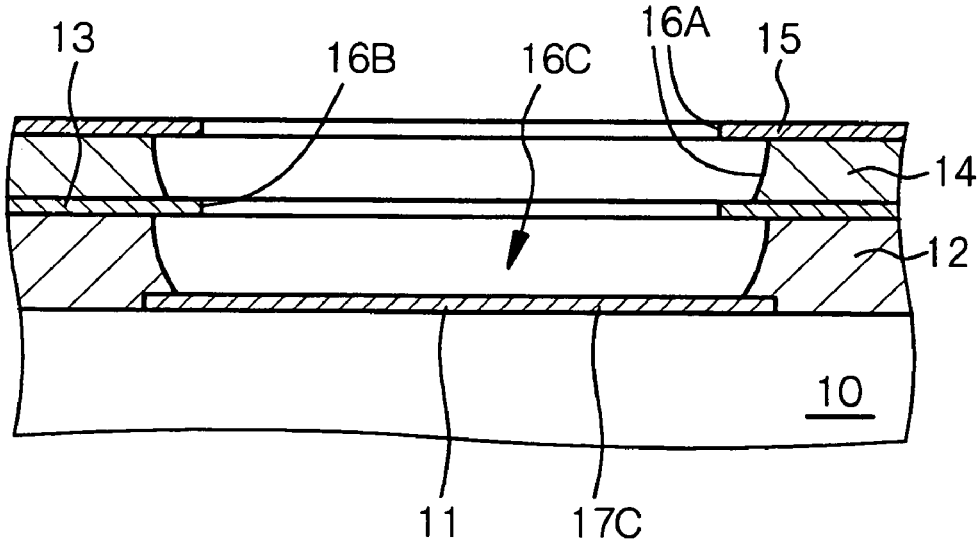

FIG. 21B shows a schematic partial cross-sectional view of a flat-type field emission device. The flat-type field emission device comprises a stripe-shaped cathode electrode 11 formed on a supporting member 10 made, for example, of glass, an insulating layer 12 formed on the supporting member 10 and the cathode electrode 11, a stripe-shaped gate electrode 13 formed on the insulating layer 12, an insulating film 14 formed on the gate electrode 13 and the insulating layer 12, a focus electrode 15 formed on the insulating film 14, and an opening portion 16 formed through the focus electrode 15, the insulating film 14, the gate electrode 13 and the insulating layer 12 (an opening portion 16A formed through the focus electrode 15 and the insulating film 14, an opening portion 16B formed through the gate electrode 13, and an opening portion 16C formed through the insulating layer 12). The cathode electrode 11 is exposed in the bottom portion of the opening portion 16. The cathode electrode 11 is extending in the direction perpendicular to the paper surface of the drawing, and the gate electrode 13 is extending in leftward and rightward on the paper surface of the drawing. The cathode electrode 11 and the gate electrode 13 are made of chromium (Cr), and the insulating layer 12 is made of $SiO_2$. That portion of the above cathode electrode 11 which is exposed in the bottom portion of the opening portion 16 corresponds to an electron-emitting portion 17C.

[Method of Manufacturing an Anode Panel and a Display]

The method of manufacturing an anode panel AP will be explained below with reference to FIGS. 22A to 22F which are schematic partial cross-sectional views of a substrate, etc.

[Step-100]

Figure 22A:
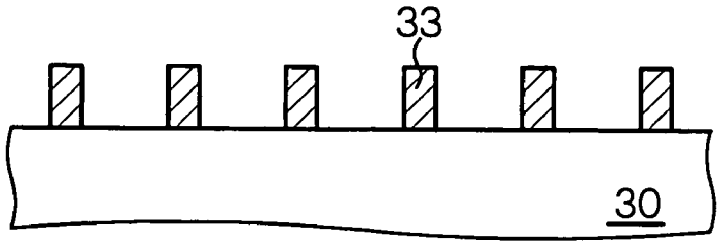
FIGS. 22A to 22F are schematic partial cross-sectional views of a substrate, etc., for explaining a method of manufacturing an anode panel.
Figure 22B:
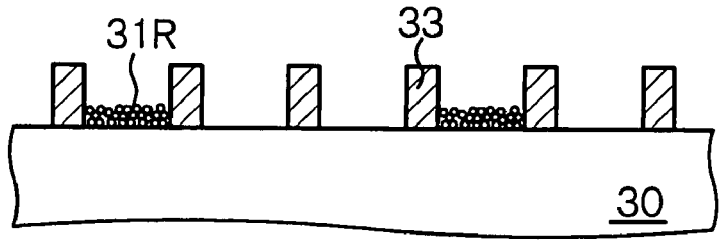
Figure 22C:
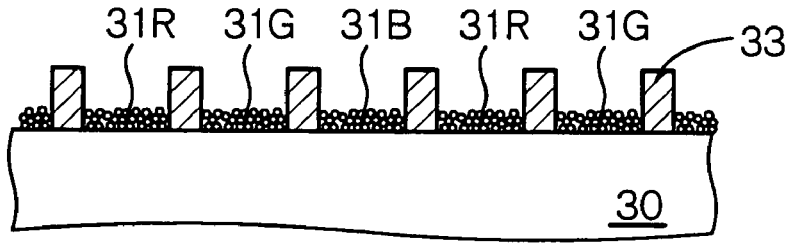

First, a separation wall 33 is formed on a substrate 30 made of a glass substrate (see FIG. 22A). The plan form of the separation wall 33 is the form of a lattice (grid). Specifically, a lead glass layer colored in black with a metal oxide such as cobalt oxide or the like is formed so as to have a thickness of approximately 50 μm, and then the lead glass layer is selectively processed by photolithography and an etching technique, whereby the separation wall 33 (see, for example, FIG. 3) having the form of a lattice (grid) can be obtained. There may be optionally employed a constitution in which a glass paste having a low melting point is printed on the substrate 30 by a screen printing method, and then the glass paste having a low melting point is fired to form the separation wall, or a constitution in which a photosensitive polyimide resin layer is formed on the entire surface of the substrate 30, and then the photosensitive polyimide resin layer is exposed to light and developed to form the separation wall. The separation wall 33 in one pixel had length×width×height dimensions of 200 μm×100 μm×50 μm. Part of the separation wall works as a spacer holder for holding a spacer 34. Before the formation of the separation wall 33, preferably, a black matrix (not shown in FIG. 22) is formed on the surface of that portion of the substrate 30 which is a portion where the separation wall 33 is to be formed, for improving displayed images in contrast.

[Step-110]

Then, for forming a phosphor layer 31R that emits light in red, for example, a red-light-emitting phosphor slurry prepared by dispersing a red-light-emitting phosphor particles in a polyvinyl alcohol (PVA) resin and water and further adding ammonium bichromate is applied to the entire surface, and the applied red-light-emitting phosphor slurry is dried. Then, that portion of the red-light-emitting phosphor slurry which is a portion where the red-light-emitting phosphor layer 31R is to be formed is irradiated to ultraviolet ray through the substrate 30 to expose the red-light-emitting phosphor slurry. The red-light-emitting phosphor slurry is gradually cured from the substrate 30 side. The thickness of the red-light-emitting phosphor layer 31R is determined depending upon the dosage of ultraviolet ray to the red-light-emitting phosphor slurry. In this case, the red-light-emitting phosphor layer 31R had a thickness of approximately 8 μm, which was attained by adjusting the time period of irradiation of the red-light-emitting phosphor slurry with the ultraviolet ray. Then, the red-light-emitting phosphor slurry is developed, whereby the red-light-emitting phosphor layer 31R can be formed between predetermined separation walls 33 (see FIG. 22B). Thereafter, a green-light-emitting phosphor slurry is treated in the same manner as above, to form a green-light-emitting phosphor layer 31G, and a blue-light-emitting phosphor slurry is treated in the same manner as above, to form a blue-light-emitting phosphor layer 31B (see FIG. 22C). The surface of the phosphor layer 31 microscopically has a convexoconcave shape formed by a plurality of the phosphor particles. The method of forming the phosphor layer is not limited to the above-explained method. A red-light-emitting phosphor slurry, a green-light-emitting phosphor slurry and a blue-light-emitting phosphor slurry may be consecutively applied, followed by consecutive exposures and developments of the phosphor slurries to form each phosphor layer, or each phosphor layer may be formed by a screen printing method or the like.

[Step-120]

Then, the substrate 30 having the separation walls 33 and the phosphor layers 31 is immersed in a liquid (specifically, water) filled in a treatment vessel while the phosphor layer 31 is allowed to face the liquid surface side. A drain portion of the treatment vessel is closed in advance. And, an intermediate film 60 having a substantially flat surface is formed on the liquid surface. Specifically, an organic solvent in which a resin (lacquer) for constituting the intermediate film 60 is dissolved is dropped on the liquid surface. That is, an intermediate film material for forming the intermediate film 60 is spread on the liquid surface. The resin (lacquer) for constituting the intermediate film 60 is a kind of varnish in a broad sense, and it includes a solution of a cellulose derivative, generally, a formulation containing nitrocellulose as a main component in a volatilizable solvent such as a lower fatty acid ester, a urethane lacquer containing other synthetic polymer and an acrylic lacquer. Then, in a state where the intermediate film material is floated on the liquid surface, the intermediate film material is dried, for example, for 2 minutes, whereby a film is made of the intermediate film material, and the intermediate film 60 having a flat surface is formed on the liquid surface. When the intermediate film 60 is formed, the amount of the intermediate film material to be spread is adjusted so that it has a thickness, for example, of about 30 nm.

Figure 22D:
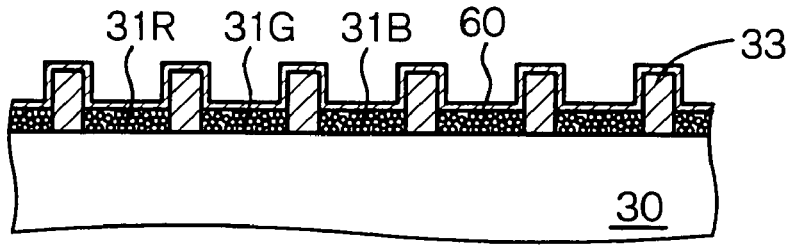
Figure 22E:
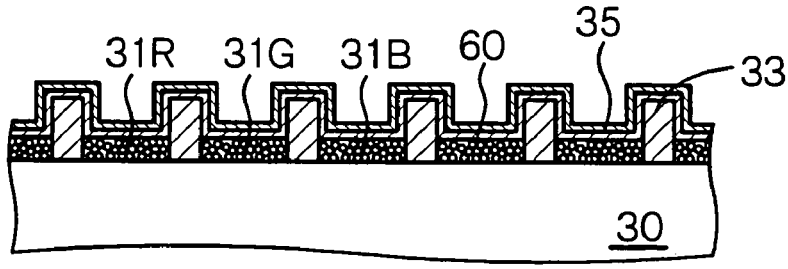
Figure 22F:
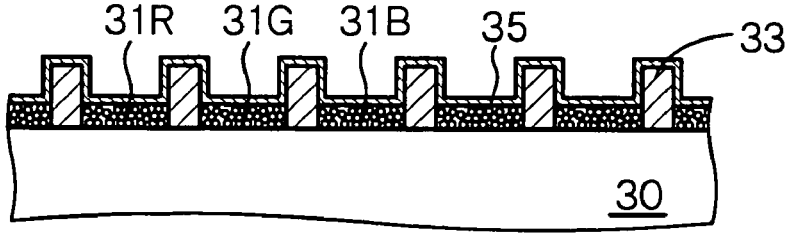

Then, the drain portion of the treatment vessel is opened, and the liquid is drained from the treatment vessel to lower the liquid surface, whereby the intermediate film 60 formed on the liquid surface moves toward the separation wall 33, comes in contact with the separation wall 33 and finally comes into a state where the intermediate film 60 is in contact with the phosphor layers 31, and the intermediate film 60 is left on the phosphor layers 31 (see FIG. 22D).

[Step-130]

Then, the intermediate film 60 is dried. That is, the substrate 30 is taken out of the treatment vessel, introduced into a drying furnace and dried in an environment having a predetermined temperature. The temperature for drying the intermediate film 60 is preferably in the range, for example, of 30° C. to 60° C., and the time period for drying the intermediate film 60 is preferably in the range, for example, of several minutes to several tens minutes. The drying time period is naturally decreased or increased depending upon the drying temperature.

[Step-140]

Then, an anode electrode 35 is formed on the intermediate film 60. Specifically, the anode electrode 35 made of a conductive material such as aluminum (Al), chromium (Cr) or the like is formed so as to cover the intermediate film 60 by a vapor deposition method or a sputtering method (see FIG. 22E).

[Step-150]

Then, the intermediate film 60 is fired at about 400° C. (see FIG. 22F). The intermediate film 60 is combusted off by the above firing, and the anode electrode 35 remains on the phosphor layers 31 and the separation walls 33. Gas generated by the combustion of the intermediate film 60 is discharged to an outside through fine pores formed in that region of the anode electrode 35 which is bent along the form of the separation wall 33. Since the pores are very fine, they do not cause any serious influence on the structural strength of the anode electrode or on the property of image display.

[Step-160]

Then, a resistance layer 36, for example, made of ITO, is formed on the anode electrode 35 by a sputtering method. In this manner, the anode panel AP can be completed.

[Step-170]

The cathode panel CP having a plurality of field emission devices is prepared. Then, the display is assembled. Specifically, a spacer 34 is attached on a spacer holding portion formed in the effective region of the anode panel AP. Then, the anode panel AP and the cathode panel CP are arranged such that the phosphor layer 31 and the electron-emitting region face each other, and the anode panel AP and the cathode panel CP (more specifically, the substrate 30 and the supporting member 10) are bonded to each other in their circumferential portions through the frame 40 made of ceramic or glass having a height of approximately 1 mm. In the bonding, a frit glass is applied to bonding portions of the frame 40 and the anode panel AP and bonding portions of the frame 40 and the cathode panel CP. Then, the anode panel AP, the cathode panel CP and the frame 40 are attached. The frit glass (not shown) is pre-calcined or pre-sintered to be dried, and then fully calcined or sintered at approximately 450° C. for 10 to 30 minutes. Then, a space surrounded by the anode panel AP, the cathode panel CP, the frame 40 and the frit glass is vacuumed through a through-hole (not shown) and a tip tube (not shown), and when the space comes to have a pressure of approximately $10^{-4}$ Pa, the tip tube is sealed by thermal fusion. In the above manner, the space surrounded by the anode panel AP, the cathode panel CP and the frame 40 can be vacuumed. Otherwise, for example, the frame 40, the anode panel AP and the cathode panel CP may be bonded in a high-vacuum atmosphere. Otherwise, the anode panel AP and the cathode panel CP may be bonded with the adhesive layer alone without the frame depending upon the structure of the display. Then, wiring to external circuits is carried out to complete the display.

While the present invention has been explained on the basis of preferred Examples, the present invention shall not be limited thereto. The constitutions and structures explained with regard to the anode panel, the cathode panels, the displays and the field emission devices in Examples are given as examples and may be modified as required. The manufacturing method explained with regard to the anode panel, the cathode panels, the displays and the field emission devices are given as examples and may be modified as required. Further, the various materials used in the manufacture of the anode panel and the cathode panels are also given as examples and may be modified as required. With regard to the display, color displays are explained as examples, while the display may be a monochromatic display.

Figure 23:
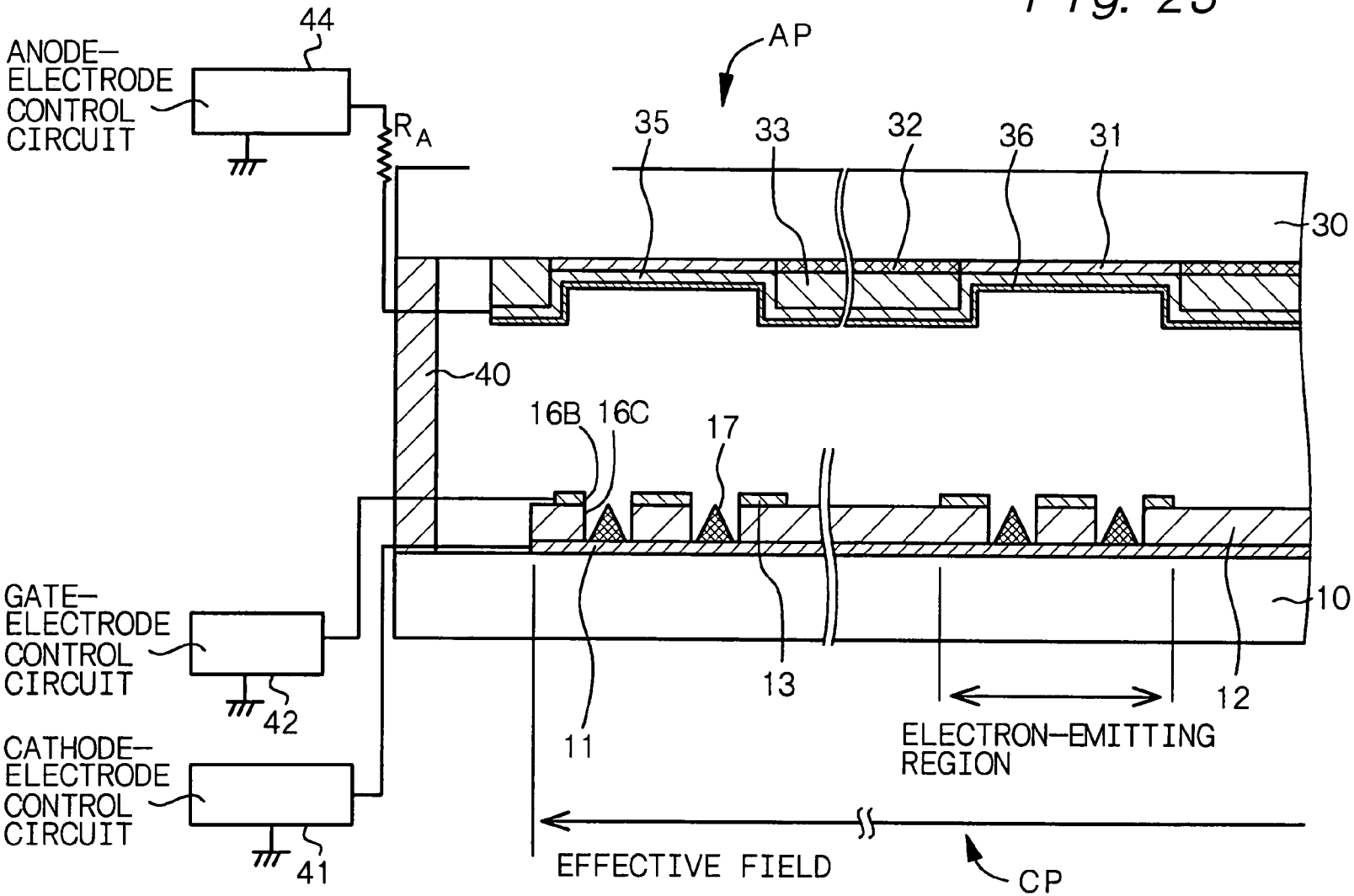
FIG. 23 is a schematic partial end view of a variant of the cold cathode field emission display.

In Example 1, the field emission device having the focus electrode has been explained, while the focus electrode may be omitted. FIG. 23 shows a schematic partial end view of a display having such a constitution.

Generally, the above field emission device comprises:

(a) a cathode electrode 11 being formed on a supporting member 10 and extending in a first direction, (b) an insulating layer 12 formed on the supporting member 10 and the cathode electrode 11, (c) a gate electrode 13 being formed on the insulating layer 12 and extending in a second direction different from the first direction, (d) an opening portion formed through the gate electrode 13 and the insulating layer 12 (an opening portion 16B formed through the gate electrode 13 and an opening portion 16C formed through the insulating layer 12), and (e) an electron-emitting portion 17 exposed in a bottom portion of the opening portion 16C.

While the field emission device shown in FIG. 23 is a Spindt-type field emission device, the field emission device shall not be limited thereto.

As explained in Example 2, the cold cathode field emission display of the present invention may be any one of:

(1) a combination of the cold cathode field emission display according to the first aspect of the present invention with the cold cathode field emission display according to the third aspect of the present invention, (2) a combination of the cold cathode field emission display according to the first aspect of the present invention with the cold cathode field emission display according to the fourth aspect of the present invention, (3) a combination of the cold cathode field emission display according to the second aspect of the present invention with the cold cathode field emission display according to the third aspect of the present invention, and (4) a combination of the cold cathode field emission display according to the second aspect of the present invention with the cold cathode field emission display according to the fourth aspect of the present invention.

In the field emission device, there have been mostly explained embodiments in which one electron-emitting portion corresponds to one opening portion, while there may be employed an embodiment in which a plurality of electron-emitting portions correspond to one opening portion or one electron-emitting portion corresponds to a plurality of opening portions, depending upon the structure of the field emission device. Alternatively, there may be also employed an embodiment in which a plurality of first opening portions are formed through a gate electrode, a plurality of second opening portions communicating with a plurality of the first opening portion are formed through an insulating layer, and one or a plurality of electron-emitting portions are formed.

Figure 24:
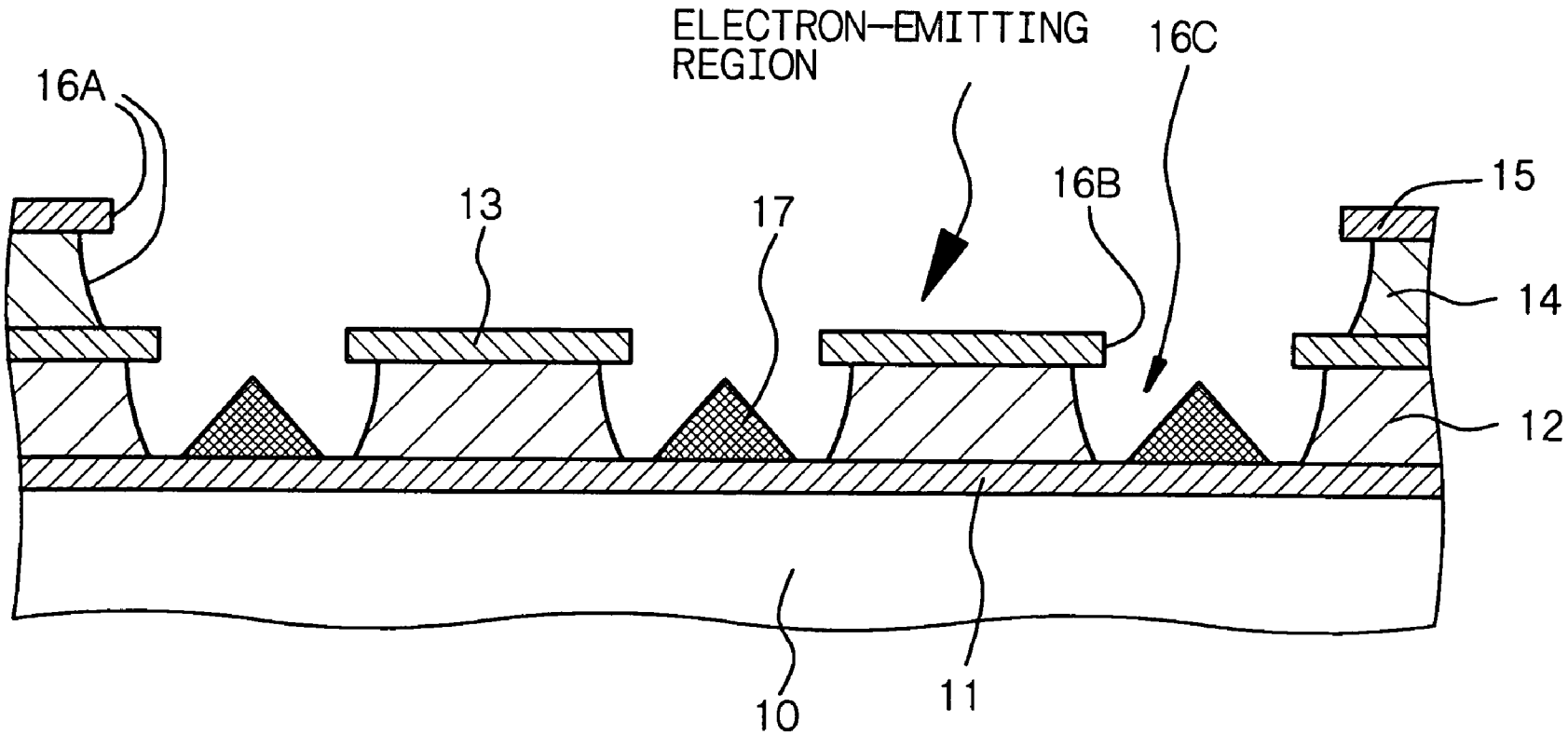
FIG. 24 is a schematic partial end view of another variant of the cold cathode field emission display.
Figure 25:
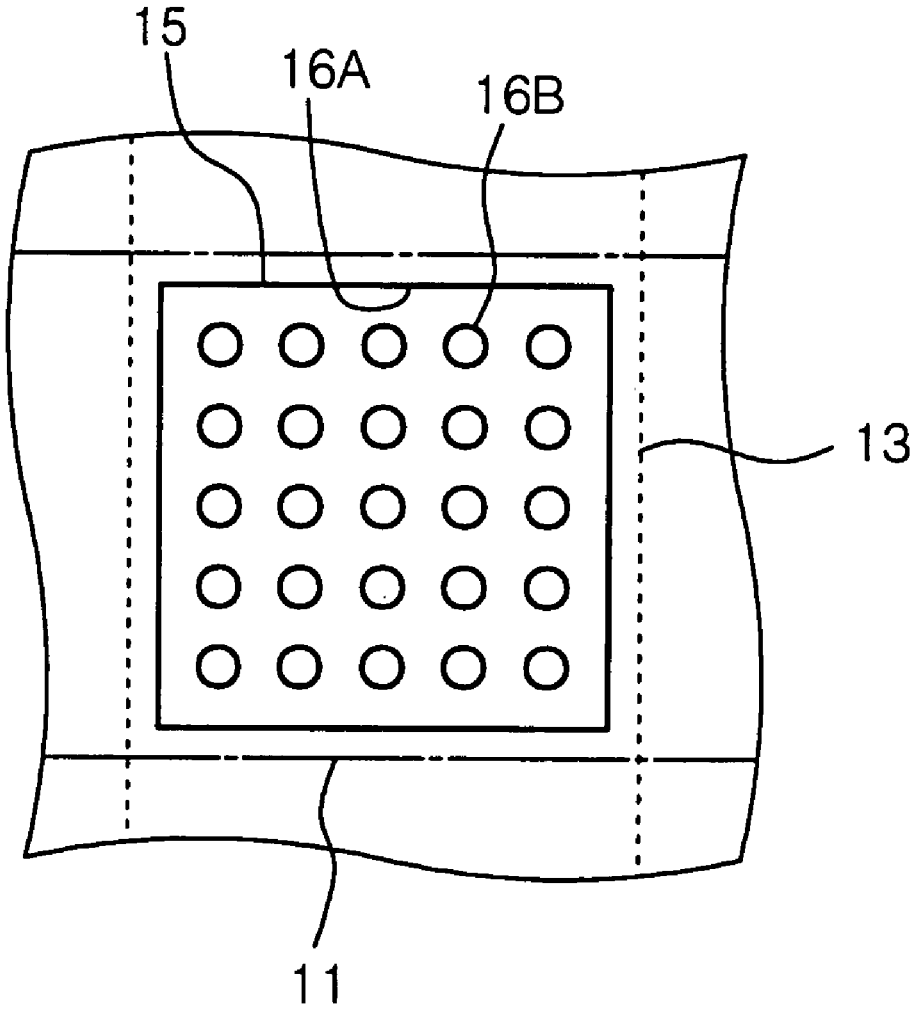
FIG. 25 is a schematic showing of a layout state of a focus electrode, an opening portion formed through the focus electrode and an opening portion formed through the gate electrode in another variant of the cold cathode field emission display shown in FIG. 24, FIG. 25 being drawn by viewing the electron-emitting region from above.
Figure 26:
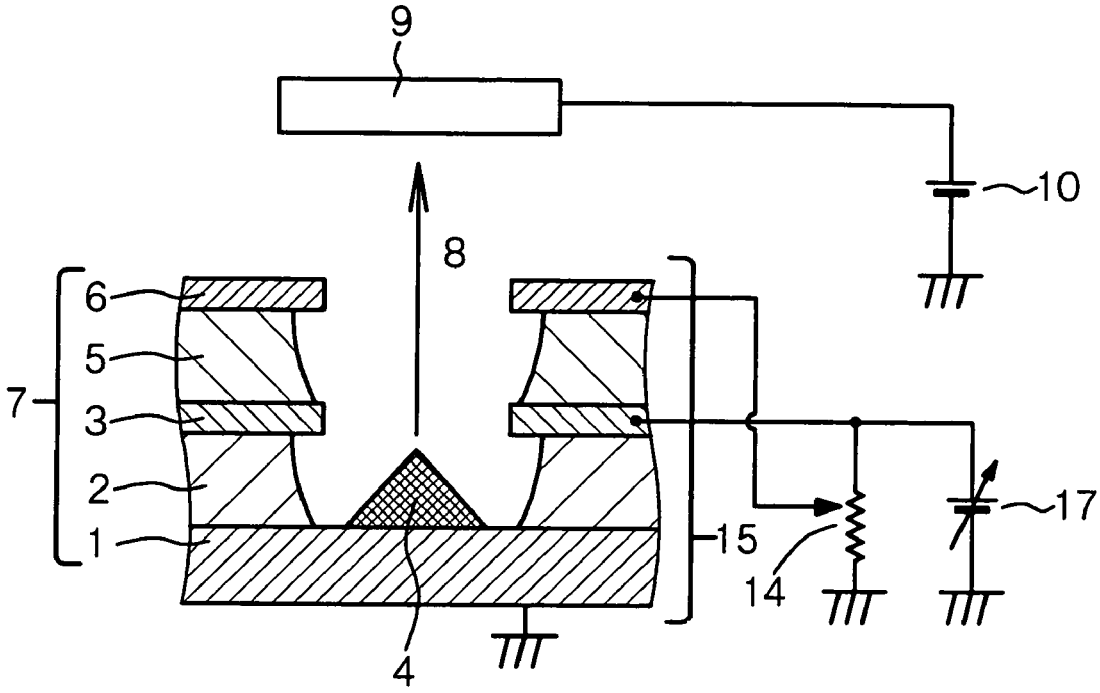
FIG. 26 is a schematic partial end view of a field emission device disclosed in FIG. 2 to JP-A-9-90898.

While the field emission devices in Examples have mainly explained a form in which one opening portion 16B formed through the gate electrode 13 corresponds to one opening portion 16A formed through the focus electrode 15 and the insulating film 14, some structures of the field emission device may use a form in which a plurality of opening portions 16B formed through the gate electrode 13 correspond to one opening portion 16A formed through the focus electrode 15 and the insulating film 14. That is, one opening portion 16A formed through the focus electrode 15 and the insulating film 14 is provided in each electron emitting-region (each overlap region). FIGS. 24 and 25 show such a form. FIG. 24 is a schematic partial end view of such a display. FIG. 25 is a showing of a layout state of the focus electrode 15, the opening portion 16A formed through the focus electrode 15 and the opening portion 16B formed through the gate electrode 13, and it is a schematic drawing obtained by viewing them from above. In FIG. 25, a dotted line shows the gate electrode 13 positioned below the focus electrode 15, and a chain line shows the cathode electrode 11. While a Spindt-type field emission device is shown as a field emission device, a field emission device having any other constitution may be employed.

In the display according to the present invention explained in Examples, the focus electrode may be replaced with a focus electrode which will be explained hereinafter. That is, one example of the focus electrode can be formed by forming an insulation film made, for example, of $SiO_2$ on each surface of a metal sheet made, for example, of 42% Ni—Fe alloy having a thickness of several tens micrometers, and then forming opening portions in regions corresponding to pixels by punching or etching. And, the cathode panel, the metal sheet and the anode panel are stacked, a frame is arranged in the circumferential portions of the two panels, and a heat treatment is carried out to bond the insulation film formed on one surface of the metal sheet and the insulating layer 12 and to bond the insulation layer formed on the other surface of the metal sheet and the anode panel, whereby these members are integrated, followed by evacuating and sealing. In this manner, the display can be also completed.

The gate electrode can be formed so as to have a form in which the effective field is covered with one sheet of an electrically conductive material (having a opening portion). In this case, a positive voltage is applied to the gate electrode. And, a switching element constituted, for example, of TFT is provided between the cathode electrode constituting a pixel and the cathode-electrode control circuit, and the voltage application state to the electron-emitting portion constituting the pixel is controlled by the operation of the above switching element, to control the light emission state of the pixel.

Alternatively, the cathode electrode can be formed so as to have a form in which the effective field is covered with one sheet of an electrically conductive material. In this case, a voltage is applied to the cathode electrode. And, a switching element constituted, for example, of TFT is provided between the electron-emitting portion constituting a pixel and the gate-electrode control circuit, and the voltage application state to the gate electrode constituting the pixel is controlled by the operation of the switching element, to control the light emission state of the pixel.

In the display of the present invention, the relationship of the total energy "Q" required for vaporization of the resistance layer, the electrostatic capacity "C" between the cold cathode field emission device or the focus electrode and the anode electrode, and the voltage $V_A$ applied to the anode electrode are defined, or the thickness $t_R$ of the resistance layer, the capacity "C" between the cold cathode field emission device or the focus electrode and the anode electrode, and the voltage $V_A$ applied to the anode electrode are defined. As a consequence, the occurrence of damage on the resistance layer and elements constituting the anode electrode and the cold cathode field emission device can be reliably suppressed even when a discharge takes place between the cold cathode field emission device or the focus electrode and the anode electrode. Moreover, the formation of the resistance layer can decrease the peak value of a discharge current. As a result of these, there can be obtained cold cathode field emission displays having excellent stability and reliability and having a long lifetime.

Further, the anode electrode may be divided into anode electrode units having a smaller area in place of forming the anode electrode on the entire surface of the effective field. In this case, the electrostatic capacity between each anode electrode unit and the cold cathode field emission device can be decreased, and the generation energy can be decreased. As a result, the size of damage that a discharge causes on the resistance layer or elements constituting the anode electrode and the cold cathode field emission device can be more effectively minimized.

Further, generally, cold cathode field emission displays are subjected to aging treatment immediately after their completion. The aging treatment refers to a treatment that causes electron-emitting regions to gradually emit electrons for brining the surfaces of the electron-emitting regions into a state in which electrons are easily emitted. Specifically, the voltage applied to the cathode electrode, the gate electrode and the anode electrode is gradually brought close to the operation voltage of an actual cold cathode field emission display. By the above aging treatment, residual gas can be gradually released from each of elements constituting the cathode panel and the anode panel, and the release of a large amount of gas from these elements at a time can be prevented. During such aging treatment, an abnormal discharge is liable to take place between the anode electrode and the focus electrode. In the cold cathode field emission display of the present invention, it is possible to reliably prevent the occurrence of damage that the abnormal discharge between the anode electrode and the focus electrode during the aging treatment causes on elements constituting the cold cathode field emission display.

The invention claimed is:

1. A cold cathode field emission display comprising a cathode panel having a plurality of cold cathode field emission devices and an anode panel which panels are bonded to each other in their circumferential portions, the anode panel comprising a substrate, a phosphor layer formed on the substrate, an anode electrode formed on the phosphor layer and a resistance layer for controlling a discharge current, the resistance layer being formed on the anode electrode and having a thickness of $t_R$ (unit: μm), and the cold cathode field emission display satisfying the following expression (1), $$Q>(1/2)C\cdot V_A^2 \quad (1)$$

where $$Q \approx \pi \cdot t_R \cdot r_R^2 \cdot d_R \times [C_{m_S}(T_L - T_r) + Q_{S_L} + C_{m_L}(T_G - T_L) + Q_{L_G}] \times 10^{-6}$$

and,

C: an electrostatic capacity (F) between the cold cathode field emission device and the anode electrode, $V_A$: a voltage (V) to be applied to the anode electrode, $r_R$: a radius (mm) of a vaporization-allowable region of the resistance layer, $d_R$: a density ($g\cdot cm^{-3}$) of a material constituting the resistance layer, $C_{m_S}$: a specific heat ($J\cdot g^{-1}\cdot K^{-1}$) of a material constituting the resistance layer in a solid state, $T_L$: a melting point (° C.) of a material constituting the resistance layer, $T_r$: room temperature (° C.), $Q_{S_L}$: a heat of solution ($J\cdot g^{-1}$) of a material constituting the resistance layer, $C_{m_L}$: a specific heat ($J\cdot g^{-1}\cdot K^{-1}$) of a material constituting the resistance layer in a liquid state, $T_G$: a boiling point (° C.) of a material constituting the resistance layer, and, $Q_{L_G}$: a heat of vaporization ($J\cdot g^{-1}$) of a material constituting the resistance layer.

2. The cold cathode field emission display according to claim 1, in which the cold cathode field emission device comprises:

(a) a cathode electrode being formed on the supporting member and extending in a first direction, (b) an insulating layer formed on the supporting member and the cathode electrode, (c) a gate electrode being formed on the insulating layer and extending in a second direction different from the first direction, (d) an insulating film formed on the gate electrode and the insulating layer, (e) a focus electrode formed on the insulating film, (f) an opening portion formed through the focus electrode, the insulating film, the gate electrode and the insulating layer, and (g) an electron-emitting portion exposed in a bottom portion of the opening portion.

3. The cold cathode field emission display according to claim 2, in which the cold cathode field emission device further comprises:

(h) a second resistance layer for controlling a discharge current, the second resistance layer being formed on the focus electrode and having a thickness of $t'_R$ (unit: μm).

4. The cold cathode field emission display according to claim 1, in which the cold cathode field emission device comprises:

(a) a cathode electrode being formed on a supporting member and extending in a first direction, (b) an insulating layer formed on the supporting member and the cathode electrode, (c) a gate electrode being formed on the insulating layer and extending in a second direction different from the first direction, (d) an opening portion formed through the gate electrode and the insulating layer, and (e) an electron-emitting portion exposed in a bottom portion of the opening portion.

5. The cold cathode field emission display according to claim 1, in which the anode electrode is constituted of a set of N anode electrode units (N≧2), and said "C" represents an electrostatic capacity (unit: F) between the cold cathode field emission device and the anode electrode unit.

6. A cold cathode field emission display comprising a cathode panel having a plurality of cold cathode field emission devices and an anode panel which panels are bonded to each other in their circumferential portions, the anode panel comprising a substrate, a phosphor layer formed on the substrate, an anode electrode formed on the phosphor layer and a resistance layer for controlling a discharge current, the resistance layer being formed on the anode electrode and having a thickness of $t_R$ (unit: μm), and the cold cathode field emission display satisfying the following expression (1), $$Q>(1/2)C\cdot V_A^2 \quad (1)$$

where $$Q\approx\pi\cdot t_R\cdot r_R^2\cdot d_R\times[C_{m_S}(T_G-T_r)+Q_{L_G}]\times 10^{-6}$$

and,

C: an electrostatic capacity (F) between the cold cathode field emission device and the anode electrode, $V_A$: a voltage (V) to be applied to the anode electrode, $r_R$: a radius (mm) of a vaporization-allowable region of the resistance layer, $d_R$: a density ($g\cdot cm^{-3}$) of a material constituting the resistance layer, $C_{m_S}$: a specific heat ($J\cdot g^{-1}\cdot K^{-1}$) of a material constituting the resistance layer in a solid state, $T_r$: room temperature (° C.), $T_G$: a boiling point (° C.) of a material constituting the resistance layer, and $Q_{L_G}$: a sum ($J\cdot g^{-1}$) of a heat of vaporization and a heat of solution of a material constituting the resistance layer.

7. The cold cathode field emission display according to claim 6, in which the cold cathode field emission device comprises:

(a) a cathode electrode being formed on the supporting member and extending in a first direction, (b) an insulating layer formed on the supporting member and the cathode electrode, (c) a gate electrode being formed on the insulating layer and extending in a second direction different from the first direction, (d) an insulating film formed on the gate electrode and the insulating layer, (e) a focus electrode formed on the insulating film, (f) an opening portion formed through the focus electrode, the insulating film, the gate electrode and the insulating layer, and (g) an electron-emitting portion exposed in a bottom portion of the opening portion.

8. The cold cathode field emission display according to claim 7, in which the cold cathode field emission device further comprises:

(h) a second resistance layer for controlling a discharge current, the second resistance layer being formed on the focus electrode and having a thickness of $t'_R$ (unit: μm).

9. The cold cathode field emission display according to claim 6, in which the cold cathode field emission device comprises:

(a) a cathode electrode being formed on a supporting member and extending in a first direction, (b) an insulating layer formed on the supporting member and the cathode electrode, (c) a gate electrode being formed on the insulating layer and extending in a second direction different from the first direction, (d) an opening portion formed through the gate electrode and the insulating layer, and (e) an electron-emitting portion exposed in a bottom portion of the opening portion.

10. The cold cathode field emission display according to claim 6, in which the anode electrode is constituted of a set of N anode electrode units (N≧2), and said "C" represents an electrostatic capacity (unit: F) between the cold cathode field emission device and the anode electrode unit.

11. A cold cathode field emission display comprising a cathode panel having a plurality of cold cathode field emission devices and an anode panel which panels are bonded to each other in their circumferential portions, the anode panel comprising a substrate, a phosphor layer formed on the substrate, an anode electrode formed on the phosphor layer and a resistance layer for controlling a discharge current, the resistance layer being formed on the anode electrode and having a thickness of $t_R$ (unit: μm), and the cold cathode field emission display satisfying the following expression (2), $$t_R \times 10^{-2} > (1/2) C \cdot V_A^2 \quad (2)$$

where

C: an electrostatic capacity (F) between the cold cathode field emission device and the anode electrode, and $V_A$: a voltage (V) to be applied to the anode electrode.

12. The cold cathode field emission display according to claim 11, in which the cold cathode field emission device comprises:

(a) a cathode electrode being formed on the supporting member and extending in a first direction, (b) an insulating layer formed on the supporting member and the cathode electrode, (c) a gate electrode being formed on the insulating layer and extending in a second direction different from the first direction, (d) an insulating film formed on the gate electrode and the insulating layer, (e) a focus electrode formed on the insulating film, (f) an opening portion formed through the focus electrode, the insulating film, the gate electrode and the insulating layer, and (g) an electron-emitting portion exposed in a bottom portion of the opening portion.

13. The cold cathode field emission display according to claim 12, in which the cold cathode field emission device further comprises:

(h) a second resistance layer for controlling a discharge current, the second resistance layer being formed on the focus electrode and having a thickness of $t'_R$ (unit: μm).

14. The cold cathode field emission display according to claim 11, in which the cold cathode field emission device comprises:

(a) a cathode electrode being formed on a supporting member and extending in a first direction, (b) an insulating layer formed on the supporting member and the cathode electrode, (c) a gate electrode being formed on the insulating layer and extending in a second direction different from the first direction, (d) an opening portion formed through the gate electrode and the insulating layer, and (e) an electron-emitting portion exposed in a bottom portion of the opening portion.

15. The cold cathode field emission display according to claim 11, in which the anode electrode is constituted of a set of N anode electrode units (N≧2), and said "C" represents an electrostatic capacity (unit: F) between the cold cathode field emission device and the anode electrode unit.

16. A cold cathode field emission display comprising a cathode panel having a plurality of cold cathode field emission devices and an anode panel which panels are bonded to each other in their circumferential portions, the anode panel comprising a substrate, a phosphor layer formed on the substrate and an anode electrode formed on the phosphor layer, each cold cathode field emission device comprising:

(A) a cathode electrode being formed on a supporting member and extending in a first direction, (B) an insulating layer formed on the supporting member and the cathode electrode, (C) a gate electrode being formed on the insulating layer and extending in a second direction different from the first direction, (D) an insulating film formed on the gate electrode and the insulating layer, (E) a focus electrode formed on the insulating film, (F) a resistance layer for controlling a discharge current, the resistance layer being formed on the focus electrode and having a thickness of $t_R$ (unit: μm), (G) an opening portion formed through the focus electrode, the insulating film, the gate electrode and the insulating layer, and (H) an electron-emitting portion exposed in a bottom portion of the opening portion, and the cold cathode field emission display satisfying the following expression (3), $$Q > (1/2) C \cdot V_A^2 \quad (3)$$

where $$Q \approx \pi \cdot t_R \cdot r_R^2 \cdot d_R \times [C_{m_S}(T_L - T_r) + Q_{S_L} + C_{m_L}(T_G - T_L) + Q_{L_G}] \times 10^{-6}$$

and,

C: an electrostatic capacity (F) between the focus electrode and the anode electrode, $V_A$: a voltage (V) to be applied to the anode electrode, $r_R$: a radius (mm) of a vaporization-allowable region of the resistance layer, $d_R$: a density ($g \cdot cm^{-3}$) of a material constituting the resistance layer, $C_{m_S}$: a specific heat ($J \cdot g^{-1} \cdot K^{-1}$) of a material constituting the resistance layer in a solid state, $T_L$: a melting point (° C.) of a material constituting the resistance layer, $T_r$: room temperature (° C.), $Q_{S_L}$: a heat of solution ($J \cdot g^{-1}$) of a material constituting the resistance layer, $C_{m_L}$: a specific heat ($J \cdot g^{-1} \cdot K^{-1}$) of a material constituting the resistance layer in a liquid state, $T_G$: a boiling point (° C.) of a material constituting the resistance layer, and $Q_{L_G}$: a heat of vaporization ($J \cdot g^{-1}$) of a material constituting the resistance layer.

17. The cold cathode field emission display according to claim 16, in which the anode electrode is constituted of a set of N anode electrode units (N≧2), and said "C" represents an electrostatic capacity (unit: F) between the focus electrode and the anode electrode unit.

18. A cold cathode field emission display comprising a cathode panel having a plurality of cold cathode field emission devices and an anode panel which panels are bonded to each other in their circumferential portions, the anode panel comprising a substrate, a phosphor layer formed on the substrate and an anode electrode formed on the phosphor layer, each cold cathode field emission device comprising:

(A) a cathode electrode being formed on a supporting member and extending in a first direction, (B) an insulating layer formed on the supporting member and the cathode electrode, (C) a gate electrode being formed on the insulating layer and extending in a second direction different from the first direction, (D) an insulating film formed on the gate electrode and the insulating layer, (E) a focus electrode formed on the insulating film, (F) a resistance layer for controlling a discharge current, the resistance layer being formed on the focus electrode and having a thickness of $t_R$ (unit: μm), (G) an opening portion formed through the focus electrode, the insulating film, the gate electrode and the insulating layer, and (H) an electron-emitting portion exposed in a bottom portion of the opening portion, and the cold cathode field emission display satisfying the following expression (3), $$Q > (1/2) C \cdot V_A^2 \quad (3)$$

where $$Q \approx \pi \cdot t_R \cdot r_R^2 \cdot d_R \times [C_{m_S}(T_G - T_r) + Q_{L_G}] \times 10^{-6}$$

and,

C: an electrostatic capacity (F) between the focus electrode and the anode electrode, $V_A$: a voltage (V) to be applied to the anode electrode, $r_R$: a radius (mm) of a vaporization-allowable region of the resistance layer, $d_R$: a density ($g \cdot cm^{-3}$) of a material constituting the resistance layer, $C_{m_S}$: a specific heat ($J \cdot g^{-1} \cdot K^{-1}$) of a material constituting the resistance layer in a solid state, $T_r$: room temperature (° C.), $T_G$: a boiling point (° C.) of a material constituting the resistance layer, and $Q_{L_G}$: a sum ($J \cdot g^{-1}$) of a heat of vaporization and a heat of solution of a material constituting the resistance layer.

19. The cold cathode field emission display according to claim 18, in which the anode electrode is constituted of a set of N anode electrode units (N≧2), and said "C" represents an electrostatic capacity (unit: F) between the focus electrode and the anode electrode unit.

20. A cold cathode field emission display comprising a cathode panel having a plurality of cold cathode field emission devices and an anode panel which panels are bonded to each other in their circumferential portions, the anode panel comprising a substrate, a phosphor layer formed on the substrate and an anode electrode formed on the phosphor layer, each cold cathode field emission device comprising:

(A) a cathode electrode being formed on a supporting member and extending in a first direction, (B) an insulating layer formed on the supporting member and the cathode electrode, (C) a gate electrode being formed on the insulating layer and extending in a second direction different from the first direction, (D) an insulating film formed on the gate electrode and the insulating layer, (E) a focus electrode formed on the insulating film, (F) a resistance layer for controlling a discharge current, the resistance layer being formed on the focus electrode and having a thickness of $t_R$ (unit: μm), (G) an opening portion formed through the focus electrode, the insulating film, the gate electrode and the insulating layer, and (H) an electron-emitting portion exposed in a bottom portion of the opening portion, and the cold cathode field emission display satisfying the following expression (4), $$t_R \times 10^{-2} > (1/2) C \cdot V_A^2 \quad (4)$$

where

C: an electrostatic capacity (F) between the focus electrode and the anode electrode, and $V_A$: a voltage (V) to be applied to the anode electrode.

21. The cold cathode field emission display according to claim 20, in which the anode electrode is constituted of a set of N anode electrode units (N≧2), and said "C" represents an electrostatic capacity (unit: F) between the focus electrode and the anode electrode unit.

* * * * *